US009372016B2

(12) United States Patent
Bloedow et al.

(10) Patent No.: US 9,372,016 B2
(45) Date of Patent: Jun. 21, 2016

(54) TEMPERATURE-STABILIZED STORAGE SYSTEMS WITH REGULATED COOLING

(71) Applicant: Tokitae LLC, Bellevue, WA (US)

(72) Inventors: Jonathan Bloedow, Lynnwood, WA (US); Ryan Calderon, Seattle, WA (US); David Gasperino, Lake Forest Park, WA (US); William Gates, Medina, WA (US); Roderick A. Hyde, Redmond, WA (US); Edward K. Y. Jung, Bellevue, WA (US); Shieng Liu, Bellevue, WA (US); Nathan P. Myhrvold, Medina, WA (US); Nathan John Pegram, Seattle, WA (US); Clarence T. Tegreene, Mercer Island, WA (US); Charles Whitmer, North Bend, WA (US); Lowell L. Wood, Jr., Bellevue, WA (US); Ozgur Emek Yildirim, Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 589 days.

(21) Appl. No.: 13/906,909

(22) Filed: May 31, 2013

(65) Prior Publication Data

US 2014/0352329 A1 Dec. 4, 2014

(51) Int. Cl.
*F25B 21/02* (2006.01)
*F25D 3/06* (2006.01)

(52) U.S. Cl.
CPC . *F25B 21/02* (2013.01); *F25D 3/06* (2013.01); *F25D 2201/14* (2013.01)

(58) Field of Classification Search
CPC ..... F25B 21/02; F25B 21/04; F25D 11/00; H01L 35/20
USPC ..... 62/3.2, 3.3, 3.6; 165/104.33
See application file for complete search history.

(56) References Cited

U.S. PATENT DOCUMENTS

| | | | |
|---|---|---|---|
| 520,584 | A | 5/1894 | Turner |
| 1,903,171 | A | 3/1933 | Cordrey |
| 2,161,295 | A | 6/1939 | Hirschberg |
| 2,496,296 | A | 2/1950 | Lobl |
| 2,717,937 | A | 9/1955 | Lehr et al. |
| 2,967,152 | A | 1/1961 | Matsch et al. |
| 3,029,967 | A | 4/1962 | Morrison |
| 3,034,845 | A | 5/1962 | Haumann |
| 3,069,045 | A | 12/1962 | Haumann et al. |
| 3,108,840 | A | 10/1963 | Conrad et al. |

(Continued)

FOREIGN PATENT DOCUMENTS

| | | | |
|---|---|---|---|
| CN | 2414742 | Y | 1/2001 |
| CN | 2460457 | Y | 11/2001 |

(Continued)

OTHER PUBLICATIONS

3M Monitor Mark™; "Time Temperature Indicators—Providing a visual history of time temperature exposure"; 3M Microbiology; bearing a date of 2006; pp. 1-4; located at 3M.com/microbiology.

(Continued)

*Primary Examiner* — Melvin Jones

(57) ABSTRACT

Regulated cooling devices are described herein that are sized, shaped and calibrated for use with a substantially thermally sealed storage container. In some embodiments, the regulated cooling devices include a cooling region, an adiabatic region, a lid region, and an electronics unit attached to the lid region.

31 Claims, 12 Drawing Sheets

(56) References Cited

U.S. PATENT DOCUMENTS 3,238,002 A 3/1966 O'Connell et al.
3,921,844 A 11/1975 Walles
3,948,411 A 4/1976 Conte
4,003,426 A 1/1977 Best et al.
4,034,129 A 7/1977 Kittle
4,057,029 A 11/1977 Seiter
4,057,101 A 11/1977 Ruka et al.
4,094,127 A 6/1978 Romagnoli
4,154,363 A 5/1979 Barthel
4,184,601 A 1/1980 Stewart et al.
4,312,669 A 1/1982 Boffito et al.
4,318,058 A 3/1982 Mito et al.
4,358,490 A 11/1982 Nagai
4,388,051 A 6/1983 Dresler et al.
4,402,927 A 9/1983 Von Dardel et al.
4,428,854 A 1/1984 Enjo et al.
4,481,779 A 11/1984 Barthel
4,481,792 A 11/1984 Groeger et al.
4,482,465 A 11/1984 Gray
4,521,800 A 6/1985 Howe
4,526,015 A 7/1985 Laskaris
4,640,574 A 2/1987 Unger
4,726,974 A 2/1988 Nowobilski et al.
4,766,471 A 8/1988 Ovshinsky et al.
4,796,432 A 1/1989 Fixsen et al.
4,810,403 A 3/1989 Bivens et al.
4,855,950 A 8/1989 Takada
4,862,674 A 9/1989 Lejondahl et al.
4,920,387 A 4/1990 Takasu et al.
4,951,014 A 8/1990 Wohlert et al.
4,955,204 A 9/1990 Pehl et al.
4,956,976 A 9/1990 Kral et al.
4,969,336 A 11/1990 Knippscheer et al.
4,974,423 A 12/1990 Pring
4,976,308 A 12/1990 Faghri
5,012,102 A 4/1991 Gowlett
5,103,337 A 4/1992 Schrenk et al.
5,116,105 A 5/1992 Hong
5,138,559 A 8/1992 Kuehl et al.
5,187,116 A 2/1993 Kitagawa et al.
5,215,214 A 6/1993 Lev et al.
5,245,869 A 9/1993 Clarke et al.
5,261,241 A 11/1993 Kitahara et al.
5,277,031 A 1/1994 Miller et al.
5,277,959 A 1/1994 Kourtides et al.
5,302,840 A 4/1994 Takikawa
5,330,816 A 7/1994 Rusek, Jr.
5,355,684 A 10/1994 Guice
5,359,890 A 11/1994 Fulton et al.
5,376,184 A 12/1994 Aspden
5,390,734 A 2/1995 Voorhes et al.
5,390,791 A 2/1995 Yeager
5,444,223 A 8/1995 Blama
5,452,565 A 9/1995 Blom et al.
5,505,046 A 4/1996 Nelson et al.
5,548,116 A 8/1996 Pandelisev
5,563,182 A 10/1996 Epstein et al.
5,573,133 A 11/1996 Park
5,579,830 A 12/1996 Giammaruti
5,580,522 A 12/1996 Leonard et al.
5,590,054 A 12/1996 McIntosh
5,600,071 A 2/1997 Sooriakumar et al.
5,607,076 A 3/1997 Anthony
5,633,077 A 5/1997 Olinger
5,671,856 A 9/1997 Lisch
5,679,412 A 10/1997 Kuehnle et al.
5,709,472 A 1/1998 Prusik et al.
5,782,344 A 7/1998 Edwards et al.
5,800,905 A 9/1998 Sheridan et al.
5,821,762 A 10/1998 Hamaguchi et al.
5,829,594 A 11/1998 Warder
5,831,489 A 11/1998 Wire
5,846,224 A 12/1998 Sword et al.
5,846,883 A 12/1998 Moslehi
5,857,778 A 1/1999 Ells
5,900,554 A 5/1999 Baba et al.
5,915,283 A 6/1999 Reed et al.
5,954,101 A 9/1999 Drube et al.
6,030,580 A 2/2000 Raasch et al.
6,042,264 A 3/2000 Prusik et al.
6,050,598 A 4/2000 Upton
6,196,296 B1 * 3/2001 Wisniewski ..... F25D 31/006 165/109.1
6,209,343 B1 4/2001 Owen
6,212,904 B1 4/2001 Arkharov et al.
6,213,339 B1 4/2001 Lee
6,234,341 B1 5/2001 Tattam
6,260,613 B1 7/2001 Pollard, II
6,272,679 B1 8/2001 Norin
6,287,652 B2 9/2001 Speckhals et al.
6,321,977 B1 11/2001 Lee
6,337,052 B1 1/2002 Rosenwasser
6,438,992 B1 8/2002 Smith et al.
6,439,406 B1 8/2002 Duhon
6,453,749 B1 9/2002 Petrovic et al.
6,465,366 B1 10/2002 Nemani et al.
6,467,642 B2 10/2002 Mullens et al.
6,485,805 B1 11/2002 Smith et al.
6,521,077 B1 2/2003 McGivern et al.
6,571,971 B1 6/2003 Weiler
6,584,797 B1 7/2003 Smith et al.
6,624,349 B1 9/2003 Bass
6,673,594 B1 1/2004 Owen et al.
6,688,132 B2 2/2004 Smith et al.
6,692,695 B1 2/2004 Bronshtein et al.
6,701,724 B2 3/2004 Smith et al.
6,742,650 B2 6/2004 Yang et al.
6,742,673 B2 6/2004 Credle, Jr. et al.
6,751,963 B2 6/2004 Navedo et al.
6,771,183 B2 8/2004 Hunter
6,806,808 B1 10/2004 Watters et al.
6,808,011 B2 10/2004 Lindemuth et al.
6,813,330 B1 11/2004 Barker et al.
6,841,917 B2 1/2005 Potter
6,877,504 B2 4/2005 Schreff et al.
6,967,051 B1 11/2005 Augustynowicz et al.
6,997,241 B2 2/2006 Chou et al.
7,001,656 B2 2/2006 Maignan et al.
7,038,585 B2 5/2006 Hall et al.
7,128,807 B2 10/2006 Mörschner et al.
7,240,513 B1 7/2007 Conforti
7,253,788 B2 8/2007 Choi et al.
7,258,247 B2 8/2007 Marquez
7,267,795 B2 9/2007 Ammann et al.
7,278,278 B2 10/2007 Wowk et al.
7,596,957 B2 10/2009 Fuhr et al.
7,789,258 B1 9/2010 Anderson
7,807,242 B2 10/2010 Soerensen et al.
7,982,673 B2 7/2011 Orton et al.
8,074,271 B2 12/2011 Davis et al.
8,138,913 B2 3/2012 Nagel et al.
8,174,369 B2 5/2012 Jones et al.
8,211,516 B2 7/2012 Bowers et al.
2002/0050514 A1 5/2002 Schein
2002/0083717 A1 7/2002 Mullens et al.
2002/0084235 A1 7/2002 Lake
2002/0130131 A1 9/2002 Zucker et al.
2002/0155699 A1 10/2002 Ueda
2002/0187618 A1 12/2002 Potter
2003/0039446 A1 2/2003 Hutchinson et al.
2003/0072687 A1 4/2003 Nehring et al.
2003/0148773 A1 8/2003 Spriestersbach et al.
2003/0160059 A1 8/2003 Credle, Jr. et al.
2004/0035120 A1 2/2004 Brunnhofer
2004/0055313 A1 3/2004 Navedo et al.
2004/0055600 A1 3/2004 Izuchukwu
2004/0103302 A1 5/2004 Yoshimura et al.
2004/0113790 A1 6/2004 Hamel et al.
2004/0145533 A1 7/2004 Taubman
2005/0009192 A1 1/2005 Page
2005/0029149 A1 2/2005 Leung et al.
2005/0053345 A1 3/2005 Bayindir et al.
2005/0067441 A1 3/2005 Alley
2005/0143787 A1 6/2005 Boveja et al.

(56) References Cited

U.S. PATENT DOCUMENTS

| | | | |
|---|---|---|---|
| 2005/0188715 | A1 | 9/2005 | Aragon |
| 2005/0247312 | A1 | 11/2005 | Davies |
| 2005/0255261 | A1 | 11/2005 | Nomula |
| 2005/0274378 | A1 | 12/2005 | Bonney et al. |
| 2006/0021355 | A1 | 2/2006 | Boesel et al. |
| 2006/0027467 | A1 | 2/2006 | Ferguson |
| 2006/0054305 | A1 | 3/2006 | Ye |
| 2006/0071585 | A1 | 4/2006 | Wang |
| 2006/0086808 | A1 | 4/2006 | Appalucci et al. |
| 2006/0150662 | A1 | 7/2006 | Lee et al. |
| 2006/0187026 | A1 | 8/2006 | Kochis |
| 2006/0191282 | A1 | 8/2006 | Sekiya et al. |
| 2006/0196876 | A1 | 9/2006 | Rohwer |
| 2006/0220978 | A1 | 10/2006 | Atchiriki |
| 2006/0259188 | A1 | 11/2006 | Berg |
| 2006/0280007 | A1 | 12/2006 | Ito et al. |
| 2007/0041814 | A1 | 2/2007 | Lowe |
| 2007/0046559 | A1 | 3/2007 | Youn |
| 2007/0210090 | A1 | 9/2007 | Sixt et al. |
| 2008/0012577 | A1 | 1/2008 | Potyrailo et al. |
| 2008/0022698 | A1 | 1/2008 | Hobbs et al. |
| 2008/0060215 | A1 | 3/2008 | Reilly et al. |
| 2008/0129511 | A1 | 6/2008 | Yuen et al. |
| 2008/0164265 | A1 | 7/2008 | Conforti |
| 2008/0184719 | A1 | 8/2008 | Lowenstein |
| 2008/0186139 | A1 | 8/2008 | Butler et al. |
| 2008/0231453 | A1 | 9/2008 | Corder |
| 2008/0233391 | A1 | 9/2008 | Sterzel et al. |
| 2008/0269676 | A1 | 10/2008 | Bieberich et al. |
| 2008/0272131 | A1 | 11/2008 | Roberts et al. |
| 2008/0297346 | A1 | 12/2008 | Brackmann et al. |
| 2009/0049845 | A1 | 2/2009 | McStravick et al. |
| 2009/0275478 | A1 | 11/2009 | Atkins et al. |
| 2009/0301125 | A1 | 12/2009 | Myles et al. |
| 2009/0309733 | A1 | 12/2009 | Moran et al. |
| 2010/0016168 | A1 | 1/2010 | Atkins et al. |
| 2010/0028214 | A1 | 2/2010 | Howard et al. |
| 2010/0265068 | A1 | 10/2010 | Brackmann et al. |
| 2010/0287963 | A1 | 11/2010 | Billen et al. |
| 2011/0100605 | A1 | 5/2011 | Zheng et al. |
| 2011/0117538 | A1 | 5/2011 | Niazi |
| 2011/0248825 | A1 | 10/2011 | Hamel et al. |
| 2011/0297306 | A1 | 12/2011 | Yang |
| 2012/0168645 | A1 | 7/2012 | Atzmony et al. |
| 2013/0306656 | A1 | 11/2013 | Eckhoff et al. |

FOREIGN PATENT DOCUMENTS

| | | | |
|---|---|---|---|
| CN | 1496537 | A | 5/2004 |
| CN | 1756912 | A | 4/2006 |
| CN | 1827486 | A | 9/2006 |
| CN | 101073524 | A | 11/2007 |
| FR | 2 621 685 | | 10/1987 |
| GB | 2 441 636 | A | 3/2008 |
| WO | WO 94/15034 | | 7/1994 |
| WO | WO 99/36725 | A1 | 7/1999 |
| WO | WO 2005/084353 | A2 | 9/2005 |
| WO | WO 2007/039553 | A2 | 4/2007 |

OTHER PUBLICATIONS

Adams, R. O.; "A review of the stainless steel surface"; The Journal of Vacuum Science and Technology A; Bearing a date of Jan.-Mar. 1983; pp. 12-18; vol. 1, No. 1; American Vacuum Society.

Arora, Anubhav; Hakim, Itzhak; Baxter, Joy; Rathnasingham, Ruben; Srinivasan, Ravi; Fletcher, Daniel A.; "Needle-Free Delivery Of Macromolecules Across The Skin By Nanoliter-Volume Pulsed Microjets"; PNAS Applied Biological Sciences; Mar. 13, 2007; pp. 4255-4260; vol. 104; No. 11; The National Academy of Sciences USA.

Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).

Bapat, S. L. et al.; "Experimental investigations of multilayer insulation"; *Cryogenics*; Bearing a date of Aug. 1990; pp. 711-719; vol. 30.

Bapat, S. L. et al.; "Performance prediction of multilayer insulation"; *Cryogenics*; Bearing a date of Aug. 1990; pp. 700-710; vol. 30.

Barth, W. et al.; "Experimental investigations of superinsulation models equipped with carbon paper"; *Cryogenics*; Bearing a date of May 1988; pp. 317-320; vol. 28.

Barth, W. et al.; "Test results for a high quality industrial superinsulation"; *Cryogenics*; Bearing a date of Sep. 1988; pp. 607-609; vol. 28.

Bartl, J., et al.; "Emissivity of aluminium and its importance for radiometric measurement"; Measurement Science Review; Bearing a date of 2004; pp. 31-36; vol. 4, Section 3.

Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.

Benvenuti, C.; "Decreasing surface outgassing by thin film getter coatings"; *Vacuum*; Bearing a date of 1998; pp. 57-63; vol. 50; No. 1-2; Elsevier Science Ltd.

Benvenuti, C.; "Nonevaporable getter films for ultrahigh vacuum applications"; *Journal of Vacuum Science Technology A Vacuum Surfaces, and Films*; Bearing a date of Jan./Feb. 1998; pp. 148-154; vol. 16; No. 1; American Chemical Society.

Benvenuti, C. et al.; "Obtention of pressures in the $10^{-14}$ torr range by means of a Zr V Fe non evaporable getter"; *Vacuum*; Bearing a date of 1993; pp. 511-513; vol. 44; No. 5-7; Pergamon Press Ltd.

Benvenuti, C., et al.; "Pumping characteristics of the St707 nonevaporable getter (Zr 70 V 24.6-Fe 5.4 wt %)"; The Journal of Vacuum Science and Technology A; Bearing a date of Nov.-Dec. 1996; pp. 3278-3282; vol. 14, No. 6; American Vacuum Society.

Berman, A.; "Water vapor in vacuum systems"; *Vacuum*; Bearing a date of 1996; pp. 327-332; vol. 47; No. 4; Elsevier Science Ltd.

Bernardini, M. et al.; "Air bake-out to reduce hydrogen outgassing from stainless steel"; *Journal of Vacuum Science Technology*; Bearing a date of Jan./Feb. 1998; pp. 188-193; vol. 16; No. 1; American Chemical Society.

Bine Informationsdienst; "Zeolite/water refrigerators, Projektinfo 16/10"; BINE Information Service; printed on Feb. 12, 2013; pp. 1-4; FIZ Karlsruhe, Germany; located at: http://www.bine.info/fileadmin/content/Publikationen/Englische_Infos/projekt_1610_engl_internetx.pdf.

Bo, H. et al.; "Tetradecane and hexadecane binary mixtures as phase change materials (PCMs) for cool storage in district cooling systems"; *Energy*; Bearing a date of 1999; vol. 24; pp. 1015-1028; Elsevier Science Ltd.

Boffito, C. et al.; "A nonevaporable low temperature activatable getter material"; *Journal of Vacuum Science Technology*; Bearing a date of Apr. 1981; pp. 1117-1120; vol. 18; No. 3; American Vacuum Society.

Brenzel, Logan; Wolfson, Lara J.; Fox-Rushby, Julia; Miller, Mark; Halsey, Neal A.; "Vaccine-Preventable Diseases—Chapter 20"; Disease Control Priorities in Developing Countries; printed on Oct. 15, 2007; pp. 389-411.

Brown, R.D.; "Outgassing of epoxy resins in vacumm."; *Vacuum*; Bearing a date of 1967; pp. 25-28; vol. 17; No. 9; Pergamon Press Ltd.

Burns, H. D.; "Outgassing Test for Non-metallic Materials Associated with Sensitive Optical Surfaces in a Space Environment"; MSFC-SPEC-1443; Bearing a date of Oct. 1987; pp. 1-10.

Cabeza, L. F. et al.; "Heat transfer enhancement in water when used as PCM in thermal energy storage"; Applied Thermal Engineering; 2002; pp. 1141-1151; vol. 22; Elsevier Science Ltd.

CDC; "Vaccine Management: Recommendations for Storage and Handling of Selected Biologicals"; Jan. 2007; 16 pages total; Department of Health & Human Services U.S.A.

Chen, Dexiang et al.; "Characterization of the freeze sensitivity of a hepatitis B vaccine"; Human Vaccines; Jan. 2009; pp. 26-32; vol. 5, Issue 1; Landes Bioscience.

(56) References Cited

OTHER PUBLICATIONS

Chen, Dexiang, et al.; "Opportunities and challenges of developing thermostable vaccines"; Expert Reviews Vaccines; 2009; pp. 547-557; vol. 8, No. 5; Expert Reviews Ltd.
Chen, G. et al.; "Performance of multilayer insulation with slotted shield"; *Cryogenics ICEC Supplement*; Bearing a date of 1994; pp. 381-384; vol. 34.
Chen, J. R.; "A comparison of outgassing rate of 304 stainless steel and A6063-EX aluminum alloy vacuum chamber after filling with water"; *Journal of Vacuum Science Technology A Vacuum Surfaces and Film*; Bearing a date of Mar. 1987; pp. 262-264; vol. 5; No. 2; American Chemical Society.
Chen, J. R. et al.; "An aluminum vacuum chamber for the bending magnet of the SRRC synchrotron light source"; *Vacuum*; Bearing a date of 1990; pp. 2079-2081; vol. 41; No. 7-9; Pergamon Press PLC.
Chen, J. R. et al.; "Outgassing behavior of A6063-EX aluminum alloy and SUS 304 stainless steel"; *Journal of Vacuum Science Technology*; Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; *Journal of Vacuum Science Technology*; Bearing a date of Jul./Aug. 1994; pp. 1750-1754; vol. 12; No. 4; American Vacuum Society.
Chen, J. R. et al.; "Thermal outgassing from aluminum alloy vacuum chambers"; *Journal of Vacuum Science Technology*; Bearing a date of Nov./Dec. 1985; pp. 2188-2191; vol. 3; No. 6; American Vacuum Society.
Chiggiato, P.; "Production of extreme high vacuum with non evaporable getters" *Physica Scripta*; Bearing a date of 1997; pp. 9-13; vol. T71.
Chinese State Intellectual Property Office; Office Action; App. No. 200980109399.4; Aug. 29, 2012; pp. 1-12 (No translation provided).
Chinese State Intellectual Property Office; Office Action; App. No. 200880120367.X; Oct. 25, 2012; pp. 1-5 (No translation provided).
Chinese State Intellectual Property Office; Office Action; App. No. 200880120366.5; Feb. 17, 2013 (received by our agent Feb. 19, 2013); pp. 1-3 (No translation provided).
Chinese State Intellectual Property Office; Office Action; App. No. 200880120366.5; Jun. 1, 2012; pp. 1-19 (No translation provided).
Chinese State Intellectual Property Office; Office Action; App. No. 200880119918.0; Dec. 12, 2012; pp. 1-11 (No translation provided).
Chinese State Intellectual Property Office; Office Action; App. No. 200880119918.0; Jul. 13, 2011; pp. 1-9 (No translation provided).
Chinese State Intellectual Property Office; Office Action; App. No. 200880119777.2; Jan. 7, 2013 (received by our agent on Jan. 9, 2013); pp. 1-12 (No translation provided).
Chinese State Intellectual Property Office; Office Action; App. No. 200880119777.2; Mar. 30, 2012; pp. 1-10 (No translation provided).
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315, The American Association for the Advancement of Science.
Cho, B.; "Creation of extreme high vacuum with a turbomolecular pumping system: A baking approach"; *Journal of Vacuum Science Technology*; Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; *Composites Part B: Engineering*; Bearing a date of 2008; pp. 782-791; vol. 39; Elsevier Science Ltd.
Chun, I. et al.; "Effect of the Cr-rich oxide surface on fast pumpdown to ultrahigh vacuum"; *Journal of Vacuum Science Technology A Vacuum, Surfaces, and Films*; Bearing a date of Sep./Oct. 1997; pp. 2518-2520; vol. 15; No. 5; American Vacuum Society.
Chun, I. et al.; "Outgassing rate characteristic of a stainless-steel extreme high vacuum system"; *Journal of Vacuum Science Technology*; Bearing a date of Jul./Aug. 1996; pp. 2636-2640; vol. 14; No. 4; American Vacuum Society.
Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.
Cole-Parmer; "Temperature Labels and Crayons"; www.coleparmer.com; bearing a date of 1971 and printed on Sep. 27, 2007; p. 1.
Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.
Cool-System Keg Gmbh; "Cool-System presents: CoolKeg® The world's first self-chilling Keg!"; printed on Feb. 6, 2013; pp. 1-5; located at: http://www.coolsystem.de/.
Cornell University Coop; "The Food Keeper"; printed on Oct. 15, 2007; 7 pages total (un-numbered).
Crawley, D J. et al.; "Degassing Characteristics of Some 'O' Ring Materials"; *Vacuum*; Bearing a date of 1963; pp. 7-9; vol. 14; Pergamon Press Ltd.
Csernatony, L.; "The Properties of Viton 'A' Elastomers II. The influence of permeation, diffusion and solubility of gases on the gas emission rate from an O-ring used as an atmospheric seal or high vacuum immersed"; *Vacuum*; Bearing a date of 1965; pp. 129-134; vol. 16; No. 3; Pergamon Press Ltd.
Daryabeigi, Kamran; "Thermal Analysis And Design Optimization Of Multilayer Insulation For Reentry Aerodynamic Heating"; Journal Of Spacecraft And Rockets; Jul.-Aug. 2002; pp. 509-514; vol. 39; No. 4; American Institute of Aeronautics and Astronautics Inc.
Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.
Day, C.; "The use of active carbons as cryosorbent"; *Colloids and Surfaces A Physicochemical and Engineering Aspects*; Bearing a date of 2001; pp. 187-206; vol. 187-188; Elsevier Science.
Della Porta, P.; "Gas problem and gettering in sealed-off vacuum devices"; *Vacuum*; Bearing a date of 1996; pp. 771-777; vol. 47; No. 6-8 Elsevier Science Ltd.
Demko, J. A., et al.; "Design Tool for Cryogenic Thermal Insulation Systems"; Advances in Cryogenic Engineering: Transactions of the Cryogenic Engineering Conference-CEC; Bearing a date of 2008; pp. 145-151; vol. 53; American Institute of Physics.
Department of Health and Social Services, Division of Public Health, Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.
Dometic S.A.R.L.; "Introduction of Zeolite Technology into refrigeration systems, LIFE04 ENV/LU/000829, Layman's Report"; printed on Feb. 6, 2013; pp. 1-10; located at: http://ec.europa.eu/environment/life/project/Projects/index.cfm?fuseaction=home.showFile&rep=file&fil=LIFE04_ENV_LU_000829_LAYMAN.pdf.
Dow Chemical Company; "Calcium Chloride Handbook: A Guide to Properties, Forms, Storage and Handling"; Aug. 2003; pp. 1-28.
Dylla, H. F. et al.; "Correlation of outgassing of stainless steel and aluminum with various surface treatments"; *Journal of Vacuum Science Technology*; Bearing a date of Sep./Oct. 1993; pp. 2623-2636; vol. 11; No. 5; American Vacuum Society.
Edstam, James S. et al.; "Exposure of hepatitis B vaccine to freezing temperatures during transport to rural health centers in Mongolia"; Preventive Medicine; 2004; pp. 384-388; vol. 39;The Institute For Cancer Prevention and Elsevier Inc.
Efe, Emine et al.; "What do midwives in one region in Turkey know about cold chain?"; Midwifery; 2008; pp. 328-334; vol. 24; Elsevier Ltd.
Elsey, R. J. "Outgassing of vacuum material I"; *Vacuum*; Bearing a date of 1975; pp. 299-306; vol. 25; No. 7; Pergamon Press Ltd.
Elsey, R. J. "Outgassing of vacuum materials II" *Vacuum*; Bearing a date of 1975; pp. 347-361; vol. 25; No. 8; Pergamon Press Ltd.

(56) References Cited

OTHER PUBLICATIONS

Engelmann, G. et al.; "Vacuum chambers in composite material"; *Journal of Vacuum Science Technology*; Bearing a date of Jul./Aug. 1987; pp. 2337-2341; vol. 5; No. 4; American Vacuum Society.
Ette, Ene I.; "Conscience, the Law, and Donation of Expired Drugs"; The Annals of Pharmacotherapy; Jul./Aug. 2004; pp. 1310-1313; vol. 38.
Eyssa, Y. M. et al.; "Thermodynamic optimization of thermal radiation shields for a cryogenic apparatus"; *Cryogenics*; Bearing a date of May 1978; pp. 305-307; vol. 18; IPC Business Press.
Ferrotec; "Ferrofluid: Magnetic Liquid Technology"; bearing dates of 2001-2008; printed on Mar. 10, 2008; found at http://www.ferrotec.com/technology/ferrofluid.php.
Fricke, Jochen; Emmerling, Andreas; "Aerogels—Preparation, Properties, Applications"; Structure And Bonding; 1992; pp. 37-87; vol. 77; Springer-Verlag Berlin Heidelberg.
Gast Manufacturing, Inc.; "Vacuum and Pressure Systems Handbook"; printed on Jan. 3, 2013; pp. 1-20; located at: http://www.gastmfg.com/vphb/vphb_s1.pdf.
Gea Wiegand; "Pressure loss in vacuum lines with water vapour"; printed on Mar. 13, 2013; pp. 1-2; located at: http://produkte.gea-wiegand.de/GEA/GEACategory/139/index_en.html.
Glassford, A. P. M. et al.; "Outgassing rate of multilayer insulation"; 1978; Bearing a date of 1978; pp. 83-106.
Greenbox Systems; "Thermal Management System"; 2010; Printed on: Feb. 3, 2011; p. 1 of 1; located at http://www.greenboxsystems.com.
Günter, M. M. et al.; "Microstructure and bulk reactivity of the nonevaporable getter Zr57V36Fe7"; J. Vac. Sci. Technol. A; Nov./Dec. 1998; pp. 3526-3535; vol. 16, No. 6; American Vacuum Society.
Gupta, A. K. et al.; "Outgassing from epoxy resins and methods for its reduction"; *Vacuum*; Bearing a date of 1977; pp. 61-63; vol. 27; No. 12; Pergamon Press Ltd.
HaŁ aczek, T. et al.; "Flat-plate cryostat for measurements of multilayer insulation thermal conductivity"; *Cryogenics*; Bearing a date of Oct. 1985; pp. 593-595; vol. 25; Butterworth & Co. Ltd.
HaŁ aczek, T. et al.; "Unguarded cryostat for thermal conductivity measurements of multilayer insulations"; *Cryogenics*; Bearing a date of Sep. 1985; pp. 529-530; vol. 25; Butterworth & Co. Ltd.
HaŁ aczek, T. L. et al.; "Heat transport in self-pumping multilayer insulation"; *Cryogenics*; Bearing a date of Jun. 1986; pp. 373-376; vol. 26; Butterworth & Co. Ltd.
HaŁ aczek, T. L. et al.; "Temperature variation of thermal conductivity of self-pumping multilayer insulation"; *Cryogenics*; Bearing a date of Oct. 1986; pp. 544-546.; vol. 26; Butterworth & Co. Ltd.
Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.
Halldorórsson, Árni, et al.; "The sustainable agenda and energy efficiency: Logistics solutions and supply chains in times of climate change"; *International Journal of Physical Distribution & Logistics Management*; Bearing a date of 2010; pp. 5-13; vol. 40; No. ½; Emerald Group Publishing Ltd.
Halliday, B. S.; "An introduction to materials for use in vacuum"; *Vacuum*; Bearing a date of 1987; pp. 583-585; vol. 37; No. 8-9; Pergamon Journals Ltd.
Hedayat, A., et al.; "Variable Density Multilayer Insulation for Cryogenic Storage"; Contract NAS8-40836; 36$^{th}$ Joint Propulsion Conference; Bearing a date of Jul. 17-19, 2000; pp. 1-10.
Hipgrave, David B. et al.; "Immunogenicity Of A Locally Produced Hepatitis B Vaccine With The Birth Dose Stored Outside The Cold Chain In Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hirohata, Y.; "Hydrogen desorption behavior of aluminium materials used for extremely high vacuum chamber"; *Journal of Vacuum Science Technology*; Bearing a date of Sep./Oct. 1993; pp. 2637-2641; vol. 11; No. 5; American Vacuum Society.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Holtrop, K. L. et al.; "High temperature outgassing tests on materials used in the DIII-D tokamak"; *Journal of Vacuum Science Technology*; Bearing a date of Jul./Aug. 2006; pp. 1572- ; vol. 24; No. 4; American Vacuum Society.
Hong, S. et al.; "Investigation of gas species in a stainless steel ultrahigh vacuum chamber with hot cathode ionization gauges"; *Measurement Science and Technology*; Bearing a date of 2004; pp. 359-364; vol. 15; IOP Science.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.
Ishikawa, Y.; "An overview of methods to suppress hydrogen outgassing rate from austenitic stainless steel with reference to UHV and EXV"; *Vacuum*; Bearing a date of 2003; pp. 501-512; vol. 69; No. 4; Elsevier Science Ltd.
Ishikawa, Y. et al.; "Reduction of outgassing from stainless surfaces by surface oxidation"; *Vacuum*; Bearing a date of 1990; pp. 1995-1997; vol. 4; No. 7-9; Pergamon Press PLC.
Ishimaru, H.; "All-aluminum-alloy ultrahigh vacuum system for a large-scale electron-positron collider"; *Journal of Vacuum Science Technology*; Bearing a date of Jun. 1984; pp. 1170-1175; vol. 2; No. 2; American Vacuum Society.
Ishimaru, H.; "Aluminium alloy-sapphire sealed window for ultrahigh vacuum"; *Vacuum*; Bearing a date of 1983; pp. 339-340.; vol. 33; No. 6; Pergamon Press Ltd.
Ishimaru, H.; "Bakeable aluminium vacuum chamber and bellows with an aluminium flange and metal seal for ultra-high vacuum"; *Journal of Vacuum Science Technology*; Bearing a date of Nov./Dec. 1978; pp. 1853-1854; vol. 15; No. 6; American Vacuum Society.
Ishimaru, H.; "Ultimate pressure of the order of $10^{-13}$ Torr in an aluminum alloy vacuum chamber"; *Journal of Vacuum Science and Technology*; Bearing a date of May/Jun. 1989; pp. 2439-2442; vol. 7; No. 3; American Vacuum Society.
Ishimaru, H. et al.; "All Aluminum Alloy Vacuum System for the TRISTAN e+ e-Storage"; *IEEE Transactions on Nuclear Science*; Bearing a date of Jun. 1981; pp. 3320-3322; vol. NS-28; No. 3.
Ishimaru, H. et al.; "Fast pump-down aluminum ultrahigh vacuum system"; *Journal of Vacuum Science Technology*; Bearing a date of May/Jun. 1992; pp. 547-552 ; vol. 10; No. 3; American Vacuum Society.
Ishimaru, H. et al.; "Turbomolecular pump with an ultimate pressure of $10^{-12}$ Torr"; *Journal of Vacuum Science Technology*; Bearing a date of Jul./Aug. 1994; pp. 1695-1698; vol. 12; No. 4; American Vacuum Society.
Jacob, S. et al.; "Investigations into the thermal performance of multilayer insulation (300-77 K) Part 1: Calorimetric studies"; *Cryogenics*; Bearing a date of 1992; pp. 1137-1146; vol. 32; No. 12; Butterworth-Heinemann Ltd.
Jacob, S. et al.; "Investigations into the thermal performance of multilayer insulation (300-77 K) Part 2: Thermal analysis"; *Cryogenics*; Bearing a date of 1992; pp. 1147-1153; vol. 32; No. 12; Butterworth-Heinemann Ltd.
JAMC; "Preventing Cold Chain Failure: Vaccine Storage and Handling"; JAMC; Oct. 26, 2004; p. 1050; vol. 171; No. 9; Canadian Medical Association.
Jenkins, C. H. M.; "Gossamer spacecraft: membrane and inflatable structures technology for space applications"; AIAA; Bearing a date of 2000; pp. 503-527; vol. 191.
Jhung, K. H. C. et al.; "Achievement of extremely high vacuum using a cryopump and conflat aluminium"; *Vacuum*; Bearing a date of 1992; pp. 309-311; vol. 43; No. 4; Pergamon Press PLC.
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical

(56) References Cited

OTHER PUBLICATIONS

Medicine and Hygiene; 2006; pp. 750-754; vol. 74; No. 5; The American Society of Tropical Medicine and Hygiene.
Kato, S. et al.; "Achievement of extreme high vacuum in the order of $10^{-10}$ Pa without baking of test chamber"; *Journal of Vacuum Science Technology*; Bearing a date of May/Jun. 1990; pp. 2860-2864; vol. 8 ; No. 3; American Vacuum Society.
Keller, C. W., et al.; "Thermal Performance of Multilayer Insulations, Final Report, Contract NAS 3-14377"; Bearing a date of Apr. 5, 1974; pp. 1-446.
Keller, K. et al.; "Application of high temperature multilayer insulations"; *Acta Astronautica* ; Bearing a date of 1992; pp. 451-458; vol. 26; No. 6; Pergamon Press Ltd.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Kozubal, et al.; "Desiccant Enhanced Evaporative Air-Conditioning (DEVap): Evaluation of a New Concept in Ultra Efficient Air Conditioning, Technical Report NREL/TP-5500-49722"; National Renewable Energy Laboratory; Jan. 2011; pp. i-vii, 1-60, plus three cover pages and Report Documentation Page.
Koyatsu, Y. et al. "Measurements of outgassing rate from copper and copper alloy chambers"; *Vacuum*; Bearing a date of 1996; pp. 709-711; vol. 4; No. 6-8; Elsevier Science Ltd.
Kristensen, D. et al.; "Stabilization of vaccines: Lessons learned"; *Human Vaccines*; Bearing a date of Mar. 2010; pp. 227-231; vol. 6; No. 3; Landes Bioscience.
Kropschot, R. H.; "Multiple layer insulation for cryogenic applications"; *Cryogenics*; Bearing a date of Mar. 1961; pp. 135-135; vol. 1.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Li, Y.; "Design and pumping characteristics of a compact titanium—vanadium non-evaporable getter pump"; *Journal of Vacuum Science Technology*; Bearing a date of May/Jun. 1998; pp. 1139-1144; vol. 16; No. 3; American Vacuum Society.
Li, Yang et al.; "Study on effect of liquid level on the heat leak into vertical cryogenic vessels"; Cryogenics; 2010; pp. 367-372; vol. 50; Elsevier Ltd.
Little, Arthur D.; "Liquid Propellant Losses During Space Flight, Final Report on Contract No. NASw-615"; Bearing a date of Oct. 1964; pp. 1-315.
Liu, Y. C. et al.; "Thermal outgassing study on aluminum surfaces"; *Vacuum*; Bearing a date of 1993; pp. 435-437; vol. 44; No. 5-7; Pergamon Press Ltd.
Llanos-Cuentas, A.; Campos, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute Plasmodium Falciparum Malaria in Peru"; The Brazilian Journal of Infectious Diseases; 2001; pp. 67-72; vol. 5; No. 2; The Brazilian Journal of Infectious Diseases and Contexto Publishing.
Lockheed Missiles & Space Company; "High-Performance Thermal Protection Systems, Contract NAS 8-20758, Volume II"; Bearing a date of Dec. 31, 1969; pp. 1-117.
Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4° C to 55° C"; 12th Conference on Retroviruses and Opportunistic Infections, Boston, Massachusetts; Feb. 22-25, 2005; p. 1; Foundation for Retrovirology and Human Health.
Londer, H. et al.; "New high capacity getter for vacuum insulated mobile $LH_2$ storage tank systems"; *Vacuum*; Bearing a date of 2008; pp. 431-434; vol. 82; No. 4; Elsevier Ltd.
Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.
Machine-History.com; "Refrigeration Machines"; printed on Mar. 27, 2013; pp. 1-10; located at: http://www.machine-history.com/Refigeration%20Machines.
Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.
Marquardt, Niels; "Introduction to the Principles of Vacuum Physics"; 1999; pp. 1-24; located at: http://www.cientificosaficionados.com/libros/CERN/vaciol-CERN.pdf.
Matolin, V. et al.; "Static SIMS study of TiZrV NEG activation"; Vacuum; 2002; pp. 177-184; vol. 67; Elsevier Science Ltd.
Matsuda, A. et al.; "Simple structure insulating material properties for multilayer insulation"; *Cryogenics*; Bearing a date of Mar. 1980; pp. 135-138; vol. 20; IPC Business Press.
Matthias, Dipika M., et al.; "Freezing temperatures in the vaccine cold chain: A systematic literature review"; Vaccine; 2007; pp. 3980-3986; vol. 25; Elsevier Ltd.
Mikhalchenko, R. S. et al.; "Study of heat transfer in multilayer insulations based on composite spacer materials."; *Cryogenics*; Bearing a date of Jun. 1983; pp. 309-311; vol. 23; Butterworth & Co. Ltd.
Mikhalchenko, R. S. et al.; "Theoretical and experimental investigation of radiative-conductive heat transfer in multilayer insulation"; *Cryogenics*; Bearing a date of May 1985; pp. 275-278; vol. 25; Butterworth & Co. Ltd.
Miki, M. et al.; "Characteristics of extremely fast pump-down process in an aluminum ultrahigh vacuum system"; *Journal of Vacuum Science Technology*; Bearing a date of Jul./Aug. 1994; pp. 1760-1766; vol. 12; No. 4; American Vacuum Society.
Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modernmechanix.com/icyball-is-practical-refrigerator-for-farm-or-camp-use/.
Mohri, M. et al.; "Surface study of Type 6063 aluminium alloys for vacuum chamber materials"; *Vacuum*; Bearing a date of 1984; pp. 643-647; vol. 34; No. 6; Pergamon Press Ltd.
Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.
Moshfegh, B.; "A New Thermal Insulation System for Vaccine Distribution; Journal of Thermal Insulation"; Jan. 1992; pp. 226-247; vol. 15; Technomic Publishing Co., Inc.
Mukugi, K. et al.; "Characteristics of cold cathode gauges for outgassing measurements in uhv range"; *Vacuum*; Bearing a date of 1993; pp. 591-593; vol. 44; No. 5-7; Pergamon Press Ltd.
Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.
Nemanič, V.; "Outgassing of thin wall stainless steel chamber"; *Vacuum*; Bearing a date of 1998; pp. 431-437; vol. 50; No. 3-4; Elsevier Science Ltd.
Nemanič, V.; "Vacuum insulating panel"; *Vacuum*; bearing a date of 1995; pp. 839-842; vol. 46; No. 8-10; Elsevier Science Ltd.
Nemanič, V. et al.; "Anomalies in kinetics of hydrogen evolution from austenitic stainless steel from 300 to 1000° C"; *Journal of Vacuum Science Technology*; Bearing a date of Jan./Feb. 2001; pp. 215-222; vol. 19; No. 1; American Vacuum Society.
Nemanič, V. et al.; "Outgassing in thin wall stainless steel cells"; *Journal of Vacuum Science Technology*; Bearing a date of May/Jun. 1999; pp. 1040-1046; vol. 17; No. 3; American Vacuum Society.

(56) References Cited

OTHER PUBLICATIONS

Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.
Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.
Nemanič, Vincenc, et al.; "Outgassing of a thin wall vacuum insulating panel"; Vacuum; Bearing a date of 1998; pp. 233-237; vol. 49, No. 3; Elsevier Science Ltd.
Nolan, Timothy D. C.; Hattler, Brack G.; Federspiel, William J.; "Development Of A Balloon Volume Sensor For Pulsating Balloon Catheters"; ASAIO Journal; 2004; pp. 225-233; vol. 50; No. 3; American Society of Artificial Internal Organs.
NSM Archive; "Band structure and carrier concentration"; date of Jan. 22, 2004 provided by examiner, printed on Feb. 16, 2013; pp. 1-10, 1 additional page of archive information; located at: http://web.archive.org/20040122200811/http://www.ioffe.rssi.ru/SVA/NSM/Semicond/SiC/bandstr.html.
Odaka, K.; "Dependence of outgassing rate on surface oxide layer thickness in type 304 stainless steel before and after surface oxidation in air"; *Vacuum*; Bearing a date of 1996; pp. 689-692; vol. 47; No. 6-8; Elsevier Science Ltd.
Odaka, K. et al.; "Effect of baking temperature and air exposure on the outgassing rate of type 316L stainless steel"; *Journal of Vacuum Science Technology*; Bearing a date of Sep./Oct. 1987; pp. 2902-2906; vol. 5; No. 5; American Vacuum Society.
Okamura, S. et al.; "Outgassing measurement of finely polished stainless steel"; *Journal of Vacuum Science Technology*; Bearing a date of Jul./Aug. 1991; pp. 2405-2407; vol. 9; No. 4; American Vacuum Society.
Oxychem; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical-properties.pdf.
PATH—A Catalyst for Global Health; "Uniject™ Device—The Radically Simple Uniject™ Device—Rethinking the Needle to Improve Immunization"; bearing dates of 1995-2006; printed on Oct. 11, 2007; pp. 1-2; located at http://www.path.org/projects/uniject.php; PATH Organization.
Patrick, T. J.; "Outgassing and the choice of materials for space instrumentation"; *Vacuum*; Bearing a date of 1973; pp. 411-413; vol. 23; No. 11; Pergamon Press Ltd.
Patrick, T. J.; "Space environment and vacuum properties of spacecraft materials"; *Vacuum*; Bearing a date of 1981; pp. 351-357; vol. 31; No. 8-9; Pergamon Press Ltd.
Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins.
PCT International Search Report; Application No. PCT/US2011/001939; Mar. 27, 2012; pp. 1-2.
PCT International Search Report; International App. No. PCT/US11/00234; Jun. 9, 2011; pp. 1-4.
PCT International Search Report; International App. No. PCT/US09/01715; Jan. 8, 2010; pp. 1-2.
PCT International Search Report; International App. No. PCT/US08/13646; Apr. 9, 2009; pp. 1-2.
PCT International Search Report; International App. No. PCT/US08/13648; Mar. 13, 2009; pp. 1-2.
PCT International Search Report; International App. No. PCT/US08/13642; Feb. 26, 2009; pp. 1-2.
PCT International Search Report; International App. No. PCT/US08/13643; Feb. 20, 2009; pp. 1-2.
Pekala, R. W.; "Organic Aerogels From The Polycondensation Of Resorcinol With Formaldehyde"; Journal Of Materials Science; Sep. 1989; pp. 3221-3227; vol. 24; No. 9; Springer Netherlands.
Pickering, Larry K.; Wallace, Gregory; Rodewald, Lance; "Too Hot, Too Cold: Issues with Vaccine Storage"; Pediatrics®—Official Journal of the American Academy of Pediatrics; 2006; pp. 1738-1739 (4 pages total, incl. cover sheet and end page); vol. 118; American Academy of Pediatrics.
Poole, K. F. et al.; "Hialvac and Teflon outgassing under ultra-high vacuum conditions"; *Vacuum*; Bearing a date of Jun. 30, 1980; pp. 415-417; vol. 30; No. 10; Pergamon Press Ltd.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Pure Temp; "Technology"; Printed on: Feb. 9, 2011; p. 1-3; located at http://puretemp.com/technology.html.
Redhead, P. A.; "Recommended practices for measuring and reporting outgassing data"; *Journal of Vacuum Science Technology*; Bearing a date of Sep./Oct. 2002; pp. 1667-1675; vol. 20; No. 5; American Vacuum Society.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located at www.ChildrensVaccine.org/html/safe_injection.htm.
Ren, Qian et al.; "Evaluation Of An Outside-The-Cold-Chain Vaccine Delivery Strategy In Remote Regions Of Western China"; Public Health Reports; Sep.-Oct. 2009; pp. 745-750; vol. 124.
Restuccia, et al.; "Selective water sorbent for solid sorption chiller: experimental results and modeling"; International Journal of Refrigeration; 2004; pp. 284-293; vol. 27; Elsevier Ltd and IIR.
Rezk, et al.; "Physical and operating conditions effects on silica gel/water adsorption chiller performance"; Applied Energy; 2012; pp. 142-149; vol. 89; Elsevier Ltd.
Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.
Risha, Peter G.; Shewiyo, Danstan; Msami, Amani; Masuki, Gerald; Vergote, Geert; Vervaet, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Rutherford, S; "The Benefits of Viton Outgassing"; Bearing a date of 1997; pp. 1-5; Duniway Stockroom Corp.
Saes Getters; "St707 Getter Alloy for Vacuum Systems"; printed on Sep. 22, 2011; pp. 1-2; located at http://www.saegetters.com/default.aspx?idPage=212.
Saha, et al.; "A new generation of cooling device employing $CaCl_2$-in-silica gel-water system"; International Journal of Heat and Mass Transfer; 2009; pp. 516-524; vol. 52; Elsevier Ltd.
Saito, K. et al.; "Measurement system for low outgassing materials by switching between two pumping paths"; *Vacuum*; Bearing a date of 1996; pp. 749-752; vol. 47; No. 6-8; Elsevier Science Ltd.
Saitoh, M. et al.; "Influence of vacuum gauges on outgassing rate measurements" ; *Journal of Vacuum Science Technology*; Bearing a date of Sep./Oct. 1993; pp. 2816-2821; vol. 11; No. 5; American Vacuum Society.
Santhanam, S. M. T. J. et al. ;"Outgassing rate of reinforced epoxy and its control by different pretreatment methods"; *Vacuum*; Bearing a date of 1978; pp. 365-366; vol. 28; No. 8-9; Pergamon Press Ltd.

(56) References Cited

OTHER PUBLICATIONS

Sasaki, Y. T.; "Reducing SS 304/316 hydrogen outgassing to $2x10^{-15}$torr Vcm $^{2}$s"; *Journal of Vacuum Science Technology*; Bearing a date of Jul./Aug. 2007; pp. 1309-1311; vol. 25; No. 4; American Vacuum Society.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Scurlock, R. G. et al.; "Development of multilayer insulations with thermal conductivities below 0.1 μW $cm^{-1}$ $K^{-1}$"; *Cryogenics*; Bearing a date of May 1976; pp. 303-311; vol. 16.
Setia, S. et al.; "Frequency and causes of vaccine wastage"; *Vaccine* ; Bearing a date of 2002; pp. 1148-1156; vol. 20; Elsevier Science Ltd.
Seto, Joyce; Marra, Fawziah; "Cold Chain Management of Vaccines"; Continuing Pharmacy Professional Development Home Study Program; Feb. 2005; pp. 1-19; University of British Columbia.
Shockwatch; "Environmental Indicators"; printed on Sep. 27, 2007; pp. 1-2; located at www.shockwatch.com.
Shu, Q. S. et al.; "Heat flux from 277 to 77 K through a few layers of multilayer insulation"; *Cryogenics*; Bearing a date of Dec. 1986; pp. 671-677; vol. 26; Butterworth & Co. Ltd.
Shu, Q. S. et al.; "Systematic study to reduce the effects of cracks in multilayer insulation Part 1: Theoretical model"; *Cryogenics*; Bearing a date of May 1987; pp. 249-256; vol. 27; Butterworth & Co. Ltd.
Shu, Q. S. et al.; "Systematic study to reduce the effects of cracks in multilayer insulation Part 2: experimental results"; *Cryogenics*; Bearing a date of Jun. 1987; pp. 298-311; vol. 27; No. 6; Butterworth & Co. Ltd.
Spur Industries Inc.; "The Only Way To Get Them Apart is to Melt Them Apart"; 2006; pp. 1-3; located at http://www.spurind.com/applications.php.
Suemitsu, M. et al.; "Development of extremely high vacuums with mirror-polished Al-alloy chambers"; *Vacuum*; Bearing a date of 1993; pp. 425-428; vol. 44; No. 5-7; Pergamon Press Ltd.
Suemitsu, M. et al.; "Ultrahigh-vacuum compatible mirror-polished aluminum-alloy surface: Observation of surface-roughness-correlated outgassing rates"; Journal of Vacuum Science Technology; Bearing a date of May/Jun. 1992; pp. 570-572; vol. 10; No. 3; American Vacuum Society.
Suttmeier, Chris; "Warm Mix Asphalt: A Cooler Alternative"; Material Matters—Around the Hot Mix Industry; Spring 2006; pp. 21-22; Peckham Materials Corporation.
Tatenuma, K. et al.; "Acquisition of clean ultrahigh vacuum using chemical treatment"; *Journal of Vacuum Science Technology*; Bearing a date of Jul./Aug. 1998; pp. 2693-2697; vol. 16; No. 4; American Vacuum Society.
Tatenuma, K.; "Quick acquisition of clean ultrahigh vacuum by chemical process technology"; *Journal of Vacuum Science Technology*; Bearing a date of Jul./Aug. 1993; pp. 2693-2697; vol. 11; No. 4; American Vacuum Society.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage Of Vaccines In The Community: Weak Link In The Cold Chain?"; British Medical Journal; Mar. 21, 1992; pp. 756-758; vol. 304, No. 6829; BMJ Publishing Group.
Thompson, Marc T.; "Eddy current magnetic levitation—Models and experiments"; IEEE Potentials; Feb./Mar. 2000; pp. 40-46; IEEE.
Tripathi, A. et al.; "Hydrogen intake capacity of ZrVFe alloy bulk getters"; *Vacuum*; Bearing a date of Aug. 6, 1997; pp. 1023-1025; vol. 48; No. 12; Elsevier Science Ltd.
"Two Wire Gage / Absolute Pressure Transmitters—Model 415 and 440"Honeywell and Sensotec; printed 2007; pp. 1-2; Located at www.sensotec.com and www.honeywell.com/sensing.
UNICEF Regional Office for Latin America & the Carribean (UNICEF-TACRO); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
UOP; "An Introduction to Zeolite Molecular Sieves"; printed on Jan. 10, 2013; pp. 1-20; located at: http://www.eltrex.pl/pdf/karty/adsorbenty/ENG-Introduction%20to%20Zeolite%20Molecular%20Sieves.pdf.
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Wang, et al.; "Study of a novel silica gel-water adsorption chiller. Part I. Design and performance prediction"; International Journal of Refrigeration; 2005; pp. 1073-1083; vol. 28; Elsevier Ltd and IIR.
Watanabe, S. et al.; "Reduction of outgassing rate from residual gas analyzers for extreme high vacuum measurements"; *Journal of Vacuum Science Technology*; Bearing a date of Nov./Dec. 1996; pp. 3261-3266; vol. 14; No. 6; American Vacuum Society.
Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
Wiedemann, C. et al.; "Multi-layer Insulation Literatures Review"; *Advances*; Printed on May 2, 2011; pp. 1-10; German Aerospace Center.
Wikipedia; "Icyball"; Mar. 14, 2013; printed on Mar. 27, 2013; pp. 1-4; located at: http://en.wikipedia.org/wiki/Icyball.
Williams, Preston; "Greenbox Thermal Management System Refrigerate-able 2 to 8 C Shipping Containers"; Printed on: Feb. 9, 2011; p. 1; located at http://www.puretemp.com/documents/Refrigerate-able%202%20to%208%20C%20Shipping%20Containers.pdf.
Winn, Joshua N. et al.; "Omnidirectional reflection from a one-dimensional photonic crystal"; Optics Letters; Oct. 15, 1998; pp. 1573-1575; vol. 23, No. 20; Optical Society of America.
Wirkas, Theo, et al.; "A vaccine cold chain freezing study in PNG highlights technology needs for hot climate countries"; Vaccine; 2007; pp. 691-697; vol. 25; Elsevier Ltd.
World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
World Health Organization; "Guidelines on the international packaging and shipping of vaccines"; Department of Immunization, Vaccines and Biologicals; Dec. 2005; 40 pages; WHO/IVB/05.23.
World Health Organization; "Preventing Freeze Damage to Vaccines: Aide-memoire for prevention of freeze damage to vaccines"; 2007; pp. 1-4; WHO/IVB/07.09; World Health Organization.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Yamazaki, K. et al.; "High-speed pumping to UHV"; *Vacuum* ; Bearing a date of 2010; pp. 756-759; vol. 84; Elsevier Science Ltd.

(56) References Cited

OTHER PUBLICATIONS

Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zalba, B. et al.; "Review on thermal energy storage with phase change: materials, heat transfer analysis and applications"; *Applied Thermal Engineering*; Bearing a date of 2003; pp. 251-283; vol. 23; Elsevier Science Ltd.
Zhitomirskij, I.S. et al.; "A theoretical model of the heat transfer processes in multilayer insulation"; *Cryogenics*; Bearing a date of May 1979; pp. 265-268; IPC Business Press.
Zhu, Z. Q.; Howe, D.; "Halbach Permanent Magnet Machines And Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.
Chinese State Intellectual Property Office; Office Action; App. No. 200880120366.5; Jun. 27, 2013; 3 pages (no English translation available).
U.S. Appl. No. 13/907,470, Bowers et al.
Chinese State Intellectual Property Office, Office Action; App. No. 200880119918.0; Sep. 18, 2013 (rec'd by our agent Sep. 20, 2013); pp. 1-10 (no English translation available).
U.S. Appl. No. 14/098,886, Bloedow et al.
U.S. Appl. No. 14/070,892, Hyde et al.
U.S. Appl. No. 14/070,234, Hyde et al.
Chinese State Intellectual Property Office, Office Action; App. No. 201180016103.1 (based on PCT Patent Application No. PCT/US2011/000234); Jun. 23, 2014 (received by our Agent on Jun. 25, 2014); pp. 1-23.
"About Heat Leak—Comparison"; Technifab Products, Inc.; printed on Jun. 25, 2014; 2 pages; located at www.technifab.com/cryogenic-resource-library/about-heat-leak.html.
PCT International Search Report; International App. No. PCT/US2014/067863; Mar. 27, 2015; pp. 1-3.
Chinese State Intellectual Property Office; Office Action; App. No. 200880119918.0; May 27, 2013 (received by our agent on May 29, 2013); 9 pages (No English Translation Available).
U.S. Appl. No. 13/853,245, Eckhoff et al.
U.S. Appl. No. 13/720,328, Hyde et al.
U.S. Appl. No. 13/720,256, Hyde et al.
U.S. Appl. No. 13/489,058, Bowers et al.
U.S. Appl. No. 13/385,088, Hyde et al.
U.S. Appl. No. 13/374,218, Hyde et al.
U.S. Appl. No. 13/200,555, Chou et al.
U.S. Appl. No. 13/199,439, Hyde et al.
U.S. Appl. No. 13/135,126, Deane et al.
U.S. Appl. No. 12/927,982, Deane et al.
U.S. Appl. No. 12/927,981, Chou et al.
U.S. Appl. No. 12/658,579, Deane et al.
U.S. Appl. No. 12/220,439, Hyde et al.
U.S. Appl. No. 12/152,467, Bowers et al.
U.S. Appl. No. 12/152,465, Bowers et al.
U.S. Appl. No. 12/077,322, Hyde et al.
U.S. Appl. No. 12/012,490, Hyde et al.
U.S. Appl. No. 12/008,695, Hyde et al.
U.S. Appl. No. 12/006,089, Hyde et al.
U.S. Appl. No. 12/006,088, Hyde et al.
U.S. Appl. No. 12/001,757, Hyde et al.
Abdul-Wahab et al.; "Design and experimental investigation of portable solar thermoelectric refrigerator"; Renewable Energy; 2009; pp. 30-34; vol. 34; Elsevier Ltd.
Astrain et al.; "Computational model for refrigerators based on Peltier effect application"; Applied Thermal Engineering; 2005; pp. 3149-3162; vol. 25; Elsevier Ltd.
Azzouz et al.; "Improving the energy efficiency of a vapor compression system using a phase change material"; Second Conference on Phase Change Material & Slurry: Scientific Conference & Business Forum; Jun. 15-17, 2005; pp. 1-11; Yverdon-les-Bains, Switzerland.
Chatterjee et al.; "Thermoelectric cold-chain chests for storing/transporting vaccines in remote regions"; Applied Energy; 2003; pp. 415-433; vol. 76; Elsevier Ltd.
Chiu et al.; "Submerged finned heat exchanger latent heat storage design and its experimental verification"; Applied Energy; 2012; pp. 507-516; vol. 93; Elsevier Ltd.
Conway et al.; "Improving Cold Chain Technologies through the Use of Phase Change Material"; Thesis, University of Maryland; 2012; pp. ii-xv and 16-228.
Dai et al.; "Experimental investigation and analysis on a thermoelectric refrigerator driven by solar cells"; Solar Energy Materials & Solar Cells; 2003; pp. 377-391; vol. 77; Elsevier Science B.V.
Ghoshal et al.; "Efficient Switched Thermoelectric Refrigerators for Cold Storage Applications"; Journal of Electronic Materials; 2009; pp. 1-6; doi: 10.1007/s11664-009-0725-3.
Groulx et al.; "Solid-Liquid Phase Change Simulation Applied to a Cylindrical Latent Heat Energy Storage System"; Excerpt from the Proceedings of the COMSOL Conference, Boston; 2009; pp. 1-7.
Jiajitsawat, Somchai; "A Portable Direct-PV Thermoelectric Vaccine Refrigerator with Ice Storage Through Heat Pipes"; Dissertation, University of Massachusetts, Lowell; 2008; three cover pages, pp. ii-x, 1-137.
Kempers et al.; "Characterization of evaporator and condenser thermal resistances of a screen mesh wicked heat pipe"; International Journal of Heat and Mass Transfer; 2008; pp. 6039-6046; vol. 51; Elsevier Ltd.
Mohamad et al.; "An Analysis of Sensitivity Distribution Using Two Differential Excitation Potentials in ECT"; IEEE Fifth International Conference on Sensing Technology; 2011; pp. 575-580; IEEE.
Mohamad et al.; "A introduction of two differential excitation potentials technique in electrical capacitance tomography"; Sensors and Actuators A; 2012; pp. 1-10; vol. 180; Elsevier B.V.
Mughal et al.; "Review of Capacitive Atmospheric Icing Sensors"; The Sixth International Conference on Sensor Technologies and Applications (SENSORCOMM); 2012; pp. 42-47; IARIA.
Omer et al.; "Design optimization of thermoelectric devices for solar power generation"; Solar Energy Materials and Solar Cells; 1998; pp. 67-82; vol. 53; Elsevier Science B.V.
Omer et al.; "Experimental investigation of a thermoelectric refrigeration system employing a phase change material integrated with thermal diode (thermosyphons)"; Applied Thermal Engineering; 2001; pp. 1265-1271; vol. 21; Elsevier Science Ltd.
Oró et al.; "Review on phase change materials (PCMs) for cold thermal energy storage applications"; Applied Energy; 2012; pp. 1-21; doi: 10.1016/j.apenergy.2012.03.058; Elsevier Ltd.
Owusu, Kwadwo Poku; "Capacitive Probe for Ice Detection and Accretion Rate Measurement: Proof of Concept"; Master of Science Thesis, Department of Mechanical Engineering, University of Manitoba; 2010; pp. i-xi, 1-95.
Peng et al.; "Determination of the optimal axial length of the electrode in an electrical capacitance tomography sensor"; Flow Measurement and Instrumentation; 2005; pp. 169-175; vol. 16; Elsevier Ltd.
Peng et al.; "Evaluation of Effect of Number of Electrodes in ECT Sensors on Image Quality"; IEEE Sensors Journal; May 2012; pp. 1554-1565; vol. 12, No. 5; IEEE.
Riffat et al.; "A novel thermoelectric refrigeration system employing heat pipes and a phase change material: an experimental investigation"; Renewable Energy; 2001; pp. 313-323; vol. 23; Elsevier Science Ltd.
Robak et al.; "Enhancement of latent heat energy storage using embedded heat pipes"; International Journal of Heat and Mass Transfer; 2011; pp. 3476-3483; vol. 54; Elsevier Ltd.
Rodríguez et al.; "Development and experimental validation of a computational model in order to simulate ice cube production in a thermoelectric ice maker"; Applied Thermal Engineering; 2009; one cover page and pp. 1-28; doi: 10.1016/j.applthermaleng.2009.03.005.

(56) References Cited

OTHER PUBLICATIONS

Russel et al.; "Characterization of a thermoelectric cooler based thermal management system under different operating conditions"; Applied Thermal Engineering; 2012; two cover pages and pp. 1-29; doi: 10.1016/j.applthermaleng.2012.05.002.
Sharifi et al.; "Heat pipe-assisted melting of a phase change material"; International Journal of Heat and Mass Transfer; 2012; pp. 3458-3469; vol. 55; Elsevier Ltd.
Stampa et al.; "Numerical Study of Ice Layer Growth Around a Vertical Tube"; Engenharia Térmica (Thermal Engineering); Oct. 2005; pp. 138-144; vol. 4, No. 2.
Vián et al.; "Development of a thermoelectric refrigerator with two-phase thermosyphons and capillary lift"; Applied Thermal Engineering; 2008; one cover page and pp. 1-16 doi: 10.1016/j.applthermaleng.2008.09.018.
Ye et al.; "Evaluation of Electrical Capacitance Tomography Sensors for Concentric Annulus"; IEEE Sensors Journal; Feb. 2013; pp. 446-456; vol. 13, No. 2; IEEE.
Yu et al.; "Comparison Study of Three Common Technologies for Freezing-Thawing Measurement"; Advances in Civil Engineering; 2010; pp. 1-10; doi: 10.1155/2010/239651.

* cited by examiner

TEMPERATURE-STABILIZED STORAGE SYSTEMS WITH REGULATED COOLING

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

None.

RELATED APPLICATIONS

U.S. patent application Ser. No. 12/001,757, entitled TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 11 Dec. 2007 is related to the present application.

U.S. patent application Ser. No. 12/006,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 27 Dec. 2007 now issued as U.S. Pat. No. 8,215,518, is related to the present application.

U.S. patent application Ser. No. 12/006,089, entitled TEMPERATURE-STABILIZED STORAGE SYSTEMS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 27 Dec. 2007 is related to the present application.

U.S. patent application Ser. No. 12/008,695, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 10 Jan. 2008 now issued as U.S. Pat. No. 8,377,030, is related to the present application.

U.S. patent application Ser. No. 12/012,490, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 31 Jan. 2008 now issued as U.S. Pat. No. 8,069,680, is related to the present application.

U.S. patent application Ser. No. 12/077,322, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed 17 Mar. 2008 now issued as U.S. Pat. No. 8,215,835, is related to the present application.

U.S. patent application Ser. No. 12/152,465, entitled STORAGE CONTAINER INCLUDING MULTI-LAYER INSULATION COMPOSITE MATERIAL HAVING BANDGAP MATERIAL AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed 13 May 2008 is related to the present application.

U.S. patent application Ser. No. 12/152,467, entitled MULTI-LAYER INSULATION COMPOSITE MATERIAL INCLUDING BANDGAP MATERIAL, STORAGE CONTAINER USING SAME, AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed 13 May 2008 now issued as U.S. Pat. No. 8,211,516, is related to the present application.

U.S. patent application Ser. No. 12/220,439, entitled MULTI-LAYER INSULATION COMPOSITE MATERIAL HAVING AT LEAST ONE THERMALLY-REFLECTIVE LAYER WITH THROUGH OPENINGS, STORAGE CONTAINER USING SAME, AND RELATED METHODS, naming Roderick A. Hyde; Muriel Y. Ishikawa; Jordin T. Kare; and Lowell L. Wood, Jr. as inventors, filed 23 Jul. 2008 is related to the present application.

U.S. patent application Ser. No. 12/658,579, entitled TEMPERATURE-STABILIZED STORAGE SYSTEMS, naming Geoffrey F. Deane; Lawrence Morgan Fowler; William Gates; Zihong Guo; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed 8 Feb. 2010 is related to the present application.

U.S. patent application Ser. No. 12/927,981, entitled TEMPERATURE-STABILIZED STORAGE SYSTEMS WITH FLEXIBLE CONNECTORS, naming Fong-Li Chou; Geoffrey F. Deane; William Gates; Zihong Guo; Roderick A. Hyde; Edward K. Y. Jung; Nathan P. Myhrvold; Nels R. Peterson; Clarence T. Tegreene; Charles Whitmer; and Lowell L. Wood, Jr. as inventors, filed 29 Nov. 2010 is related to the present application.

U.S. patent application Ser. No. 12/927,982, entitled TEMPERATURE-STABILIZED STORAGE SYSTEMS INCLUDING STORAGE STRUCTURES CONFIGURED FOR INTERCHANGEABLE STORAGE OF MODULAR UNITS, naming Geoffrey F. Deane; Lawrence Morgan Fowler; William Gates; Jenny Ezu Hu; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed 29 Nov. 2010 is related to the present application.

U.S. patent application Ser. No. 13/135,126, entitled TEMPERATURE-STABILIZED STORAGE SYSTEMS CONFIGURED FOR STORAGE AND STABILIZATION OF MODULAR UNITS, naming Geoffrey F. Deane; Lawrence Morgan Fowler; William Gates; Jenny Ezu Hu; Roderick A. Hyde; Edward K. Y. Jung; Jordin T. Kare; Mark K. Kuiper; Nathan P. Myhrvold; Nathan Pegram; Nels R. Peterson; Clarence T. Tegreene; Mike Vilhauer; Charles Whitmer; Lowell L. Wood, Jr.; and Ozgur Emek Yildirim as inventors, filed 23 Jun. 2011 is related to the present application.

U.S. patent application Ser. No. 13/199,439, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 29 Aug. 2011 now issued as U.S. Pat. No. 8,322,147, is related to the present application.

U.S. patent application Ser. No. 13/200,555, entitled ESTABLISHMENT AND MAINTENANCE OF LOW GAS PRESSURE WITHIN INTERIOR SPACES OF TEMPERATURE-STABILIZED STORAGE SYSTEMS, naming Fong-Li Chou; William Gates; Roderick A. Hyde; Edward K. Y. Jung; Nathan P. Myhrvold; Clarence T. Tegreene; Charles Whitmer; and Lowell L. Wood, Jr. as inventors, filed 23 Sep. 2011 is related to the present application.

U.S. patent application Ser. No. 13/374,218, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed 16 Dec. 2011 is related to the present application.

U.S. patent application Ser. No. 13/385,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 31 Jan. 2012 is related to the present application.

U.S. patent application Ser. No. 13/489,058, entitled MULTI-LAYER INSULATION COMPOSITE MATERIAL INCLUDING BANDGAP MATERIAL, STORAGE CONTAINER USING SAME, AND RELATED METHODS, naming Jeffery A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed 5 Jun. 2012 is related to the present application.

U.S. patent application Ser. No. 13/720,256, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 19 Dec. 2012 is related to the present application.

U.S. patent application Ser. No. 13/720,328, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed 19 Dec. 2012 is related to the present application.

U.S. patent application Ser. No. 13/853,245, entitled TEMPERATURE-CONTROLLED STORAGE SYSTEMS, naming Philip A. Eckhoff; William Gates; Roderick A. Hyde; Edward K. Y. Jung; Nathan P. Myhrvold; Nels R. Peterson; Clarence T. Tegreene; Charles Whitmer; and Lowell L. Wood, Jr. as inventors, filed 29 Mar. 2013 is related to the present application.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

SUMMARY

In one aspect, a regulated cooling device of a size, shape and calibration for use with a substantially thermally sealed storage container includes: a cooling region, an adiabatic region, a lid region, and an electronics unit attached to the lid region. In some embodiments, the regulated cooling device includes: a cooling region including an outer wall with an inner surface and an outer surface, at least one temperature sensor positioned adjacent to the outer surface of the outer wall, and a first region of thermal heat pipe positioned within the outer wall substantially parallel to the inner surface, the first region of the thermal heat pipe including a first end with a heat-absorbing interface. In some embodiments, the regulated cooling device includes: an adiabatic region including an insulation unit, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe, and a second region of the thermal heat pipe positioned adjacent to the inner surface of the insulation unit. In some embodiments, the regulated cooling device includes: a lid region including a third region of the thermal heat pipe, the third region including a second end with a heat-releasing interface, a thermoelectric unit in contact with the second end of the thermal heat pipe, and a thermal dissipator unit in contact with the thermoelectric unit. In some embodiments, the regulated cooling device includes: an electronics unit attached to the lid region, including a microcontroller connected to the at least one temperature sensor, to the thermoelectric unit and to the thermal dissipator unit, and a power source attached to the microcontroller.

In one aspect, a regulated cooling device of a size, shape and calibration for use with a substantially thermally sealed storage container includes: a thermal heat pipe including a first end with a heat-absorbing interface, and a second end with a heat-releasing interface; an outer wall surrounding the first end of the heat pipe, the outer wall including an inner surface and an outer surface, the outer wall forming a phase change material-impermeable gap around the first end of the heat pipe; an end cap, the end cap sealed to an edge of the outer wall distal to the first end of the heat pipe; a phase change material within the phase change material-impermeable gap around the first end of the heat pipe; at least one temperature sensor positioned adjacent to the outer wall; an insulation unit surrounding the heat pipe at a region between the first end and the second end, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe at the region between the first end and the second end; a thermoelectric unit in contact with the second end of the thermal heat pipe; a thermal dissipator unit in contact with the thermoelectric unit; a microcontroller connected to the at least one temperature sensor, to the thermoelectric unit and to the thermal dissipator unit; and an power source attached to the microcontroller.

In one aspect, a regulated cooling device of a size, shape and calibration for use with a substantially thermally sealed storage container includes: a substantially tubular thermal heat pipe including a first end with a heat-absorbing interface, and a second end with a heat-releasing interface; a phase change material-retaining unit surrounding the first end of the thermal heat pipe, the phase change material-retaining unit including an outer wall surrounding the first end of the heat pipe, the outer wall including an inner surface and an outer surface, the outer wall forming a phase change material-impermeable gap around the first end of the heat pipe, the inner surface positioned substantially parallel to an outer surface of the thermal heat pipe, an end cap sealed to a first edge of the outer wall distal to the first end of the heat pipe, and a phase change material within the phase change material-impermeable gap; a sensor conduit attached to the outer surface of the outer wall of the phase change material-retaining unit, the sensor conduit including a first temperature sensor positioned to detect temperature in a location adjacent to the end cap, and a second temperature sensor positioned to detect temperature in a location adjacent to the outer wall distal to the end cap; at least one capacitance sensor attached to the outer surface of the phase change material-retaining unit and positioned to detect capacitance across the phase change material within the phase change material-impermeable gap; an insulation unit surrounding the heat pipe at a region between the first end and the second end, the insulation unit including a lower surface sealed to a second edge of the outer wall of the phase change material-retaining unit, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe at the region between the first end and the second end; an electronics conduit within the insulation unit, the electronics conduit including one or more wires attached to the first and second temperature sensors within the sensor conduit; a thermoelectric unit in thermal contact with the second end of the thermal heat pipe; a thermal dissipator unit in thermal contact with the thermoelectric unit; a microcontroller connected to the one or more connectors attached to the first and second temperature sensors, to the at least one capacitance sensor, to the thermoelectric unit and to the thermal dissipator unit; and an power source attached to the microcontroller.

In addition to the foregoing, other system aspects are described in the claims, drawings, and text forming a part of the disclosure set forth herein. The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
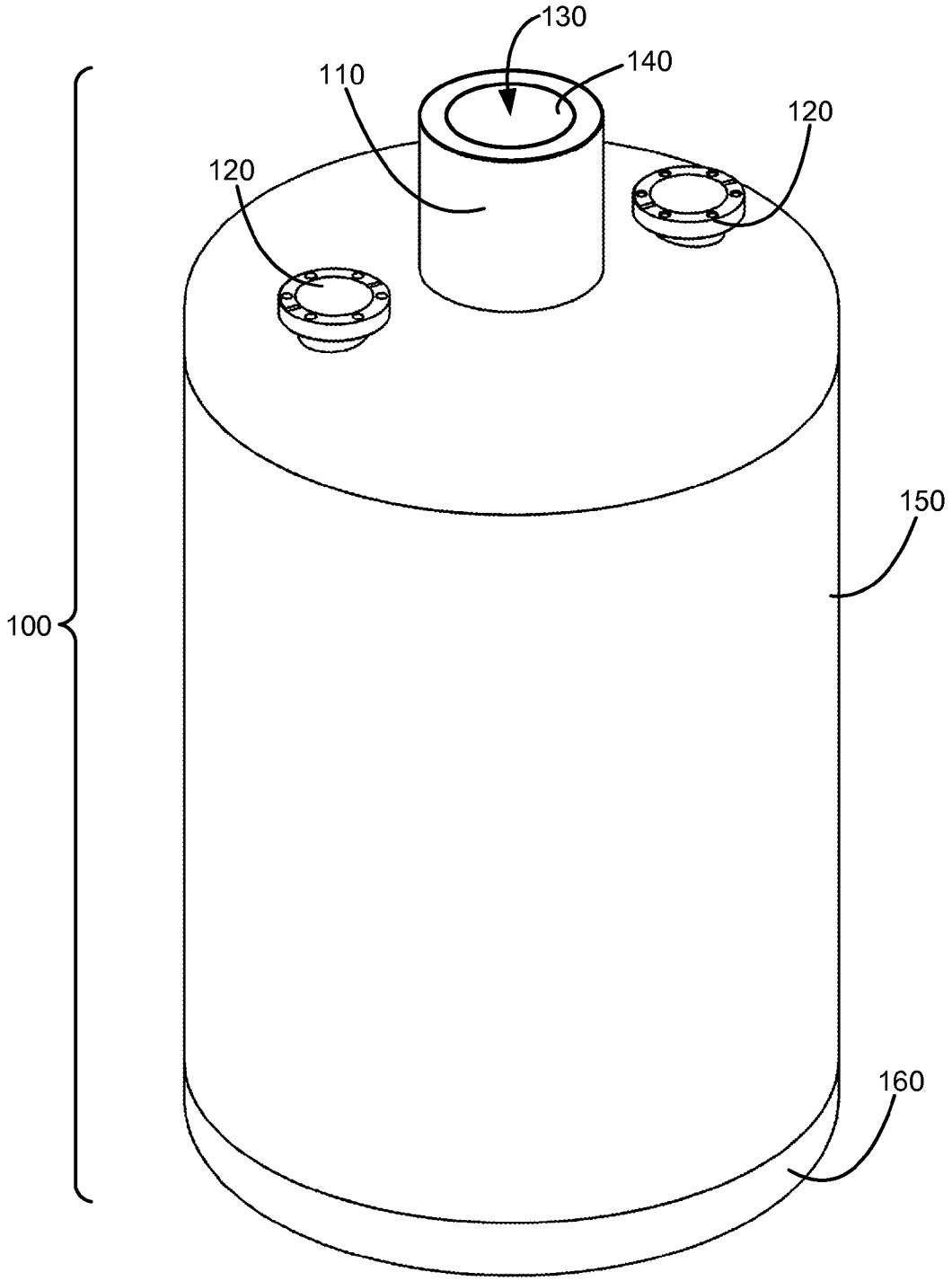
FIG. 1 illustrates an external view of a substantially thermally sealed storage container.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments can be utilized, and other changes can be made, without departing from the spirit or scope of the subject matter presented here.

The use of the same symbols in different drawings typically indicates similar or identical items unless context dictates otherwise.

With reference now to FIG. 1, shown is an embodiment of a substantially thermally sealed storage container to serve as a context for introducing the devices described herein. FIG. 1 depicts an exterior view of a substantially thermally sealed storage container 100. The substantially thermally sealed storage container 100 can be of a portable size and shape, for example a size and shape within reasonable expected portability estimates for an individual person. The substantially thermally sealed storage container 100 can be configured of a size and shape for carrying or hauling by an individual person. For example, in some embodiments the substantially thermally sealed storage container 100 has a mass that is less than approximately 50 kilograms (kg), or less than approximately 30 kg. For example, in some embodiments the substantially thermally sealed storage container 100 has a length and width that are less than approximately 1 meter (m). The substantially thermally sealed storage container 100 illustrated in FIG. 1 is roughly configured as a cylindrical shape, however multiple shapes are possible depending on the embodiment. For example, a rectangular shape, or an irregular shape, can be desirable in some embodiments, depending on the intended use of the substantially thermally sealed storage container 100. The substantially thermally sealed storage container 100 includes an outer wall 150 substantially defining the substantially thermally sealed storage container 100.

Figure 2:
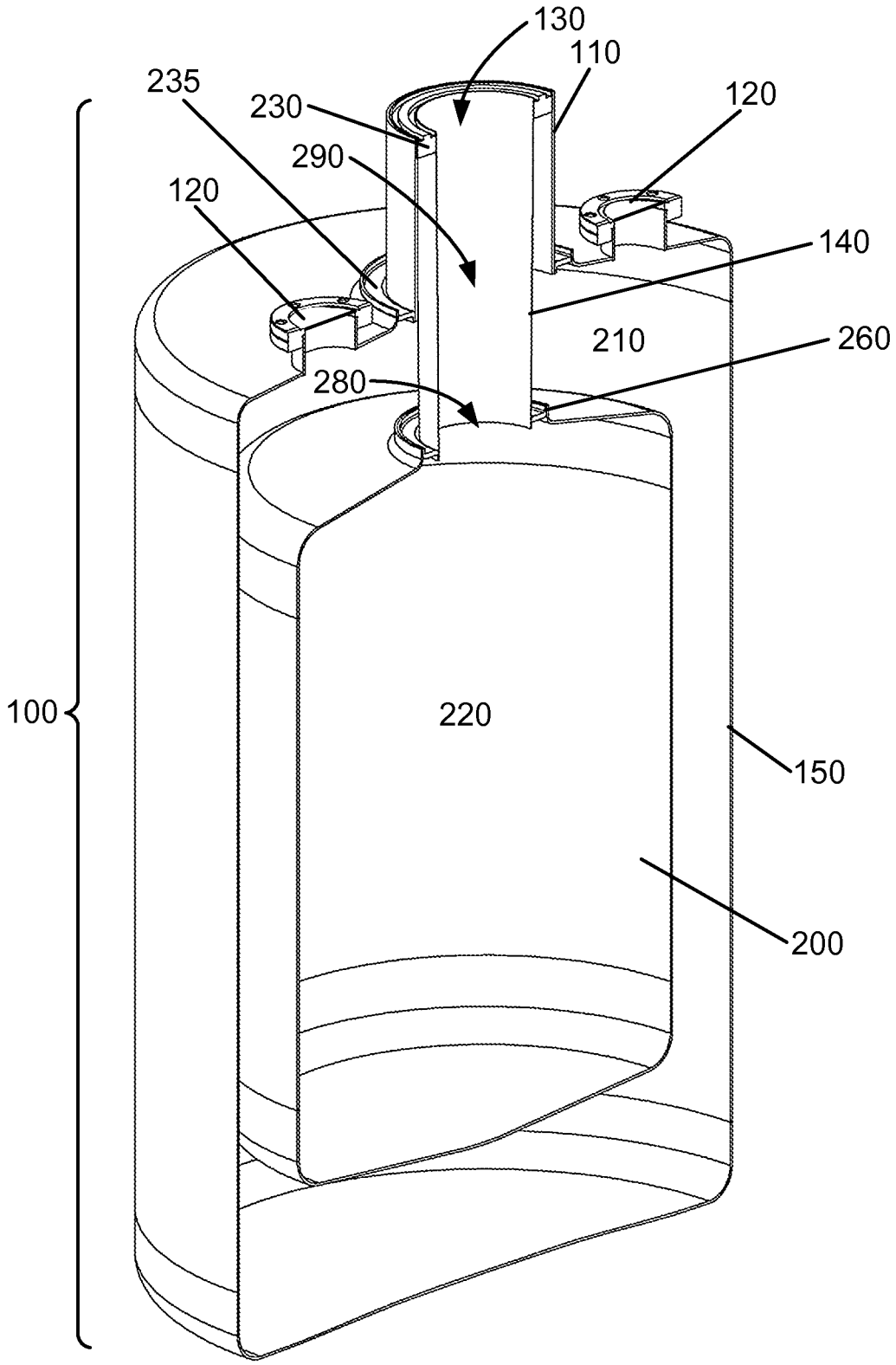
FIG. 2 depicts a vertical cross-section view of a substantially thermally sealed storage container.

The substantially thermally sealed storage container 100 includes a single access conduit 130 connecting an outer wall 150 single aperture to an inner wall single aperture within the container (see, e.g. FIG. 2). The substantially thermally sealed storage container 100 includes an external wall 110 of the access conduit 130 which extends the access conduit 130 externally from the outer surface of the substantially thermally sealed storage container 100 into the region adjacent to the outer surface of the substantially thermally sealed storage container 100. Such an external wall 110 of the access conduit 130 can be covered with additional material as appropriate to the embodiment, for example to provide stability or insulation to the external wall 110 of the access conduit 130. The external wall 110 of the access conduit 130 can be covered with additional material, for example, material such as stainless steel, fiberglass, plastic or a composite material as appropriate to the embodiment to provide stability, durability, and/or thermal insulation to the external wall 110 of the access conduit 130. The external wall 110 of the access conduit 130 can be of varying lengths relative to the size and configuration of the substantially thermally sealed storage container 100. For example, the external wall 110 of the access conduit 130 can project between approximately 4 centimeters (cm) and approximately 10 cm from the surface of the substantially thermally sealed storage container 100. For example, the external wall 110 of the access conduit 130 can project approximately 6 cm from the surface of the substantially thermally sealed storage container 100. The substantially thermally sealed storage container 100 includes a single access aperture to a substantially thermally sealed storage region. The single access aperture is formed by the end of the access conduit 130 within the container. The access conduit 130 includes an inner wall 140 of the access conduit 130.

The substantially thermally sealed storage container 100 illustrated in FIG. 1 includes a base 160, which is configured to provide stability and balance to the substantially thermally sealed storage container 100. For example, the base 160 can provide mass and therefore ensure stability of the substantially thermally sealed storage container 100 in an upright position, or a position for its intended use. For example, the base 160 can provide mass and form a stable support structure for the substantially thermally sealed storage container 100. In some embodiments, the substantially thermally sealed storage container 100 is configured to be maintained in a position so that the single access aperture to a substantially thermally sealed storage region is commonly maintained substantially at the highest elevated surface of the substantially thermally sealed storage container 100. In embodiments such as that depicted in FIG. 1, such positioning minimizes thermal transfer of heat from the region surrounding the substantially thermally sealed storage container 100 into a storage region within the substantially thermally sealed storage container 100. In order to maintain the thermal stability of a storage region within the substantially thermally sealed storage container 100 over time, thermal transfer of heat from the exterior of the substantially thermally sealed storage container 100 into the substantially thermally sealed storage container 100 is not desirable. A base 160 of sufficient mass can be configured to encourage maintenance of the substantially thermally sealed storage container 100 in an appropriate position for the embodiment during use. A base 160 of sufficient mass can be configured to encourage maintenance of the substantially thermally sealed storage container 100 in an appropriate position for minimal thermal transfer into a storage region within the substantially thermally sealed storage container 100 from a region exterior to the substantially thermally sealed storage container 100. In some embodiments, the external wall 110 of the access conduit 130 can be elongated and/or nonlinear to create an elongated thermal pathway between the exterior of the container 100 and the exterior of the container.

The substantially thermally sealed storage container 100 can include one or more sealed access ports 120 to the gap between the inner wall and outer wall 150 (see, e.g. FIG. 2). Such access ports can, for example, be remaining from the fabrication of the substantially thermally sealed storage container 100. Such access ports can, for example, be configured to provide access to an interior region during refurbishment of the substantially thermally sealed storage container 100.

The substantially thermally sealed storage container 100 can include, in some embodiments, one or more handles attached to an exterior surface of the container 100, wherein the handles are configured for transport of the container 100. The handles can be fixed on the surface of the container, for example welded, fastened or glued to the surface of the container. The handles can be operably attached but not fixed to the surface of the container, such as with a harness, binding, hoop or chain running along the surface of the container. The handles can be positioned to retain the container 100 with the access conduit 130 on the top of the container 100 during transport to minimize thermal transfer from the exterior of the container 100 through the access conduit 130.

The substantially thermally sealed storage container 100 can include electronic components. Although it may be desirable, depending on the embodiment, to minimize thermal emissions (i.e. heat output) within the container 100, electronics with thermal emissions can be operably attached to the exterior of the container 100 without providing heat to the interior of the container. For example, one or more positioning devices, such as GPS devices, can be attached to the exterior of the container. One or more positioning devices can be configured as part of a system including, for example, monitors, displays, circuitry, power sources, an operator unit, and transmission units. To the extent that circuitry is positioned within the interior region of a container during use of an embodiment, it is selected for low thermal emission properties as well as positioned and utilized to minimize thermal emissions.

Depending on the embodiment, one or more power sources can be attached to an exterior surface of the container 100, wherein the power source is configured to supply power to circuitry within the container or within a regulated cooling unit used with the container. For example, a solar unit can be attached to the exterior surface of the container 100. For example, a battery unit can be attached to the exterior surface of the container 100. For example, one or more wires can be positioned within the access conduit 130 to supply power to circuitry within the container or within a regulated cooling unit used with the container. For example, one or more power sources can be attached to an exterior surface of the container 100, wherein the power source is configured to supply power to circuitry within the container 100. For example, one or more power sources can be attached to an exterior surface of the container 100, wherein the power source is configured to supply power to circuitry integral to a regulated cooling unit. A power source can include wirelessly transmitted power sources, such as described in U.S. Patent Application No. 2005/0143787 to Boveja, titled "Method and system for providing electrical pulses for neuromodulation of vagus nerve(s), using rechargeable implanted pulse generator," which is herein incorporated by reference. A power source can include a magnetically transmitted power source. A power source can include a battery. A power source can include a solar panel. A power source can include an AC power source with a converter to supply DC current to the circuitry within the container or within a regulated cooling unit used with the container.

Depending on the embodiment, one or more temperature sensors can be attached to an exterior surface of the container 100. The one or more temperature sensors can be configured, for example, to display the ambient temperature at the surface of the container. The one or more temperature sensors can be configured, for example, to transmit data to one or more system. The one or more temperature sensors can be configured, for example, as part of a temperature monitoring system.

Depending on the embodiment, one or more transmission units can be operably attached to the container 100. For example, one or more transmission units can be operably attached to the exterior surface of the container 100. For example, one or more transmission units can be operably attached to an interior unit within the container 100. For example, one or more transmission units can be operably attached to the cooling device utilized with the container 100. Depending on the embodiment, one or more receiving units can be operably attached to the container 100. For example, one or more receiving units can be operably attached to the exterior surface of the container 100. For example, one or more receiving units can be operably attached to an interior unit within the container 100. For example, one or more receiving units can be operably attached to the cooling device utilized with the container 100.

FIG. 2 depicts a vertical cross section view of a substantially thermally sealed storage container 100, such as illustrated in FIG. 1. The use of the same symbols in different drawings typically indicates similar or identical items. The substantially thermally sealed storage container 100 includes an outer assembly, which includes an outer wall 150 substantially defining the substantially thermally sealed storage container 100. The outer wall 150 substantially defines an outer wall aperture 290. The outer assembly includes an inner wall 200, which substantially defines a substantially thermally sealed storage region 220 within the storage container 100. In some embodiments, the inner wall 200 substantially defines a substantially thermally sealed storage region 220 with a corresponding shape to the outer wall 150. In some embodiments, the inner wall 200 substantially defines a substantially thermally sealed storage region 220 shaped as an elongated spherical structure. Such a structure may be desirable to maximize access to the substantially thermally sealed storage region 220 while minimizing thermal transfer with the region external to the container 100. In some embodiments, the substantially thermally sealed storage region 220 has a volume of approximately 25 cubic liters. The inner wall substantially defines a single inner wall aperture 280.

The outer assembly of the substantially thermally sealed storage container 100 includes at least one gap 210 between the inner wall 200 and the outer wall 150. One or more access ports 120 can provide access to the gap 210 during fabrication of the container 100, and then the access ports 120 can be sealed for container use. In some embodiments, an access port 120 can be opened during repair or refurbishment of a container 100, and then sealed for further use of the container 100. The outer assembly includes at least one section of ultra efficient insulation material within the gap 210 between the inner wall 200 and the outer wall 150. The at least one section of ultra efficient insulation material within the gap 210 can include aerogel. The at least one section of ultra efficient insulation material within the gap 210 can include a plurality of layers of ultra efficient insulation material. The at least one section of ultra efficient insulation material within the gap 210 can include at least one superinsulation material. The at least one section of ultra efficient insulation material within the gap 210 can substantially cover the inner wall 200 surface facing the gap 210. The at least one section of ultra efficient insulation material within the gap 210 can substantially cover the outer wall 150 surface facing the gap 210. The gap 210 between the inner wall 200 and the outer wall 150 can include substantially evacuated space, such as substantially evacuated space having a pressure less than or equal to $5\times10^{-4}$ torr.

The outer assembly includes a single access conduit 130 connecting the single outer wall aperture 290 with the single inner wall aperture 280. The outer assembly and the one or more sections of ultra efficient insulation material can substantially define a single access aperture, including an access conduit 130 extending from an exterior surface of the storage container to an interior surface of the at least one thermally sealed storage region 220. The outer assembly and the one or more sections of ultra efficient insulation material can substantially define a single access aperture, and may include an access conduit 130 surrounding a single access aperture region, wherein the external wall 110 of the access conduit 130 extends from an exterior surface of the storage container 100 into a region adjacent to the exterior the container 100. In some embodiments, the access conduit 130 can extend beyond the outer wall 150 of the container 100, and include an external wall 110. The access conduit 130 can be configured to substantially define a tubular structure, such as in the embodiment shown in FIG. 2. The access conduit 130 includes an inner wall 140 with an internal surface facing the interior of the access conduit 130. The access conduit 130 can be configured as an elongated thermal pathway within the outer wall 150 of the container 100. The access conduit 130 can be fabricated of a variety of materials, depending on the embodiment. For example, the access conduit 130 can be fabricated from metal, plastic, fiberglass or a composite relative to the requirements of toughness, durability, stability, or cost associated with a particular embodiment. In some embodiments, the access conduit 130 can be fabricated from aluminum. In some embodiments, the access conduit 130 can be fabricated from stainless steel.

The outer wall 110 of the access conduit 130 can be sealed to the inner wall 140 of the access conduit with a gas-impermeable seal 230. The outer wall 110 of the access conduit 130 can be sealed to the outer wall 150 of the container 100 with a gas-impermeable seal 235. The inner wall 140 of the access conduit 130 can be sealed to the inner wall 200 of the container 100 with a gas-impermeable seal 260. A gas-impermeable seal can include, for example, a weld or crimp joint.

In some embodiments, an outer assembly includes one or more sections of ultra efficient insulation material substantially defining at least one thermally sealed storage region 220. For example, the ultra efficient insulation material can be of a size and shape to substantially define at least one thermally sealed storage region 220. For example, the ultra efficient insulation material can be of suitable hardness and toughness to substantially define at least one thermally sealed storage region 220. In some embodiments, the outer assembly and the one or more sections of ultra efficient insulation material substantially define a single access aperture to the at least one thermally sealed storage region 220.

The at least one thermally sealed storage region 220 is configured to be maintained within a predetermined temperature range. For example, a container is designed to maintain a temperature range within the thermally sealed storage region for a period of days without additional cooling, or the addition of a heat sink such as ice. A container can include, for example, a thermally sealed storage region 220 that maintains its interior within a temperature range between approximately 2 degrees Centigrade and 8 degrees centigrade. Depending on factors including the heat loss from the container 100, the volume of the at least one thermally sealed storage region 220, the predetermined maintenance temperature range of the at least one thermally sealed storage region 220, and the ambient temperature in the region external to the container 100, a length of time for the at least one thermally sealed storage region 220 to remain within the predetermined maintenance temperature range without active cooling of the thermally sealed storage region 220 can be calculated using standard techniques. See Demko et al., "Design tool for cryogenic thermal insulation systems," Advances in Cryogenic Engineering: Transactions of the Cryogenic Engineering Conference-CEC, 53 (2008), which is incorporated herein by reference. Therefore, various embodiments may be designed and configured to provide at least one thermally sealed storage region 220 remaining within the predetermined maintenance temperature range for a known period of time without active cooling, relative to factors including the volume of the thermally sealed storage region 220, the known heat loss from the particular container, the volume of a particular included heat sink material, the predetermined maintenance temperature range of the at least one thermally sealed storage region 220, and the ambient temperature in the region external to the container. For example, a substantially thermally sealed storage container 100 can be configured to maintain at least one thermally sealed storage region 220 at a temperature substantially between approximately 2 degrees Centigrade and approximately 8 degrees Centigrade for a period of 30 days with an ambient external temperature between 25 degrees Centigrade and 35 degrees Centigrade. For example, a substantially thermally sealed storage container 100 can be configured to maintain at least one thermally sealed storage region 220 at a temperature substantially between approximately 0 degrees Centigrade and approximately 10 degrees Centigrade for a period of 35 days with an average external temperature between 20 degrees Centigrade and 30 degrees Centigrade. For example, a substantially thermally sealed storage container 100 can be configured to maintain at least one thermally sealed storage region 220 at a temperature substantially between approximately −15 degrees Centigrade and approximately −25 degrees Centigrade for a period of 25 days with external temperatures in a range between 15 degrees Centigrade and 30 degrees Centigrade. For example, for a substantially thermally sealed storage container with an internal volume of 25 cubic liters including sufficient ultra efficient insulation material, 7 kilograms (kg) of purified water ice can be configured to maintain a temperature within the storage region 200 between approximately 2 degrees Centigrade and approximately 8 degrees Centigrade for a period of 30 days in an ambient external high temperature of approximately 30 degrees Centigrade.

Some embodiments include at least one temperature indicator. Temperature indicators can be located at multiple locations relative to the container. Temperature indicators can include temperature indicating labels, which may be reversible or irreversible. Temperature indicators suitable for some embodiments include, for example, the Environmental Indicators sold by ShockWatch Company, with headquarters in Dallas Tex., the Temperature Indicators sold by Cole-Palmer Company of Vernon Hills Ill. and the Time Temperature Indicators sold by 3M Company, with corporate headquarters in St. Paul Minn., the brochures for which are each hereby incorporated by reference. Temperature indicators suitable for some embodiments include time-temperature indicators, such as those described in U.S. Pat. Nos. 5,709,472 and 6,042,264 to Prusik et al., titled "Time-temperature indicator device and method of manufacture" and U.S. Pat. No. 4,057,029 to Seiter, titled "Time-temperature indicator," each of which is herein incorporated by reference. Temperature indicators can include, for example, chemically-based indicators, temperature gauges, thermometers, bimetallic strips, or thermocouples.

The inner wall 200 and the outer wall 150 of the substantially thermally sealed storage container 100 can be fabricated from distinct or similar materials. The inner wall 200 and the outer wall 150 can be fabricated from any material of suitable hardness, strength, durability, cost or composition as appropriate to the embodiment. In some embodiments, one or both of the inner wall 200 and the outer wall 150 are fabricated from stainless steel, or a stainless steel alloy. In some embodiments, one or both of the inner wall 200 and the outer wall 150 are fabricated from aluminum, or an aluminum alloy. In some embodiments, one or both of the inner wall 200 and the outer wall 150 are fabricated from fiberglass, or a fiberglass composite. In some embodiments, one or both of the inner wall 200 and the outer wall 150 are fabricated from suitable plastic, which may include acrylonitrile butadiene styrene (ABS) plastic.

The term "ultra efficient insulation material," as used herein, includes one or more type of insulation material with extremely low heat conductance and extremely low heat radiation transfer between the surfaces of the insulation material. The ultra efficient insulation material can include, for example, one or more layers of thermally reflective film, high vacuum, aerogel, low thermal conductivity bead-like units, disordered layered crystals, low density solids, or low density foam. In some embodiments, the ultra efficient insulation material includes one or more low density solids such as aerogels, such as those described in, for example: Fricke and Emmerling, Aerogels-preparation, properties, applications, Structure and Bonding 77: 37-87 (1992); and Pekala, Organic aerogels from the polycondensation of resorcinol with formaldehyde, Journal of Materials Science 24: 3221-3227 (1989), each of which is incorporated herein by reference. As used herein, "low density" can include materials with density from about 0.01 g/cm$^3$ to about 0.10 g/cm$^3$, and materials with density from about 0.005 g/cm$^3$ to about 0.05 g/cm$^3$. In some embodiments, the ultra efficient insulation material includes one or more layers of disordered layered crystals, such as those described in, for example: Chiritescu et al., Ultralow thermal conductivity in disordered, layered $WSe_2$ crystals, Science 315: 351-353 (2007), which is herein incorporated by reference. In some embodiments, the ultra efficient insulation material includes at least two layers of thermal reflective film separated, for example, by at least one of: high vacuum, low thermal conductivity spacer units, low thermal conductivity bead like units, or low density foam. In some embodiments, the ultra efficient insulation material can include at least two layers of thermal reflective material and at least one spacer unit between the layers of thermal reflective material. For example, the ultra-efficient insulation material can include at least one multiple layer insulating composite such as described in U.S. Pat. No. 6,485,805 to Smith et al., titled "Multilayer insulation composite," which is herein incorporated by reference. See also "Thermal Performance of Multilayer Insulations-Final Report," Prepared for NASA 5 Apr. 1974, which is incorporated herein by reference. See also: Hedayat, et al., "Variable Density Multilayer Insulation for Cryogenic Storage," (2000); "High-Performance Thermal Protection Systems Final Report," Vol II, Lockheed Missiles and Space Company, Dec. 31, 1969; and "Liquid Propellant Losses During Space Flight," NASA report No. 65008-00-4

Oct. 1964, which are herein incorporated by reference. For example, the ultra-efficient insulation material can include at least one metallic sheet insulation system, such as that described in U.S. Pat. No. 5,915,283 to Reed et al., titled "Metallic sheet insulation system," which is incorporated herein by reference. For example, the ultra-efficient insulation material can include at least one thermal insulation system, such as that described in U.S. Pat. No. 6,967,051 to Augustynowicz et al., titled "Thermal insulation systems," which is incorporated herein by reference. For example, the ultra-efficient insulation material can include at least one rigid multilayer material for thermal insulation, such as that described in U.S. Pat. No. 7,001,656 to Maignan et al., titled "Rigid multilayer material for thermal insulation," which is herein incorporated by reference. See also Moshfegh, "A new thermal insulation system for vaccine distribution," Journal of Building Physics 15:226-247 (1992), which is incorporated herein by reference.

In some embodiments, an ultra efficient insulation material includes at least one material described above and at least one superinsulation material. As used herein, a "superinsulation material" can include structures wherein at least two floating thermal radiation shields exist in an evacuated double-wall annulus, closely spaced but thermally separated by at least one poor-conducting fiber-like material.

In some embodiments, one or more sections of the ultra efficient insulation material includes at least two layers of thermal reflective material separated from each other by magnetic suspension. The layers of thermal reflective material can be separated, for example, by magnetic suspension methods including magnetic induction suspension or ferromagnetic suspension. For more information regarding magnetic suspension systems, see Thompson, Eddy current magnetic levitation models and experiments, IEEE Potentials, February/March 2000, 40-44, and Post, Maglev: a new approach, Scientific American, January 2000, 82-87, which are each incorporated herein by reference. Ferromagnetic suspension can include, for example, the use of magnets with a Halbach field distribution. For more information regarding Halbach machine topologies and related applications, see Zhu and Howe, Halbach permanent magnet machines and applications: a review, IEE Proc.-Electr. Power Appl. 148: 299-308 (2001), which is herein incorporated by reference.

In some embodiments, an ultra efficient insulation material can include at least one multilayer insulation material. For example, an ultra efficient insulation material can include multilayer insulation material such as that used in space program launch vehicles, including by NASA. See, e.g., Daryabeigi, Thermal analysis and design optimization of multilayer insulation for reentry aerodynamic heating, Journal of Spacecraft and Rockets 39: 509-514 (2002), which is herein incorporated by reference. Some embodiments include one or more sections of ultra efficient insulation material comprising at least one layer of thermal reflective material and at least one spacer unit adjacent to the at least one layer of thermal reflective material. In some embodiments, one or more sections of ultra efficient insulation material includes at least one layer of thermal reflective material and at least one spacer unit adjacent to the at least one layer of thermal reflective material. The low thermal conductivity spacer units can include, for example, low thermal conductivity bead-like structures, aerogel particles, folds or inserts of thermal reflective film. There may be one layer of thermal reflective film or more than two layers of thermal reflective film. Similarly, there can be greater or fewer numbers of low thermal conductivity spacer units, depending on the embodiment. In some embodiments, there are one or more additional layers within or in addition to the ultra efficient insulation material, such as, for example, an outer structural layer or an inner structural layer. An inner or an outer structural layer can be made of any material appropriate to the embodiment, for example an inner or an outer structural layer can include: plastic, metal, alloy, composite, or glass. In some embodiments, there can be one or more regions of high vacuum between layers of thermal reflective film and/or surrounding layers of thermal reflective film. Such regions of high vacuum can include substantially evacuated space, such as space with a gas pressure less than or equal to $5\times10^{-4}$ torr. In some embodiments, the ultra efficient insulation material includes a plurality of layers of multilayer insulation, and substantially evacuated space surrounding the plurality of layers of multilayer insulation. For example, substantially evacuated space can have a persistent gas pressure less than or equal to $5\times10^{-4}$ torr.

Figure 3:
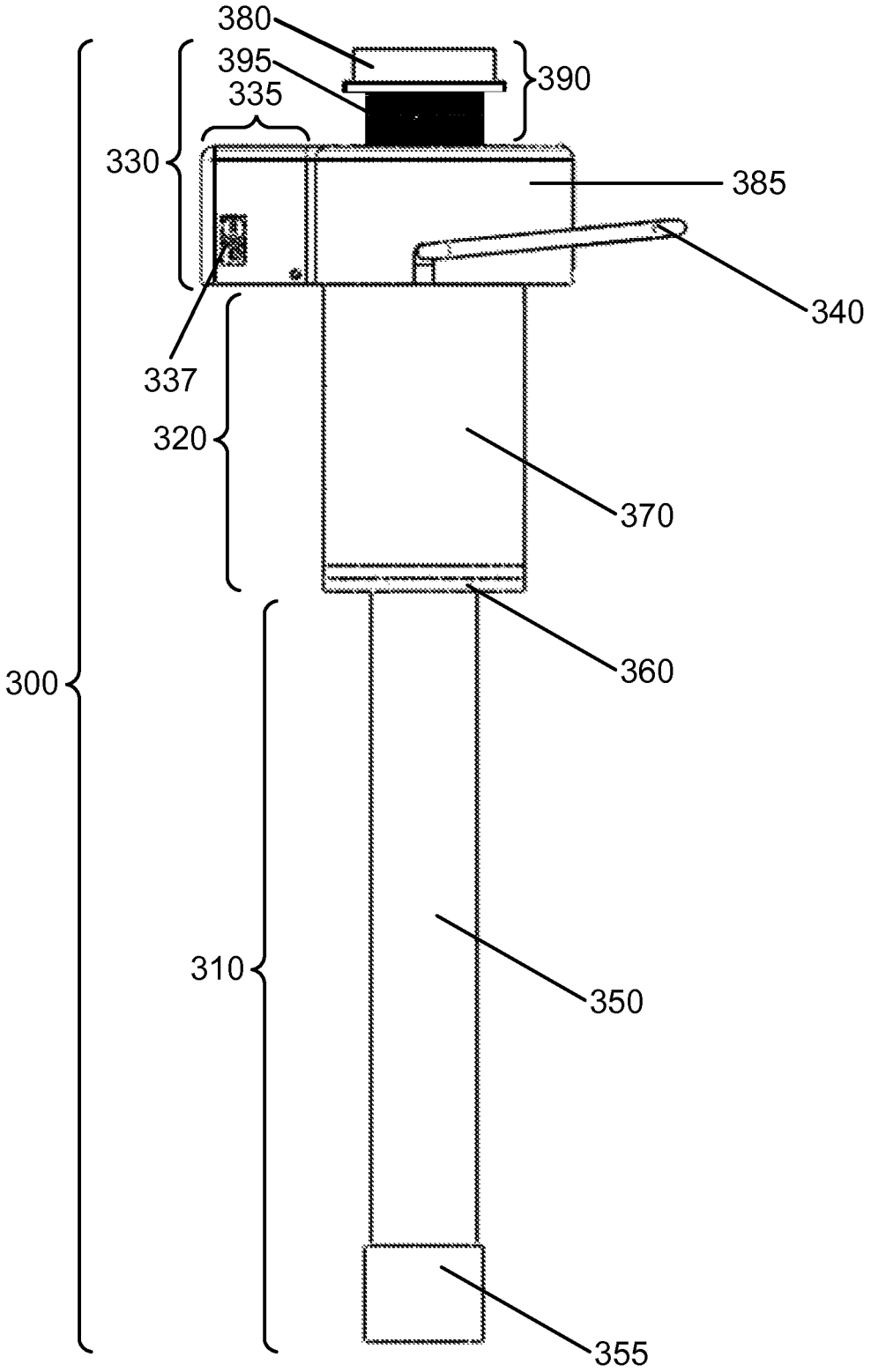
FIG. 3 shows an external view of a regulated cooling device configured for use with a substantially thermally sealed storage container.

FIG. 3 illustrates aspects of a regulated cooling device 300 for use with a substantially thermally sealed storage container such as described herein. A regulated cooling device 300 is configured to provide cooling within the substantially thermally sealed storage region of a container, such as described in relation to FIG. 1 and FIG. 2, above. A regulated cooling device 300 is configured to operate in conjunction with a substantially thermally sealed storage container based on size, shape and thermal efficiencies of both the cooling device and the container. A regulated cooling device 300 provides a cooling function to the substantially thermally sealed storage region of a container as needed to maintain the storage region within a predetermined temperature range. For example, in some embodiments the regulated cooling device 300 can be calibrated to actively cool a specific substantially thermally sealed storage region of a particular container intermittently, as needed, to maintain the storage region in a predetermined temperature range between approximately 0 degrees Centigrade and 10 degrees Centigrade for a period of at least 30 days. For example, in some embodiments the regulated cooling device 300 can be calibrated to actively cool a specific substantially thermally sealed storage region of a particular container for a time of approximately 5 hours per 24 hour period, which will be sufficient to maintain the temperature within that specific container within a range of approximately 0 degrees Centigrade and 10 degrees Centigrade when the ambient temperature external to the container is above 30 degrees Centigrade for the entire 24 hour period. The regulated cooling device 300 is calibrated for use with a specific embodiment of a substantially thermally sealed storage container such as described herein. For example, a regulated cooling device can detect multiple temperature readings from within a substantially thermally sealed storage region of a particular container, calculate the amount of cooling required to maintain the temperature in the predetermined temperature range for that container, and remove heat from (i.e. provide cooling to) the substantially thermally sealed storage region of the container as determined from the characteristics of that container and the temperature data. For example, a container with a heat leak of 5 W and a substantially thermally sealed storage region of approximately 20 L total volume would require more active cooling than a container with a heat leak of 3 W and a substantially thermally sealed storage region of approximately 15 L total volume over time to maintain the same temperature range within both containers at the same external ambient temperature. Also for example, a regulated cooling device can detect multiple temperature readings over time from within a substantially thermally sealed storage region of a particular container, calculate the amount of cooling required to maintain the temperature in the predetermined temperature range for that container, and remain in an inactive state if no additional cooling is required to maintain the temperature range at a particular time.

In the embodiment of a regulated cooling device 300 illustrated in FIG. 3, the regulated cooling device 300 includes a cooling region 310, an adiabatic region 320, a lid region 330 and an electronics unit 335 attached to the lid region 330. During use, the cooling region 310 removes heat from the interior of a substantially thermally sealed storage container (see, e.g. FIGS. 1 and 2) and the lid region 330 dissipates this heat into the environment adjacent to the container under the control of the electronics unit 335. The adiabatic region 320 physically separates the cooling region 310 and the lid region 330 and is configured to minimize thermal transfer between the interior of the substantially thermally sealed storage container and the exterior of the container through the single access conduit of the container. The cooling region 310 of the regulated cooling device 300 includes an outer wall 350 and an end cap 355. The adiabatic region 320 of the regulated cooling device 300 includes an insulation unit 370. The insulation unit 370 includes an outer surface of a size and shape to reversibly mate with a surface of an access conduit within a substantially thermally sealed storage container, such as described in relation to FIG. 1 and FIG. 2, above. In some embodiments, the largest cross-section diameter of the cooling region 310 is less than the diameter of the outer surface of the insulation unit 370. A stabilizer 360 is attached to the end of the insulation unit 370 at the end of the insulation unit 370 positioned adjacent to the cooling region 310. The stabilizer 360 is attached to both the insulation unit 370 and to the outer wall 350 of the cooling region 310. The stabilizer 360 is fabricated from a material with low thermal conductivity and sufficient strength to assist in maintaining the relative positions of the insulation unit 370 and the outer wall 350 during use of the regulated cooling device 300 within a substantially thermally sealed storage container.

The regulated cooling device 300 illustrated in FIG. 3 includes a lid region 330. The lid region 330 is of a size and shape to not pass through an access conduit in a substantially thermally sealed storage container, and as such, to remain adjacent to the exterior wall of the container during use of the cooling device 300. The size and shape of the lid region 330 conforms to the size and shape of a corresponding container that the regulated cooling device 300 is configured for use with (see, e.g. FIGS. 9 and 10). The lid region 330 includes an outer wall 385. The outer wall 385 is positioned to provide physical support and protection for the interior features of the lid region 330. In some embodiments, the lid region 330 outer wall 385 is fabricated from a rigid plastic. In some embodiments, the lid region 330 outer wall 385 is fabricated from fiberglass. In some embodiments, the lid region 330 outer wall 385 is fabricated from a metal, such as aluminum or stainless steel. A handle 340 is attached to the lid region 330 external to the outer wall 385. The handle 340 is of a size and shape to be grasped by a person using the regulated cooling device 300, and fabricated from materials of sufficient strength and durability to lift the regulated cooling device 300 into and out of a container during use of the regulated cooling device 300. For example, in some embodiments the handle 340 can be fabricated from a rigid plastic, aluminum or stainless steel.

The lid region 330 includes a thermal dissipator unit 390 positioned to dissipate heat to a region external to a substantially thermally sealed storage container when the regulated cooling device 300 is in use. The thermal dissipator unit 390 includes a plurality of thermal fins 395 positioned to radiate heat into the area surrounding the thermal dissipator unit 390, and external to the container. A fan is attached to the thermal dissipator unit 390 to increase heat transfer from the thermal fins 395. The fan is attached to the microcontroller in the electronics unit 335. The thermal dissipator unit 390 is in thermal contact with the "hot" side of the thermoelectric unit (see FIG. 4) and configured to remove heat above the ambient temperature external to the container from the "hot" side of the thermoelectric unit. The heat transferred by the thermal dissipator unit 390 from the "hot" side of the thermoelectric unit is transferred into the ambient environment through operation of a fan unit and the plurality of thermal fins 395 positioned to radiate heat into the area surrounding the thermal dissipator unit 390. The fan is controlled by the microcontroller in the electronics unit 335, which turns the fan on and off in response to data received by the microcontroller from the temperature sensors attached to the cooling region 310. In some embodiments, a thermal dissipator unit 390 includes one or more internal heat pipes, positioned to transfer heat from a side of the thermal dissipator unit 390 accepting heat from the thermoelectric unit to the plurality of thermal fins 395.

The thermal dissipator unit 390 is protected by a cover 380. In some embodiments, the cover 380 is fabricated from a mesh structure to increase air flow around, and therefore heat transfer from, the thermal fins 395. In some embodiments, the cover can include, for example, a display on the external surface, configured to depict calculated values and information relative to the substantially thermally sealed storage container and the regulated cooling device 300. For example, a display can visually indicate the average temperature calculated from data from multiple temperature sensors attached to the cooling region 310 over time. For example, a display can visually indicate the calculated time remaining for a substantially thermally sealed storage region to maintain its temperature in a predetermined temperature range without active cooling from the regulated cooling device 300. A display can be connected to the microcontroller.

The regulated cooling device 300 includes an electronics unit 335 attached to the lid region 330. In some embodiments, the electronics unit 335 is modular, for example configured to be removed and replaced. In some embodiments, the electronics unit 335 includes modular components, for example individual components configured to be removed and replaced. In some embodiments, the electronics unit 335 is integral to the lid region 330. In some embodiments, the electronics unit 330 includes an external switch 337 connected to a microcontroller. The external switch 337 can be configured to allow an individual user to turn the electronics unit 330, and by extension the active cooling of the regulated cooling device 300, on and off. In some embodiments, the electronics unit 335 includes a display unit. In some embodiments, the electronics unit 335 includes a light, such as an LED light.

The electronics unit 335 includes a microcontroller. The microcontroller is an electronic microcontroller. The electronics unit 335 includes a microcontroller, the microcontroller connected to at least one temperature sensor attached to the cooling region 310, to a thermoelectric unit and to the thermal dissipator unit 390. For example, the microcontroller can be connected to other components with a wire connector. In embodiments wherein the thermal dissipator unit 390 includes a fan, the fan can be attached to, and under the control of, the microcontroller. The microcontroller is a low power microcontroller. In some embodiments, the microcontroller is configured to maintain a setpoint temperature relative to data from one or more temperature sensors positioned within the storage region of the container. For example, in some embodiments the microcontroller is configured to maintain a setpoint temperature relative to data accepted from one or more temperature sensors attached to the cooling region 310 of a regulated cooling device 300. For example, in some embodiments the microcontroller is configured to maximize the power efficiency of the regulated cooling device. For example, in some embodiments the microcontroller includes data with at least one look-up table and is configured to maintain temperature drops for a specific container by utilizing a look-up table corresponding to the specific container.

The electronics unit 335 includes a power source attached to the microcontroller. For example, in some embodiments a power source includes a solar energy-harvesting panel, for example a single 50 W solar panel, or a 30 W solar panel. For example, in some embodiments a power source includes a 12V battery, for example a 12V battery of a type often used in a vehicle. For example, in some embodiments a power source includes a connector to an energy grid, such as a municipal power source. In some embodiments, the electronics unit 335 is configured to accept energy from more than one power source. For example, in some embodiments the electronics unit includes a solar panel as well as a connector configured to attach to a 12V battery when sunlight is not available. The microcontroller is configured to utilize energy from the power source when available and to remain in a low-energy use mode (e.g. standby or sleep mode) otherwise. In some embodiments, the electronics unit 335 includes a power converter configured to convert electrical power from a power source to direct current (DC) to power the thermal dissipator unit 390. For example, in some embodiments the electronics unit 335 includes an electrical power converter operably connected to a fan within the thermal dissipator unit 390 and the thermoelectric unit (see, e.g. FIG. 4).

Figure 4:
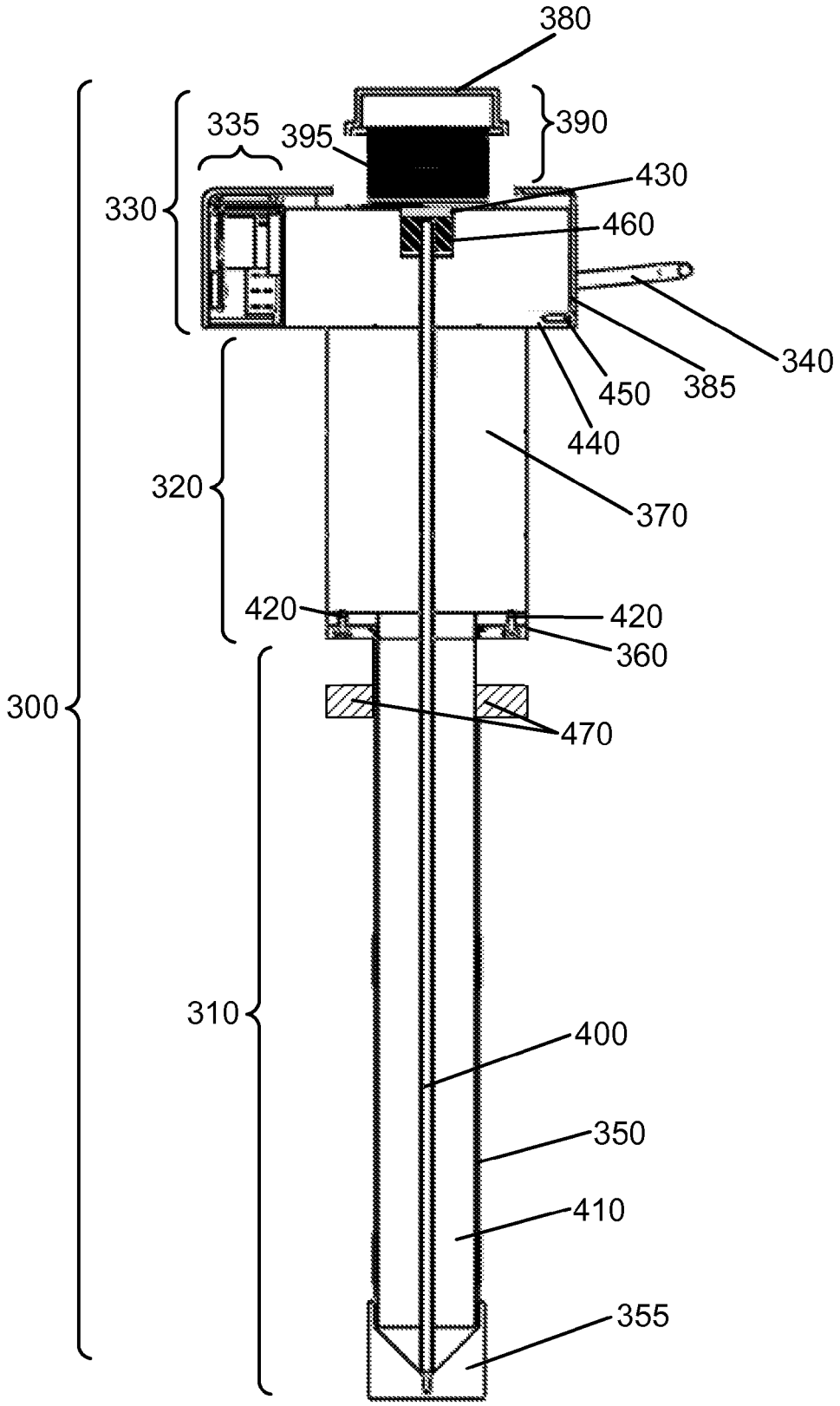
FIG. 4 illustrates a vertical cross-section view of a regulated cooling device such as shown in FIG. 3.

FIG. 4 illustrates an embodiment of a regulated cooling device 300, such as shown in FIG. 3, in vertical cross-section. The regulated cooling device 300 depicted in FIG. 4 includes a cooling region 310, an adiabatic region 320, and a lid region 330. The regulated cooling device 300 is operational in a substantially upright position, as illustrated in FIG. 4.

FIG. 4 illustrates an embodiment of a regulated cooling device 300 including a thermal heat pipe 400 including a first end with a heat-absorbing interface, and a second end with a heat-releasing interface. See: Sharifi et al., "Heat Pipe-Assisted Melting of a Phase Change Material," *International Journal of Heat and Mass Transfer* 55: 3458-3469 (2012), and Robak et al., "Enhancement of Latent Heat Energy Storage Using Embedded Heat Pipes," *International Journal of Heat and Mass Transfer* 54: 3476-3483 (2011); which are each incorporated by reference. The first end with a heat-absorbing interface of the thermal heat pipe 400 is within the cooling region 310. The second end of the thermal heat pipe 400 with a heat-releasing interface is within the lid region 330. The regulated cooling device 300 includes an outer wall 350 surrounding the first end of the heat pipe 400, the outer wall 350 including an inner surface and an outer surface, the outer wall 350 forming a phase change material-impermeable gap 410 around the first end of the heat pipe 400. The outer wall 350 is fabricated from a material with sufficient strength and rigidity to maintain the structure of the cooling unit 310 during use. For example, in some embodiments the outer wall 350 is fabricated from a polycarbonate material. The regulated cooling device 300 includes an end cap 355, the end cap 355 sealed to an edge of the outer wall 350 distal to the first end of the heat pipe 400. The phase change material-impermeable gap 410 around the first end of the heat pipe 400 includes a phase change material. For example, in some embodiments the phase change material is water or ice. For example, in some embodiments the phase change material is an organic or inorganic material. The phase change material for an embodiment can be selected based on factors such as cost, thermal capacity, toxicity, mass and freezing temperature for a specific phase change material. In some embodiments, the phase change material has different dielectric properties in its different phases. For example, the dielectric constant of water is lower than the dielectric constant of ice. More information regarding phase change materials can be found in Oró et al., "Review on Phase Change Materials (PCMs) for Cold Thermal Energy Storage Applications," *Appl. Energy* (2012) doi:10.1016, j.apenergy.2012.03.058, which is incorporated by reference herein.

The thermal heat pipe 400 is a wicking heat pipe. See, e.g. Kempers et al., "Characterization of Evaporator and Condenser Thermal Resistances of a Screen Mesh Wicked Heat Pipe," *International Journal of Heat and Mass Transfer,* 51: 6039-6046 (2008), which is incorporated by reference. In some embodiments, for example, the thermal heat pipe 400 includes a wire mesh wick. In some embodiments, for example, the thermal heat pipe 400 includes a porous metal wick. The thermal heat pipe 400 includes an internal working fluid. The internal working fluid within the heat pipe 400 is of a type that is operational at subzero (Centigrade) temperatures. The thermal heat pipe 400 is configured to minimize resistance to thermal transfer from the first end of the heat pipe 400 with the heat-absorbing interface to the second end of the heat pipe 400 with the heat-releasing interface when the thermoelectric unit connected to the heat-releasing interface is active (e.g. "on"). Correspondingly, the thermal heat pipe 400 is configured to maximize resistance to thermal transfer from the first end of the heat pipe 400 with the heat-absorbing interface to the second end of the heat pipe 400 with the heat-releasing interface when the thermoelectric unit connected to the heat-releasing interface is inactive (e.g. "off").

Figure 5:
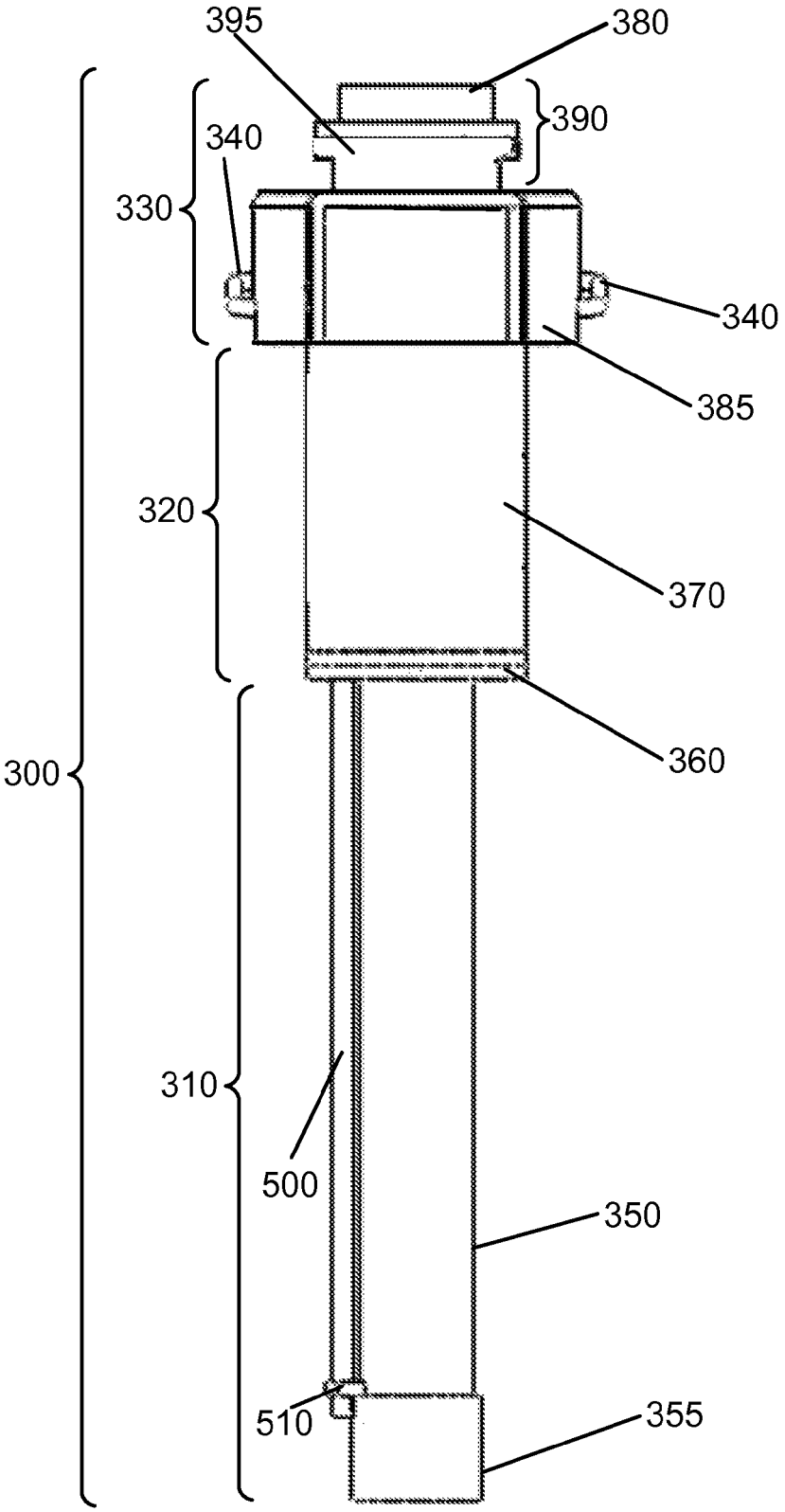
FIG. 5 depicts an external view of a regulated cooling device configured for use with a substantially thermally sealed storage container.

The regulated cooling device 300 includes at least one temperature sensor positioned adjacent to the outer wall 350 (see, e.g. FIG. 5). The regulated cooling device 300 includes an insulation unit 370 surrounding the heat pipe 400 at a region between the first end and the second end, the insulation unit 370 including an outer surface of a size and shape to reversibly mate with a surface of an access conduit within a substantially thermally sealed storage container, the insulation unit 370 including an inner surface of a size and shape to reversibly mate with an outer surface of the thermal heat pipe 400 at the region between the first end and the second end.

The regulated cooling device 300 also includes a thermoelectric unit 430 in contact with the second end of the thermal heat pipe 400. The thermoelectric unit 430 is configured to transfer heat from a first, or "cold," surface through the unit to a second, or "hot," surface in the presence of voltage through the thermoelectric effect. In some embodiments, the thermoelectric unit 430 can include a Peltier effect device. See: Abdul-Wahab et al., "Design and Experimental Investigation of Portable Solar Thermoelectric Refrigerator," *Renewable Energy,* 34:30-34 (2009); Astrain et al., "Computational Model for Refrigerators Based on Peltier Effect Application," *Applied Thermal Engineering* 25: 3149-3162 (2005); Chatterjee and Pandey, "Thermoelectric Cold-Chain Chests for Storing/Transporting Vaccines in Remote Regions," *Applied Energy* 76:415-433 (2003); Dai et al., "Experimental Investigation and Analysis on a Thermoelectric Refrigerator Driven by Solar Cells," *Solar Energy Materials & Solar Cells* 77: 377-391 (2003); Ghoshal and Guha, "Efficient Switched Thermoelectric Refrigerators for Cold Storage Applications," *Journal of Electronic Materials*, doi: 10.1077/s11664-009-0725-3 (2009); Jiajitsawat, "A Portable Direct-PV Thermoelectric Vaccine Refrigerator with Ice Storage Through Heat Pipes," Dissertation, University of Massachusetts, Lowell, (2008); Omer and Infield, "Design Optimization of Thermoelectric Devices for Solar Power Generation," *Solar Energy Materials & Solar Cells,* 53: 67-82 (1998); Omer et al., "Experimental Investigation of a Thermoelectric Refrigeration System Employing a Phase Change Material Integrated with Thermal Diode (Thermosyphons)," *Applied Thermal Engineering* 21: 1265-1271 (2001); Riffat et al., "A Novel Thermoelectric Refrigeration System Employing Heat Pipes and a Phase Change Material: an Experimental Investigation," *Renewable Energy* 23: 313-323 (2001); Rodriguez et al., "Development and Experimental Validation of a Computational Model in Order to Simulate Ice Cube Production in a Thermoelectric Ice Maker," *Applied Thermal Engineering* (2009), doi: 10.1016/j.applthermaleng.2009.03.005; Russel et al., "Characterization of a Thermoelectric Cooler Based Thermal Management System under Different Operating Conditions," *Applied Thermal Engineering* (2012), doi: 10.1016/j.applthermaleng.2012.05.002; and Vián and Astrain, "Development of a Thermoelectric Refrigerator with Two-phase Thermosyphons and Capillary Lift," *Applied Thermal Engineering* (2008), doi: 10.1016/j.applthermaleng.2008.09.018; which are each incorporated by reference.

The regulated cooling device 300 includes a thermal dissipator unit 390 in contact with the hot side of the thermoelectric unit 430. For example, the thermal dissipator unit 390 can be in physical contact with the thermoelectric unit 430. For example, the thermal dissipator unit 390 can be in thermal contact with the thermoelectric unit 430 through an intermediate thermal transfer material. For example, the thermal dissipator unit 390 can be in thermal contact with the thermoelectric unit 430 through an intermediate transfer material fabricated from a copper sheet in physical contact with both the thermal dissipator unit 390 and the thermoelectric unit 430. In some embodiments, a thermal transfer unit 460 is positioned in contact with the second end of the thermal heat pipe 400 and its heat-releasing interface as well as positioned in contact with the thermoelectric unit 430. A thermal transfer unit can be, for example, a metal or metal alloy with thermal conductivity above 200 W/mK. For example, a thermal transfer unit can include copper, aluminum, or silver.

The regulated cooling device 300 includes a microcontroller connected to the at least one temperature sensor, to the thermoelectric unit 430 and to the thermal dissipator unit 390. The regulated cooling device 300 includes a power source attached to the microcontroller. For example, the regulated cooling device can include a microcontroller and a power source within an electronics unit 335. For example, the regulated cooling device can include a microcontroller and a power source within the lid region 330.

The cooling region 310 illustrated in FIG. 4 shows the outer wall 350 of the cooling region 310. The outer wall 350 includes an inner surface facing a heat pipe 400 integral to the regulated cooling device 300. The outer wall 350 includes an outer surface, facing the exterior of the cooling region 310. The outer surface is positioned adjacent to the interior of the substantially thermally sealed storage region of a container when the regulated cooling device 300 is in use. The cooling region 310 includes at least one temperature sensor positioned adjacent to the outer surface of the outer wall 350. A temperature sensor can be attached to a temperature conduit. See, e.g. FIG. 5. In some embodiments, the cooling region 310 includes a plurality of temperature sensors positioned adjacent to the outer surface of the outer wall 350, and a connector between the temperature sensors and the microcontroller of the electronics unit 335. In some embodiments, one or more temperature sensors can be physically attached directly to the outer wall 350.

The outer wall 350 of the cooling region 310 is fabricated from a material with sufficient thermal transfer properties to allow for thermal transfer between the cooling region 310 and the interior of an adjacent substantially thermally sealed storage container. The outer wall 350 is fabricated from a material that also has sufficient strength and durability within the temperature and physical stress parameters of a specific embodiment. For example, in some embodiments the outer wall 350 is fabricated from aluminum, or a polycarbonate plastic material. In some embodiments, it may be desirable to visualize the phase change material within the outer wall 350, for example to see if it is evenly dispersed, if it has frozen, or if there is a sufficient quantity of phase change material. For example, in some embodiments the outer wall 350 is fabricated from a substantially transparent material. For example, in some embodiments the outer wall is fabricated from a substantially transparent plastic material.

The outer wall and the end cap of the cooling region substantially enclose a phase change material. See: Oró et al., "Review on Phase Change Materials (PCMs) for Cold Thermal Energy Storage Applications," *Applied Energy* 99: 513-533 (2012); Azzouz et al., "Improving the Energy Efficiency of a Vapor Compression System Using a Phase Change Material," Second Conference on Phase Change Material & Slurry: Scientific Conference & Business Forum, 15-17 Jun., 2005, Yverdon-les-Bains, Switzerland; Chiu and Martin, "Submerged Finned Heat Exchanger Latent Heat Storage Design and its Experimental Verification," *Applied Energy* 93: 507-516 (2012): Groulx and Ogoh, "Solid-Liquid Phase Change Simulation Applied to a Cylindrical Latent Heat Energy Storage System," Excerpt from the Proceedings of the COMSOL Conference, Boston (2009); Conway et al., "Improving Cold Chain Technologies through the Use of Phase Change Material," Thesis, University of Maryland (2012); Robak et al., "Enhancement of Latent Heat Energy Storage Using Embedded Heat Pipes," *International Journal of Heat and Mass Transfer* 54: 3476-3483 (2011); Sharifi et al., "Heat Pipe-Assisted Melting of a Phase Change Material," *International Journal of Heat and Mass Transfer* 55: 3458-3469 (2012); and Stampa and Nieckele, "Numerical Study of Ice Layer Growth Around a Vertical Tube," Engenharia Térmica (Thermal Engineering) 4(2): 138-144 (2005), which are each incorporated by reference. The selection of a phase change material within the cooling region of the device depends on the embodiment. Factors to be considered in selecting a phase change material for an embodiment include; cost, mass, toxicity, thermal properties, phase change temperatures, and expansion properties of a specific phase change material. In some embodiments, a phase change material includes water and ice. In some embodiments, a phase change material includes an organic material. In some embodiments, a phase change material includes an inorganic material.

In some embodiments, the region 310 includes a phase change material that has a liquid state and a frozen state during use of the device in a specific temperature range. The two states of the phase change material can have different dielectric properties, such as different dielectric constants. For example, in some embodiments the cooling region 310 includes a phase change material that includes water that freezes into ice during use of the regulated cooling device 300. The outer wall 350 material utilized in those embodiments should be durable through the freeze/thaw process. For example, in some embodiments, during use of the regulated cooling device 300, the cooling region 310 includes a phase change material that includes water within the outer wall 350, and approximately ⅔ of the water is maintained as ice at a position adjacent to the heat pipe 400 during the entire period of use of the regulated cooling device 300 within a container, while the remaining ⅓ of the water alternately freezes and thaws during on/off cycles of the regulated cooling device 300. For example, in some embodiments, during use of the regulated cooling device 300, the cooling region 310 includes approximately 600 g of water within the outer wall 350, and approximately 400 g of the water is maintained as ice at a position adjacent to the heat pipe 400 during the entire period of use of the regulated cooling device 300 within a container, while the remaining approximately 200 g of the water alternately freezes and thaws during on/off cycles of the regulated cooling device 300.

The cooling region 310 includes a first region of thermal heat pipe 400 positioned within the outer wall 350 substantially parallel to the inner surface of the outer wall 350, wherein the first region of the thermal heat pipe 400 includes a first end with a heat-absorbing interface. As shown in FIG. 4, the heat pipe 400 is substantially linear. Also as shown in FIG. 4, the heat pipe 400 is positioned within the core region of the regulated cooling device 300 along the long axis of the regulated cooling device 300. In some embodiments, the outer surface of the heat pipe 400 includes a textured surface. The textured surface can, for example, be of a size and shape to promote formation of ice crystals along the outer surface at a position adjacent to the textured surface. In some embodiments, the textured surface is positioned throughout the majority of the outer surface of the heat pipe 400 to promote formation of ice within water contained in the cooling region 310 throughout the region adjacent to the outer surface of the heat pipe 400. In some embodiments, the textured surface is positioned on a region of the outer surface of the heat pipe 400 to promote formation of ice within water contained in the cooling region 310 throughout the region adjacent to the outer surface of the heat pipe 400. For example, the textured surface may be positioned along one or more stripes positioned along the long axis of the heat pipe 400.

In some embodiments, the cooling region 310 includes a phase change material-retaining unit with an outer boundary substantially formed by the outer wall 350, and phase change material within the phase change material-retaining unit. In some embodiments, the first region of the thermal heat pipe 400 has an outer surface, the outer surface positioned substantially parallel to the inner surface of the outer wall 350 of the cooling region 310, with a phase change material-impermeable gap between the outer surface of the heat pipe and the inner surface of the outer wall 350 of the cooling region 310. Some embodiments include phase change material within the phase change material-impermeable gap. Phase change material is selected for a specific embodiment based on factors including the predetermined temperature range of use, thermal transmission properties, mass, density, toxicity and cost. Phase change material within the cooling region 310 can include, for example, liquid water or ice. In embodiments wherein water is included as a phase change material and the predetermined temperature range for a storage region adjacent to the regulated cooling device 300 is in the range of approximately 0 degrees Centigrade to approximately 10 degrees Centigrade, up to 0.5% w/w of silver iodide can be included with the phase change material to reduce the potential supercooling of the water.

As illustrated in FIG. 4, in some embodiments the cooling region 310 includes an end cap 355. The end cap 355 is attached to the outer surface of the outer wall 350 and aligned with the first end of the thermal heat pipe 400. The end cap 355 is of a size and shape to protect the end of the cooling region 310 when the regulated cooling device 300 is in use within a substantially thermally sealed storage region of a container. The end cap 355 is of a size and shape and material fabrication to support and insulate the bottom edge of the outer wall 350 and of the heat pipe 400 when the regulated cooling device 300 is moved into and out of the single access aperture in a substantially thermally sealed storage container, for example. The cooling region 310 of the regulated cooling device 300 is of a size, shape and length to not come into direct contact with an interior surface of the substantially thermally sealed storage region of a container when the regulated cooling device 300 is in use. The end cap 355 can be fabricated, for example, from a durable plastic. The end cap 355 can be fabricated, for example, from a structurally firm foam material.

FIG. 4 also illustrates that the regulated cooling device 300 includes an adiabatic region 320. The adiabatic region 320 includes an insulation unit 370, the insulation unit 370 including an outer surface of a size and shape to reversibly mate with a surface of an access conduit within a substantially thermally sealed storage container, the insulation unit 370 including an inner surface of a size and shape to reversibly mate with an outer surface of the thermal heat pipe 400. In some embodiments, the insulation unit 370 is fabricated as a single unit. In some embodiments, the insulation unit 370 is fabricated as multiple connecting units. The adiabatic region 320 includes a second region of the thermal heat pipe 400 positioned adjacent to the inner surface of the insulation unit 370. In some embodiments, the insulation unit 370 is configured as a substantially tubular or cylindrical structure, and the inner surface of a size and shape to reversibly mate with an outer surface of the thermal heat pipe 400 approximately follows the central axis of the tubular structure or cylindrical structure. In some embodiments, the thermal heat pipe is positioned approximately along the central axis of the length of the tubular structure (e.g. as illustrated in FIG. 4). The insulation unit 370 is fabricated, depending on the embodiment, of a material with low thermal transfer properties, low mass, durability, and strength, at the expected use temperatures. In some embodiments, the insulation unit 370 includes a solid plastic foam material.

In some embodiments, the adiabatic region 320 includes a stabilizer unit 360, positioned adjacent to the junction between the outer wall 350 of the cooling region 310 and the insulation unit 370. In some embodiments, the adiabatic region 320 includes a stabilizer unit 360 attached to a first end of the insulation unit 370 and to the outer surface of the outer wall 350 of the cooling region 310 at a position distal to the first end of the thermal heat pipe 400. In some embodiments, the stabilizer unit 360 is attached to the insulation unit 370 with one or more fasteners 420. In some embodiments, the stabilizer unit 360 is attached to the insulation unit 370 and to the outer wall 350 to form a liquid-impermeable junction between the insulation unit 370 and the outer wall 350. The stabilizer 360 can be fabricated, for example, from a durable plastic material. A stabilizer should be fabricated from a material with sufficient durability for use in the expected temperature ranges for the regulated cooling device 300, and with low thermal transfer properties in the expected temperature ranges.

In some embodiments, the insulation unit 370 of the adiabatic region 320 includes a medicinal storage cup 470 attached to the insulation unit 370 at a region of the insulation unit 370 proximal to the cooling region 310. In the embodiment illustrated in FIG. 4, the medicinal storage cup 470 is positioned within the cooling region 310 and attached by its top end to the stabilizer 360 of the adiabatic region 320. Some embodiments include a medicinal storage cup attached to the insulation unit at a region of the insulation unit proximal to the outer wall forming the phase change material-impermeable gap. A medicinal storage cup 470 includes an outer boundary that is no greater than the outer boundary of the insulation unit 370, so that inclusion of the medicinal storage cup 470 does not increase the dimension of the outer surface of the insulation unit 370. In some embodiments, a medicinal storage cup 470 can include, for example, an outer circumference that is substantially the same as the outer circumference of the insulation unit 370. In some embodiments, a medicinal storage cup 470 can be, for example, contiguous with a tubular or cylindrical outer surface of an insulation unit 370. In some embodiments, a medicinal storage cup 470 can include, for example, an outer circumference that is less than the outer circumference of the insulation unit 370. In some embodiments, a medicinal storage cup 470 can be, for example, fabricated from polycarbonate material. In some embodiments, a medicinal storage cup 470 can include, for example, a cup structure, including side walls and a bottom with an open top for access of medicinal units within the cup structure. In some embodiments, a medicinal storage cup can be, for example, a hollow region within the insulation unit. For example, a medicinal storage cup can be a hollow region within an insulation unit that is otherwise fabricated from a solid foam structure. In some embodiments, a medicinal storage cup 470 can be of a size and shape to retain a small quantity of medicinal units, such as vaccine vials, single-use syringes, or Uniject™ devices.

During use of a regulated cooling device 300 including a medicinal storage cup 470 within a substantially thermally sealed storage container, the regulated cooling device 300 can be partially lifted out of the container by a user to quickly and easily access one or more medicinal units within the medicinal storage cup 470. During use of a regulated cooling device 300 including a medicinal storage cup 470 within a substantially thermally sealed storage container, one or more medicinal units within the medicinal storage cup can be stored in a position that maintains them within the predetermined temperature range of the regulated cooling device 300, as well as in an easily accessible location for a user, such as a medical caregiver.

In some embodiments, the insulation unit 370 of the adiabatic region 320 includes a wire conduit within the insulation unit 370, the wire conduit including an internal surface configured to mate with an outer surface of a wire. See, e.g. FIGS. 10 and 11. In some embodiments, the wire conduit within the insulation unit 370 encloses a wire connecting one or more temperature sensors of the cooling region 310 and the microcontroller in the electronics unit 335. Some embodiments include a plurality of temperature sensors positioned adjacent to the outer surface of the outer wall 350 surrounding the first end of the heat pipe 400, and a connector between the plurality of temperature sensors and the microcontroller. For example, the connector can include a wire. For example, the connector can include an optical fiber.

In the embodiment illustrated in FIG. 4, the regulated cooling device 300 includes a lid region 330. The lid region 330 includes a third region of the thermal heat pipe 400, the third region including a second end with a heat-releasing interface. The lid region 330 includes a thermoelectric unit 430 in thermal contact with the second end of the thermal heat pipe 400. For example, the thermoelectric unit 430 can be in direct physical contact with the second end of the thermal heat pipe 400. For example, the thermoelectric unit 430 can be in thermal contact with the second end of the thermal heat pipe 400 through an intermediate layer, such as a metal sheet. A thermal transfer unit 460 is positioned adjacent to the second end of the heat pipe 400 and is in thermal contact with the thermoelectric unit 430. The lid region 330 includes a thermal dissipator unit 390 in contact with the thermoelectric unit 430. The lid region 330 includes an outer wall 385 that substantially surrounds the third region of the thermal heat pipe 400, the thermoelectric unit 430 and a first region of the thermal dissipator unit 390. A second region of the thermal dissipator unit 390 projects through an aperture in the outer wall 385 of the lid region 330. The second region of the thermal dissipator unit 390 includes a plurality of thermal fins 395. A cover 380 is positioned over the thermal dissipator unit 390 exterior to the outer wall 385 of the lid region 330, with a space between the surface of the cover 380 and the surface of the thermal dissipator unit 390 in order to allow for heat to dissipate from the surface of the thermal dissipator unit 390, including from the plurality of thermal fins 395. The lid region 330 includes a fan positioned to increase air flow across the plurality of thermal fins 395. The fan is connected to the microcontroller within the electronics unit 335.

The lid region 330 includes a surface, adjacent to the adiabatic region 320, which is configured to reversibly mate with an external surface of a substantially thermally sealed storage container. For example, the surface can be of a size and shape to conform with the size and shape of an external surface of a substantially thermally sealed storage container, such as the end of an access conduit (see, e.g. FIGS. 1 and 2). In some embodiments, the regulated cooling device 300 includes a lid enclosure surrounding the thermal dissipator unit 390 and the microcontroller, the lid enclosure including at least one first wall 385, the lid enclosure including at least one second wall 440 with an external surface configured to reversibly mate with an external surface of the substantially thermally sealed storage container. In some embodiments, the first wall 385 and the second wall 440 are attached to each other with one or more fasteners 450. In some embodiments, a handle 340 is attached to the outer wall 385 of the lid region. The handle 340 is attached with sufficient structure to hold the weight of the regulated cooling device 300, for example, when the regulated cooling device 300 is lifted in and out of the access conduit of a substantially thermally sealed container.

In some embodiments and as depicted in FIG. 4, the regulated cooling device 300 includes a lid region 330 with an integrated electronics unit 335. The electronics unit 335 includes: a microcontroller connected to the at least one temperature sensor, to the thermoelectric unit and to the thermal dissipator unit, and a power source attached to the microcontroller. In some embodiments, the electronics unit 335 is configured to be modular and replaceable. In some embodiments, the electronics unit 335 includes a user interface unit, for example including one or more displays, touchpads, touchscreens, buttons or dials. The user interface unit can, for example, be connected to the microcontroller and configured to receive signals from, and send signals to, the microcontroller.

FIG. 4 illustrates that the first region of the thermal heat pipe, the second region of the thermal heat pipe, and the third region of the thermal heat pipe are substantially linear. When the regulated cooling device 300 is in use with a substantially thermally sealed container (see, e.g. FIG. 10), the regulated cooling device 300 is in a substantially upright, or vertical position along its long axis including the heat pipe 400. The first region of the thermal heat pipe is configured to operate while positioned below the second region of the thermal heat pipe. The cooling region 310 operates efficiently when positioned below the lid region 330 and with the adiabatic region 320 between the cooling region 310 and the lid region 330.

In some embodiments, the regulated cooling device 300 is constructed so that it functions efficiently when positioned with its main linear axis substantially upright, such as illustrated in FIGS. 3 and 4. This position allows the heat pipe 400 within the regulated cooling device 300 to conduct heat from the cooling region 310 to the lid region 330, and for that heat to be transferred from the heat pipe 400 to the thermoelectric unit 430 and further to the thermal dissipator unit 390 when the regulated cooling device 300 is actively cooling. The substantially upright position of the regulated cooling device 300, with the regions 330, 320, 310 oriented linearly and the lid region 330 positioned substantially above the cooling region 310 during use, also minimizes thermal transfer between the cooling region 310 to the lid region 330 when the thermoelectric unit 430 and the thermal dissipator unit 390 are not active, i.e. when the regulated cooling device 300 is not actively cooling. In the absence of thermal transfer of heat away from the heat pipe 400 in the lid region 330 of the regulated cooling device 300, gravity will act on the heat pipe 400 and minimize the transfer of heat from the lower cooling region 310 to the upper lid region 330. The upright configuration of the device allows active cooling by the regulated cooling device 300 when the thermoelectric unit 430 and the thermal dissipator unit 390 are actively transferring heat away from the heat pipe 400. The upright configuration also minimizes heat transfer through the entire length of the heat pipe, against gravity, when the thermoelectric unit 430 and the thermal dissipator unit 390 are not actively transferring heat away from the top end of the heat pipe.

In some embodiments, a regulated cooling device 300 includes a substantially tubular thermal heat pipe including a first end with a heat-absorbing interface, and a second end with a heat-releasing interface. In some embodiments, a regulated cooling device 300 includes a phase change material-retaining unit surrounding the first end of the thermal heat pipe, the phase change material-retaining unit including an outer wall surrounding the first end of the heat pipe, the outer wall including an inner surface and an outer surface, the outer wall forming a phase change material-impermeable gap around the first end of the heat pipe, the inner surface positioned substantially parallel to an outer surface of the thermal heat pipe, an end cap sealed to a first edge of the outer wall distal to the first end of the heat pipe, and a phase change material within the phase change material-impermeable gap. In some embodiments, a regulated cooling device 300 includes a sensor conduit attached to the outer surface of the outer wall of the phase change material-retaining unit, the sensor conduit including a first temperature sensor positioned to detect temperature in a location adjacent to the end cap, and a second temperature sensor positioned to detect temperature in a location adjacent to the outer wall distal to the end cap. See, e.g. FIG. 5. In some embodiments, a regulated cooling device 300 includes at least one capacitance sensor attached to the outer surface of the phase change material-retaining unit and positioned to detect capacitance across the phase change material within the phase change material-impermeable gap. See, e.g. FIGS. 6 and 7. In some embodiments, a regulated cooling device 300 includes an insulation unit surrounding the heat pipe at a region between the first end and the second end, the insulation unit including a lower surface sealed to a second edge of the outer wall of the phase change material-retaining unit, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe at the region between the first end and the second end. In some embodiments, a regulated cooling device 300 includes an electronics conduit within the insulation unit, the electronics conduit including one or more wires attached to the first and second temperature sensors within the sensor conduit. In some embodiments, a regulated cooling device 300 includes a thermoelectric unit in thermal contact with the second end of the thermal heat pipe. In some embodiments, a regulated cooling device 300 includes a thermal dissipator unit in thermal contact with the thermoelectric unit. In some embodiments, a regulated cooling device 300 includes a microcontroller connected to the one or more connectors attached to the first and second temperature sensors, to the at least one capacitance sensor, to the thermoelectric unit and to the thermal dissipator unit. In some embodiments, a regulated cooling device 300 includes a power source attached to the microcontroller.

FIG. 5 illustrates a regulated cooling device 300 from an external view. The view shown in FIG. 5 is similar to that illustrated in FIG. 3, with the embodiment of the regulated cooling device 300 shown from a different vantage point. The regulated cooling device 300 shown in FIG. 5 includes a lid region 330, an adabatic region 320 and a cooling region 310.

The cooling region 310 of the regulated cooling device 300 shown in FIG. 5 includes an outer wall 350 and an end cap 355. In the embodiment illustrated, the cooling region 310 also includes a sensor conduit 500. The sensor conduit 500 is positioned adjacent to the outer surface of the outer wall 350 of the cooling region 310. The sensor conduit 500 is positioned substantially parallel to the outer surface of the outer wall 350 of the cooling region 310 throughout the majority of the outer wall 350. The sensor conduit in the embodiment illustrated in FIG. 5 is a substantially tubular structure with a first end and a second end, the first end attached to the lower surface of the stabilizer unit 360 and the second end positioned adjacent to the end cap 355. A fastener 510 holds the second end of the sensor conduit 500 in position relative to the outer wall 350 and the end cap 355.

The sensor conduit 500 includes one or more sensors configured to detect one or more conditions in the region adjacent to the outer wall 350 of the cooling region 310. During use of the regulated cooling device 300, the sensors are positioned to detect conditions within a substantially thermally sealed storage region of a container (see, e.g. FIG. 10). For example, in some embodiments the sensor conduit 500 is a substantially hollow structure, with one or more sensors positioned within the interior of the sensor conduit 500. For example, in some embodiments the sensor conduit 500 is a support structure, with one or more sensors attached to the exterior surface of the sensor conduit 500. For example, in some embodiments the sensor conduit 500 includes a series of apertures, with one or more sensors positioned adjacent to the apertures. In some embodiments, the sensor conduit includes one or more temperature sensors. In some embodiments, the sensor conduit 500 includes a plurality of sensors positioned at substantially equal distances along the length of the sensor conduit 500. In some embodiments, the sensor conduit includes three sensors, one positioned at the end of the sensor conduit 500 adjacent to the end cap 355, one positioned substantially at the midpoint of the sensor conduit 500, and one positioned adjacent to the stabilizer unit 360. Some embodiments include a sensor conduit 500 encompassing a plurality of temperature sensors as well as at least one additional sensor. An additional sensor can include, for example, a label detector (e.g. positioned to detect a label, bar code, or "Q" code attached to stored material in a substantially thermally sealed storage container when the device 300 is in use), such as a RFID reader, or an optical scanner. An additional sensor can include, for example, a condition detector (e.g. positioned to detect a condition within the storage region of a substantially thermally sealed storage container when the device 300 is in use), such as a chemical sensor, or a gas pressure sensor.

The sensors within the sensor conduit 500 include at least one temperature sensor. In some embodiments, one or more sensors within the sensor conduit 500 are resistance temperature detectors. For example, one or more sensors within the sensor conduit 500 can be Pt100 (platinum 100Ω) resistance temperature detectors in a 3-wire configuration. In some embodiments, one or more sensors within the sensor conduit 500 are thermistors. In some embodiments, the one or more sensors within the sensor conduit 500 are thermocouples. For example, in some embodiments temperature accuracy does not require a system error of less than 1 degree Centigrade, and the one or more sensors within the sensor conduit 500 are thermocouples. In some embodiments, one or more sensors within the sensor conduit 500 are integrated circuit temperature sensors. In embodiments including integrated circuit temperature sensors, the integrated circuit temperature sensors can include insulation configured to minimize condensation within the temperature sensors during use. The at least one temperature sensor is attached to a connector, the connector capable of transferring data from the temperature sensor to the microcontroller. The at least one temperature sensor is attached to a connector, the connector capable of transferring power from the microcontroller to the temperature sensor. For example, in some embodiments one or more temperature sensor is positioned within a substantially hollow sensor conduit 500, and one or more wire connectors are positioned within the substantially hollow sensor conduit 500, the one or more wires connecting the one or more temperature sensor to the microcontroller. For example, in some embodiments one or more temperature sensor is positioned within a substantially hollow sensor conduit 500, and one or more fiber optic connectors are positioned within the substantially hollow sensor conduit 500, the one or more fiber optic connectors connecting the one or more temperature sensor to the microcontroller.

FIG. 5 illustrates that the regulated cooling device 300 includes an adiabatic region 320 including an insulation unit 370. A stabilizer unit 360 is attached to the insulation unit 370 at a region adjacent to the cooling unit 310. The stabilizer unit 360 is of a size and shape to provide support to the insulation unit 370 relative to the cooling region 310, including the sensor conduit 500. The stabilizer unit 360 is attached to both the insulation unit 370 and the cooling region 310, to provide stability to the relative positions of the insulation unit 370 and the cooling region 310 during use of the regulated cooling device 300.

The embodiment illustrated in FIG. 5 also includes a lid region 330. The lid region 330 includes an outer wall 385 and a handle 340. The lid region 330 includes a thermal dissipator unit 390 that is partially exposed to the ambient air surrounding the lid region 330. The thermal dissipator unit 390 includes a plurality of thermal fins 395 exposed to the air surrounding the device. A cover 380 encloses the top edge of the thermal dissipator unit 390 over the thermal fins 395. In the view of the embodiment illustrated in FIG. 5, no distinct electronics unit is visible, however the regulated cooling device 300 includes a microcontroller connected to the at least one temperature sensor within the sensor conduit 500, to a thermoelectric unit within the lid region 330, and to the thermal dissipator unit 390. The regulated cooling device 300 also includes a power source attached to the microcontroller.

Figure 6:
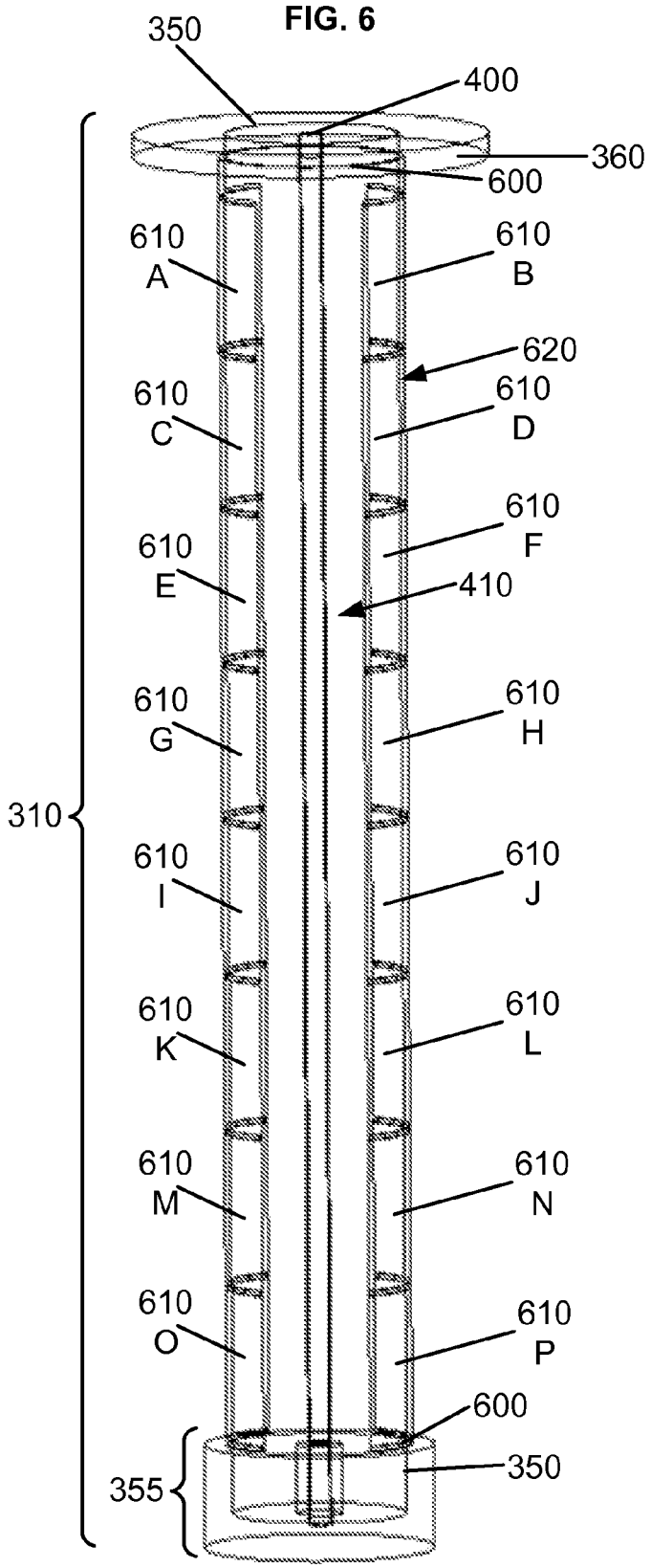
FIG. 6 illustrates aspects of a regulated cooling device.

FIG. 6 depicts aspects of a cooling unit 310 of a regulated cooling device. For purposes of illustration, only the cooling unit 310 is shown in FIG. 6. The cooling unit 310 is illustrated with features shown as outlines, to depict the position of the features of the cooling unit 310 relative to each other. A stabilizer 360 is positioned at the end of the cooling unit 310 that is connected to an insulation unit when the regulated cooling device is in use. The stabilizer 360 is connected to the outer wall 350 of the cooling unit 310. The stabilizer 360 is configured to maintain the position of the outer wall 350 of the cooling unit 310 relative to the insulation unit. An end cap 355 is attached to the outer wall 350 of the cooling unit 310 at a position distal to the stabilizer 360.

The cooling unit 310 includes a plurality of electrodes 610 A, 610 B, 610 C, 610 D, 610 E, 610 F, 610 G, 610 H, 610 I, 610 J, 610 K, 610 L, 610 M, 610 N, 610 O and 610 P, positioned adjacent to the outer surface of the outer wall 350. The plurality of electrodes 610 A, 610 B, 610 C, 610 D, 610 E, 610 F, 610 G, 610 H, 610 I, 610 J, 610 K, 610 L, 610 M, 610 N, 610 O and 610 P are collectively referred to as "electrodes 610" with reference to the figures herein. In some embodiments, the electrodes 610 are attached to the outer surface of the outer wall 350, for example with adhesive. The electrodes are fabricated from electrically conductive material, as suitable to a particular embodiment. For example, in some embodiments the electrodes are fabricated from copper. In the embodiment shown in FIG. 6, the electrodes 610 are positioned along the length of the outer wall 350 of the cooling unit 310. In the embodiment shown in FIG. 6, the electrodes 610 are positioned along the length of the outer wall 350 in opposing pairs, so that each electrode 610 is positioned parallel to another electrode 610 around a circumference of the outer wall 350. For example, in the embodiment shown in FIG. 6, electrode 610 A and electrode 610 B are positioned facing each other and in parallel along a circumference of the outer wall 350. For example, in the embodiment shown in FIG. 6, electrode 610 C and electrode 610 D are positioned facing each other and in parallel along the circumference of the outer wall 350. Similarly, in the embodiment shown in FIG. 6, each of the electrode pairs 610 E and 610 F, 610 G and 610 H, 610 I and 610 J, 610 K and 610 L, 610 M and 610 N, and 610 O and 610 P are positioned facing each other and in parallel along the circumference of the outer wall 350. The embodiment shown in FIG. 6 includes 16 electrodes positioned in 8 pairs, which are positioned facing each other and in parallel along the circumference of the outer wall 350. In some embodiments, a cooling unit 310 includes more or less than 16 electrodes positioned in 8 pairs. For example, in some embodiments a cooling unit includes 4 electrodes positioned as 2 pairs along the circumference of the outer wall 350. For example, in some embodiments a cooling unit includes 6 electrodes positioned as 3 pairs along the circumference of the outer wall 350. For example, in some embodiments a cooling unit includes 8 electrodes positioned as 4 pairs along the circumference of the outer wall 350. For example, in some embodiments a cooling unit includes 10 electrodes positioned as 5 pairs along the circumference of the outer wall 350. For example, in some embodiments a cooling unit includes 12 electrodes positioned as 6 pairs along the circumference of the outer wall 350. For example, in some embodiments a cooling unit includes 14 electrodes positioned as 7 pairs along the circumference of the outer wall 350. For example, in some embodiments a cooling unit includes 18 electrodes positioned as 9 pairs along the circumference of the outer wall 350. For example, in some embodiments a cooling unit includes 20 electrodes positioned as 10 pairs along the circumference of the outer wall 350. In some embodiments, the electrodes are fabricated from a thin, flexible material that can be molded around the circumference of the outer wall 350 during fabrication of the cooling unit 310. The electrodes 610 are connected to a controller with a wire connection.

A guard electrode 600 encircles the outer surface of the electrodes 610. The guard electrode can be, for example, fabricated from copper. The guard electrode 600 is of a size and shape to encircle the electrodes 610 without coming in physical contact with the electrodes 610. In some embodiments, each of the electrodes 610 include an outer surface that is positioned substantially in parallel with the interior surface of the guard electrode 600. In some embodiments, the guard electrode 600 is earthed. A gap 620 is positioned between the outer surface of the electrodes 610 and the inner surface of the guard electrode 600. In some embodiments, the gap 620 includes an insulator material. For example, the gap 620 can include an electrically insulating spacer material.

The electrodes 610 are positioned to measure the dielectric capacitance across the adjacent region of the outer wall 350 of the cooling region 310 of the device. The electrodes 610 are connected to the microcontroller in the electronics unit 335 with a wire connection. A wire connecting the electrodes 610 and the microcontroller can, for example, be positioned adjacent to the outer surface of the heat pipe. A wire connecting the electrodes 610 and the microcontroller can, for example, be positioned within the sensor conduit and along with the connector between the sensors and the microcontroller.

A heat pipe 400 is positioned within the circumference of the outer wall 350, approximately parallel to the inner surface of the outer wall. The heat pipe 400 is positioned approximately along the central axis of the cooling unit 310. A gap 410 is located between the outer surface of the heat pipe 400 and the inner surface of the outer wall 350. During use of the device, a phase change material with different dielectric properties in its distinct phases is positioned within the gap 410. For example, in some embodiments the phase change material is water and ice.

Figure 7:
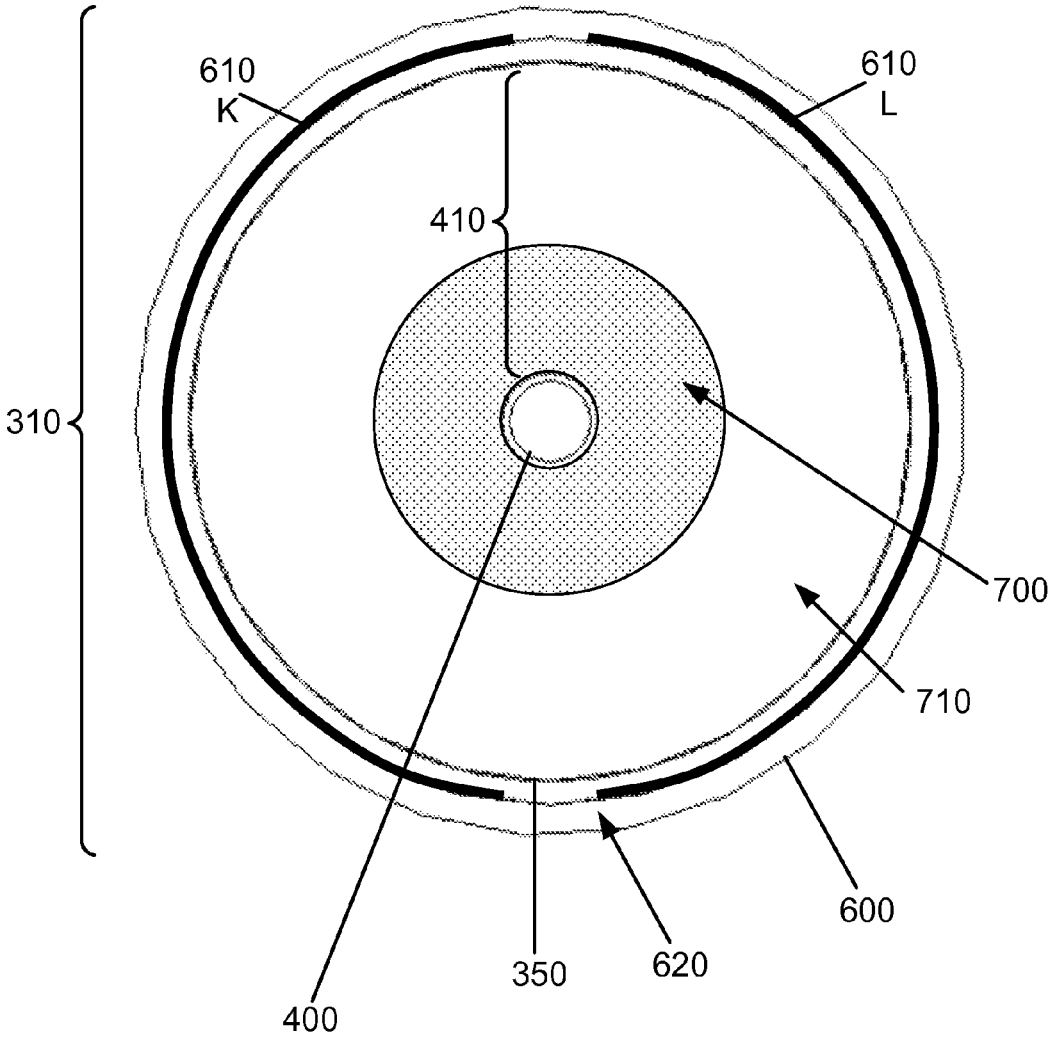
FIG. 7 shows aspects of a regulated cooling device.

FIG. 7 illustrates aspects of an embodiment during use of a regulated cooling device. FIG. 7 shows a cross-sectional view through the cooling unit 310 of a device. The view is shown in a plane approximately perpendicular to the long axis of the cooling unit 310 of the device. FIG. 7 shows an embodiment wherein the cooling unit 310 is substantially circular in cross section. FIG. 7 shows that a heat pipe 400 is positioned at the core of the substantially circular cooling unit 310. The heat pipe 400 is a wicking heat pipe, and therefore includes a substantially hollow interior region. An outer wall 350 encircles the heat pipe 400 completely. There is a gap 410 between the inner surface of the outer wall 350 and the outer surface of the heat pipe 400. As shown in FIG. 7, the gap 410 is of substantially constant dimension along the radius of the circular cross section of the cooling unit 310.

In the embodiment illustrated, a phase change material is positioned within the gap 410. The phase change material has at least two states with different dielectric properties. For example, the phase change material can be water and ice. Phase change material in a first phase 700 is located adjacent to the exterior surface of the heat pipe 400. Phase change material in a second phase 710 is located adjacent to the interior surface of the outer wall 350. The first phase 700 is the colder state of the phase change material, positioned adjacent to the cooling surface of the heat pipe 400. For example, in some embodiments, the first phase of the phase change material is ice. The second phase 710 is the warmer state of the phase change material, positioned distal to the cooling surface of the heat pipe 400. For example, in some embodiments, the second phase of the phase change material is water.

FIG. 7 depicts that the cooling unit 310 includes a guard electrode 600 at the outer perimeter of the cooling unit 310. In some embodiments, the guard electrode 600 is an earthed guard electrode. A first electrode 610 K is positioned adjacent to a region of the outer wall 350. A second electrode 610 L is positioned adjacent to a region of the outer wall 350 and facing the first electrode 610 K. A gap 620 is located between the inner surface of the guard electrode 600 and the outer surfaces of the first and second electrodes 610 K and 610 L. In some embodiments, an electrically insulating material is positioned within the gap 620.

The electrodes of a cooling unit are attached to the outer wall of the cooling unit and positioned to measure the dielectric capacitance across the diameter of the adjacent cooling region, including the first phase of the phase change material and the second phase of the phase change material. The dielectric capacitance measurements can serve, inter alia, as a basis for calculating the relative amounts of a first phase of a phase change material and a second phase of a phase change material within the cooling region. For example, in some embodiments the phase change material is water and ice, and the dielectric capacitance measurements from the electrodes are the basis for calculating the relative volume of water to ice within the cooling region of the device at a given time. Multiple dielectric capacitance measurements taken from a device at different points in time can serve, inter alia, as the basis for calculating the relative volume of water to ice within the cooling region of the device over time. More information regarding measurements of dielectric capacitance can be found, for example, in: "Capacitive Probe for Ice Detection and Accretion Rate Measurement: Proof of Concept," Owusu, Master of Science thesis, Department of Mechanical Engineering, University of Manitoba (2010); Mughal et al., "Review of Capacitive Atmospheric Icing Sensors," The Sixth International Conference on Sensor Technologies and Applications, (SENSORCOMM 2012); Peng et al., "Determination of the Optimal Axial Length of the Electrode in an Electrical Capacitance Tomography Sensor," *Flow Measurement and Instrumentation* 16:169-175 (2005); Peng et al., "Evaluation of Effect of Number of Electrodes in ECT Sensors on Image Quality," IEEE Sensors Journal 12 (5): 1554-1565 (2012); and Yu et al., "Comparison Study of Three Common Technologies for Freezing-Thawing Measurement," *Advances in Civil Engineering*, doi:10.1155/2010/239651 (2010), which are each incorporated herein by reference. More information regarding measurements of annular capacitance, including the use of two different excitation potentials, can be found, for example, in: Mohamad et al., "An Analysis of Sensitivity Distribution Using Two differential Excitation Potentials in ECT," *IEEE Fifth International Conference on Sensing Technology,* 575-580, (2011); Mohamad et al., "A Introduction of Two Differential Excitation Potentials Technique in Electrical Capacitance Tomography," *Sensors and Actuators A,* 180 1-10 (2012); and Ye and Yang, "Evaluation of Electrical Capacitance Tomography Sensors for Concentric Annulus," *IEEE Sensors Journal,* 13 (2) 446-456 (2013), which are each incorporated herein by reference.

During use of a regulated cooling device, the changes in inter-electrode capacitance due to the change in distribution and phase of a phase change material with a first phase having a first dielectric constant and a second phase having a second dielectric constant within the cooling region are measured with the electrodes integral to the cooling region. Capacitance measurement data from the electrodes is received by the microcontroller and used, for example, as a basis to calculate a 2-dimensional, cross-sectional profile of the permittivity distribution internal to the cooling region. Each pair of electrodes positioned in parallel across the circumference of the cooling region (e.g. electrode 610 K and electrode 610 L as shown in FIG. 7) provides data that is used to calculate the relative amounts of a first phase and a second phase of the phase change material in a region of the cooling region between the pair of electrodes.

For example, in an embodiment such as that shown in FIG. 6, a group of electrodes positioned along a first axial line of a cooling region can be configured as detection electrodes (e.g. electrodes 610 B, 610 D, 610 F, 610 H, 610 J, 610 L, 610 N and 610 P in FIG. 6). The detection electrodes are configured with a potential of zero. The electrodes positioned along a second axial line of a cooling region can be configured as excitation electrodes (e.g. electrodes 610 A, 610 C, 610 E, 610 G, 610 I, 610 K, 610 M and 610 O in FIG. 6). The excitation electrodes are configured with a potential above zero. Each pair of electrodes at a similar position along the length of the axis of the cooling region includes one detection electrode and one excitation electrode in a capacitive circuit (e.g. electrodes 610 A and 610 B in FIG. 6 are a capacitive circuit). In some embodiments, both axial and radial guards surround each of the detection and excitation electrodes and are configured to be at earth ground. The heat pipe through the central axis of the cooling region of the device is fabricated from an electrically conductive material. For example, in some embodiments the heat pipe is fabricated with copper. The heat pipe is configured as a driven electrode with a potential between the detection electrodes and the excitation electrodes.

During measurement of capacitance with the electrodes, each of the excitation electrodes within each of the capacitive circuit pairs is excited in series along the length of the axis of the cooling region. For example, in an embodiment such as illustrated in FIG. 6, the excitation electrode in the capacitive circuit pair positioned closest to the stabilizer plate (e.g. electrode 610 A) can first be excited with a potential above zero volts, while all of the remaining electrodes remain at earth ground. A capacitance measurement is then taken across the capacitive circuit pair with the excited electrode (e.g. electrodes 610 A and 610 B). Each of the excitation electrodes within each of the capacitive circuit pairs is then excited in series along the cooling region, and a capacitance measurement is taken across the capacitive circuit pair with the excited electrode. The resulting series of measurements can be used, inter alia, to calculate the relative amounts of a first phase change material and a second phase change material between each of the capacitive circuit pairs as well as for the total region encompassed by the capacitive circuit pairs.

For initial calibration of an embodiment of a device with a specific configuration of electrodes and a specific phase change material, capacitance measurements are taken with the phase change material substantially in the first phase, and again with the phase change material substantially in the second phase. For example, in an embodiment utilizing water as a phase change material, an initial calibration can include a series of measurements taken when the phase change material is substantially water, and another series of measurements taken when the phase change material is substantially ice. The data from each of the first and second phase measurements is then used to normalize the capacitance data when the device includes both the first phase and the second phase of the phase change material (e.g. water and ice). The resulting values for each capacitive circuit pair can then be calculated as a unitless number between 0 and 1.

Figure 8:
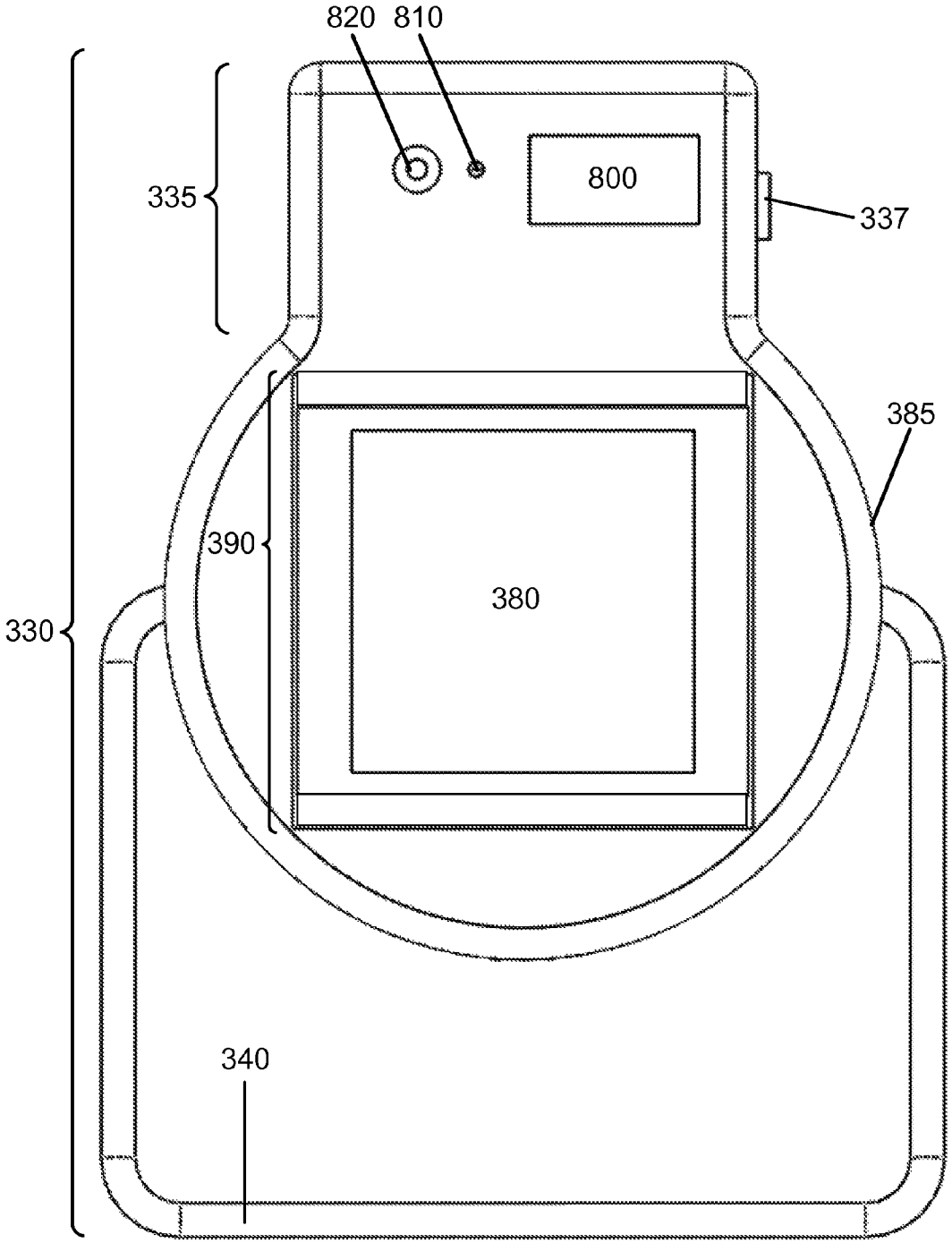
FIG. 8 shows an external, top-down view of a regulated cooling device configured for use with a substantially thermally sealed storage container.

FIG. 8 depicts the lid region of an embodiment of a regulated cooling device from a "top-down" viewpoint. As illustrated in FIG. 8, the lid region 330 includes a handle 340. The handle 340 is attached to the outer wall 385 of the lid region 330. Although the handle 340 is illustrated in a substantially horizontal position in FIG. 8, a handle 340 can be adjustable or fixed in a non-horizontal position, depending on the embodiment of the lid region 330.

The lid region 330 includes a thermal dissipator unit 390. The thermal dissipator unit 390 is configured to radiate heat to the ambient air surrounding the thermal dissipator unit 390. The thermal dissipator unit 390 includes a cover 380 positioned over at least one fan unit and a plurality of thermal fins.

The lid region 330 of the embodiment illustrated in FIG. 8 includes an electronics unit 335. The regulated cooling device 300 includes an electronics unit 335 attached to an outer wall 385 of a lid region 330. In the embodiment shown, the electronics unit 335 is substantially integrated into the lid region 330. In some embodiments, an electronics unit 335 is distinct from the structure of the lid region 330. In some embodiments, one or more components of the electronics unit 335 are modular for convenient replacement and access by a user of the regulated cooling unit.

The electronics unit 335 includes a switch 337. The switch 337 can be, for example, a binary toggle switch attached to a microcontroller internal to the electronics unit 335. The switch 337 can, for example, be attached to the electronics unit 335 as an "on/off" switch for the regulated cooling unit. The switch 337 can be a binary switch attached to the interior components of the electronics unit. For example, the switch 337 can be attached to the microcontroller within the electronics unit 335 to operate as an on/off switch for the regulated cooling device 300. In some embodiments, the electronics unit 335 includes a visual display 800, such as a liquid crystal display (LCD) or an electrophoretic ink display. In some embodiments, the electronics unit includes a switch 820, for example a binary button switch. The switch 820 can be attached to a microcontroller internal to the electronics unit 335. A switch 820 can, for example, be wired to the microcontroller and the microcontroller can be configured to initiate a specific display in response to a signal from the switch 820. The switch 820 can, for example, be operably attached to the microcontroller so that a signal created by the motion of the switch results in the microcontroller sending a signal, such as an initiation signal, to the display 800. In some embodiments, the electronics unit 335 includes a light 810, for example one or more light-emitting diodes (LEDs). The light 810 can be operably attached to the microcontroller. For example, a light may be configured to turn on and off in response to a signal from the microcontroller. For example, a microcontroller may be configured to send a signal to a light (e.g. "turn on") in response to parameters included in one or more look-up tables integrated into the circuitry of the microcontroller, such as temperature data within a preset range or capacitance data within a preset range.

Figure 9:
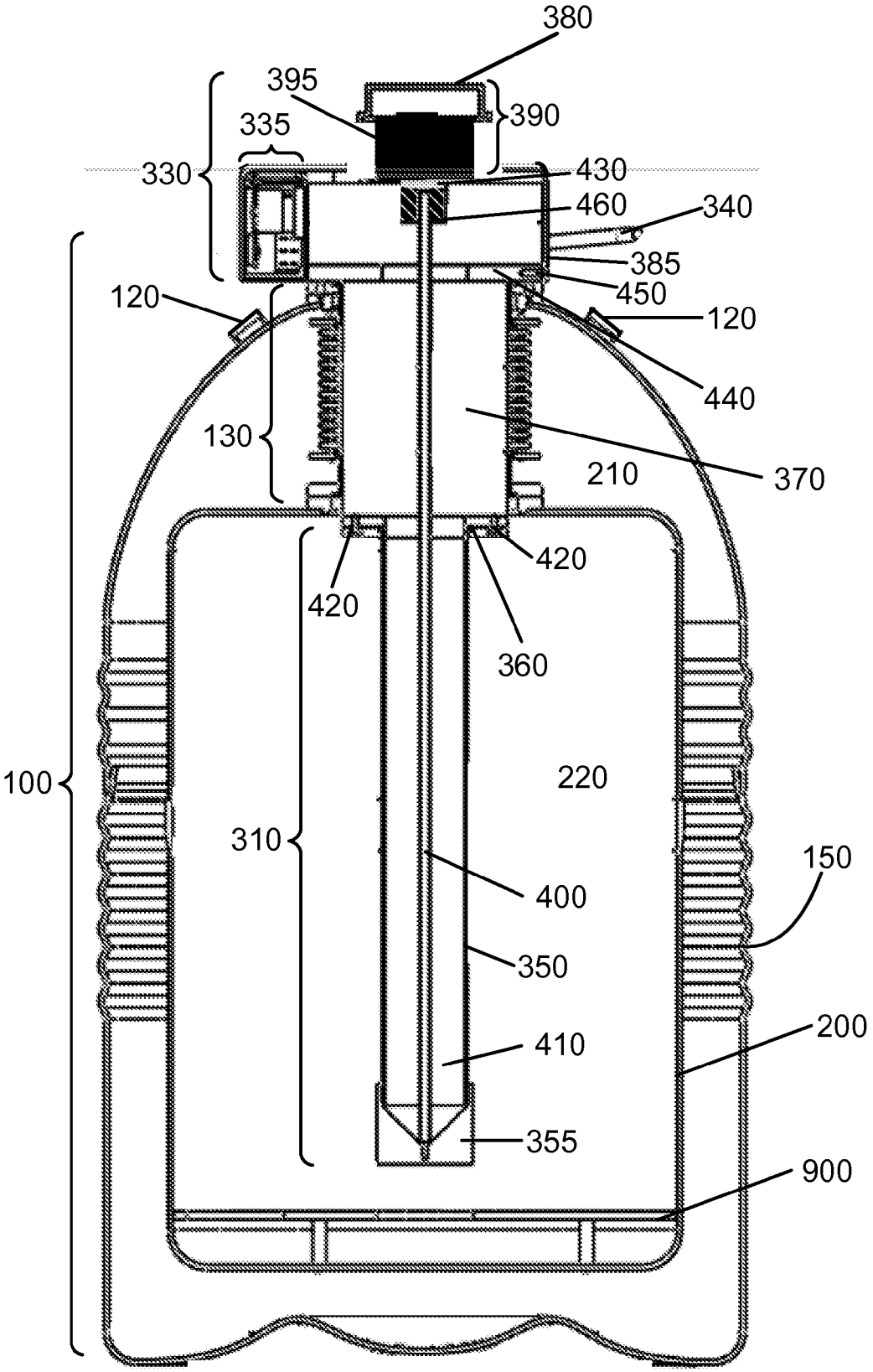
FIG. 9 depicts a vertical cross-section view of a regulated cooling device in use within a substantially thermally sealed storage container.

FIG. 9 illustrates an embodiment of a regulated cooling device in position for use with a substantially thermally sealed container 100. The view shown in FIG. 9 is a substantially cross-section view of the substantially thermally sealed container 100 and the regulated cooling unit. As shown in FIG. 9, the regulated cooling device is positioned in a substantially vertical position within the structure of the substantially thermally sealed container 100. The substantially thermally sealed container 100 includes an outer wall 150, an inner wall 200 and a sealed gap 210 between the outer wall 150 and the inner wall 200. Access ports 120 are sealed in the embodiment illustrated, but can be opened during fabrication, repair or refurbishment of the substantially thermally sealed container 100.

The regulated cooling unit includes a cooling region 310 positioned within the interior of the substantially thermally sealed storage region 220 of the substantially thermally sealed container 100. The cooling region 310 is attached at one end to the adiabatic region of the regulated cooling unit, which suspends the cooling region 310 approximately along the upper region of a central axis of the substantially thermally sealed storage region 220 of the substantially thermally sealed container 100. The cooling region 310 is positioned to not contact the inner wall 200 of the substantially thermally sealed storage region 220. In the embodiment illustrated, a storage structure 900 is affixed to the inner wall 200. The cooling region 310 of the regulated cooling unit does not contact the storage structure. During use of the substantially thermally sealed container 100, one or more storage units can be stabilized in position within the substantially thermally sealed storage region 220 by the storage structure. The cooling region 310 of the regulated cooling unit is positioned to not contact any storage units within the substantially thermally sealed storage region 220 during use of the container 100. For example, in some embodiments, one or more storage units can be positioned with at least a 2 centimeter (cm) space between the outer surface of the outer wall 350 of the cooling unit 310 and the one or more storage units. For example, in some embodiments, one or more storage units can be positioned with at least a 4 cm space between the outer surface of the outer wall 350 of the cooling unit 310 and the one or more storage units.

The cooling region 310 of the regulated cooling unit illustrated in FIG. 9 includes an outer wall 350 surrounding a thermal heat pipe 400. An end cap 355 is positioned adjacent to the end of the outer wall 350 and the thermal heat pipe 400. In some embodiments, a phase change material, for example water and ice, is positioned within the gap 410 between the outer wall 350 and the thermal heat pipe 400. In some embodiments, the phase change material has different dielectric properties in its different phases. For example, water has a higher dielectric constant value than ice. The cooling region 310 is affixed to the adiabatic region of the regulated cooling unit with a stabilizer 360. The stabilizer 360 substantially surrounds the end of the outer wall 350 distal to the end cap 355, and maintains the position of the outer wall 350. The stabilizer 360 is affixed to an insulation unit 370 of the adiabatic region with one or more fasteners 420.

As shown in FIG. 9, the insulation unit 370 of the adiabatic region of the regulated cooling unit includes an outer surface that is configured to reversibly mate with the inner surface of the single access conduit 130 within the container 100. The outer surface of the insulation unit 370 is, for example, of a size and shape to be positioned within the single access conduit 130 immediately adjacent to an inner surface of the single access conduit 130. In the embodiment illustrated in FIG. 9, the single access conduit includes an elongated thermal pathway formed from a "bellows-like" structure with a plurality of pleat structures substantially horizontal to the main internal axis of the single access conduit 130. The outer surface of the insulation unit 370 contacts the internal surface of the plurality of pleat structures during use of the regulated cooling unit. In some embodiments, there is less than a 5 millimeter (mm) space between the outer surface of the insulation unit 370 and the inner surface of the single access conduit 130 when the regulated cooling unit is in position within a substantially thermally sealed container 100. In some embodiments, there is less than a 1 mm space between the outer surface of the insulation unit 370 and the inner surface of the single access conduit 130 when the regulated cooling unit is in position within a substantially thermally sealed container 100.

The regulated cooling unit includes a lid region 330 positioned adjacent to the outer surface of the substantially thermally sealed container 100 at the end of the single access conduit 130. In the embodiment illustrated, the single access conduit 130 is substantially internal to the container 100 (e.g. the single access conduit 130 does not include an outer wall as shown in the embodiment illustrated in FIGS. 1 and 2). In the embodiment illustrated in FIG. 9, the lid region 330 of the regulated cooling unit includes a first wall 385 substantially enclosing the outer perimeter of the lid region 330. A handle 340 is affixed to the first wall 385. The lid region 330 also includes a second wall 440 connected to the first wall 385 with a fastener 450. The outer surface of the second wall 440 is positioned directly adjacent to the outer surface of the substantially thermally sealed container 100 at the end of the single access conduit 130. A thermal dissipator unit 390 projects upward from an aperture in the outer wall 385 of the lid region 330. The thermal dissipator unit 390 includes a plurality of thermal fins 395 positioned to radiate heat into the area surrounding the thermal dissipator unit 390. A cover 380 encloses the end of the thermal dissipator unit 390 distal to the aperture in the outer wall 385 of the lid region. A gap between the thermal dissipator unit 390 and the cover 380 permits air circulation around the thermal dissipator unit 390, including the plurality of thermal fins 395, external to the outer wall 385 of the lid region.

The lid region 330 of the regulated cooling unit includes a thermoelectric unit 430 positioned in thermal contact with the end of the thermal heat pipe 400. The thermoelectric unit 430 is positioned to transfer thermal energy (i.e. heat) away from the thermal heat pipe 400. A thermal transfer unit 460 surrounds the end of the thermal heat pipe 400 at a position adjacent to the thermoelectric unit 430. The thermal transfer unit 460 is configured to transfer thermal energy (i.e. heat) away from the thermal heat pipe 400 and to transfer that energy to the thermoelectric unit 430. At times when the thermoelectric unit 430 is powered (i.e. "turned on"), the thermoelectric unit 430 transfers thermal energy from the side adjacent to the thermal heat pipe to the side adjacent to the thermal dissipator unit 390, thereby transferring thermal energy from the thermal heat pipe 400 to the thermal dissipator unit 390. The thermal dissipator unit 390 is attached to the lid region 330 in a position so that a portion of the thermal dissipator unit 390 projects from the exterior of the lid region 330. The thermal dissipator unit 390 includes a plurality of thermal fins 395 and a cover 380 positioned adjacent to the distal ends of the thermal fins 395. The thermal dissipator unit 390 includes at least one fan positioned to increase air circulation around, and therefore thermal transfer from, the thermal fins 395.

In the embodiment illustrated in FIG. 9, the lid region 330 includes an electronics unit 335. The electronics unit 335 includes a microcontroller connected to the fan of the thermal dissipator unit 390. The microcontroller includes circuitry configured to control the fan of the thermal dissipator unit 390. The electronics unit 335 includes a microcontroller connected to the thermoelectric unit 430. The microcontroller includes circuitry configured to control the thermoelectric unit 430, for example by turning it on and off. The electronics unit 335 includes memory.

Figure 10:
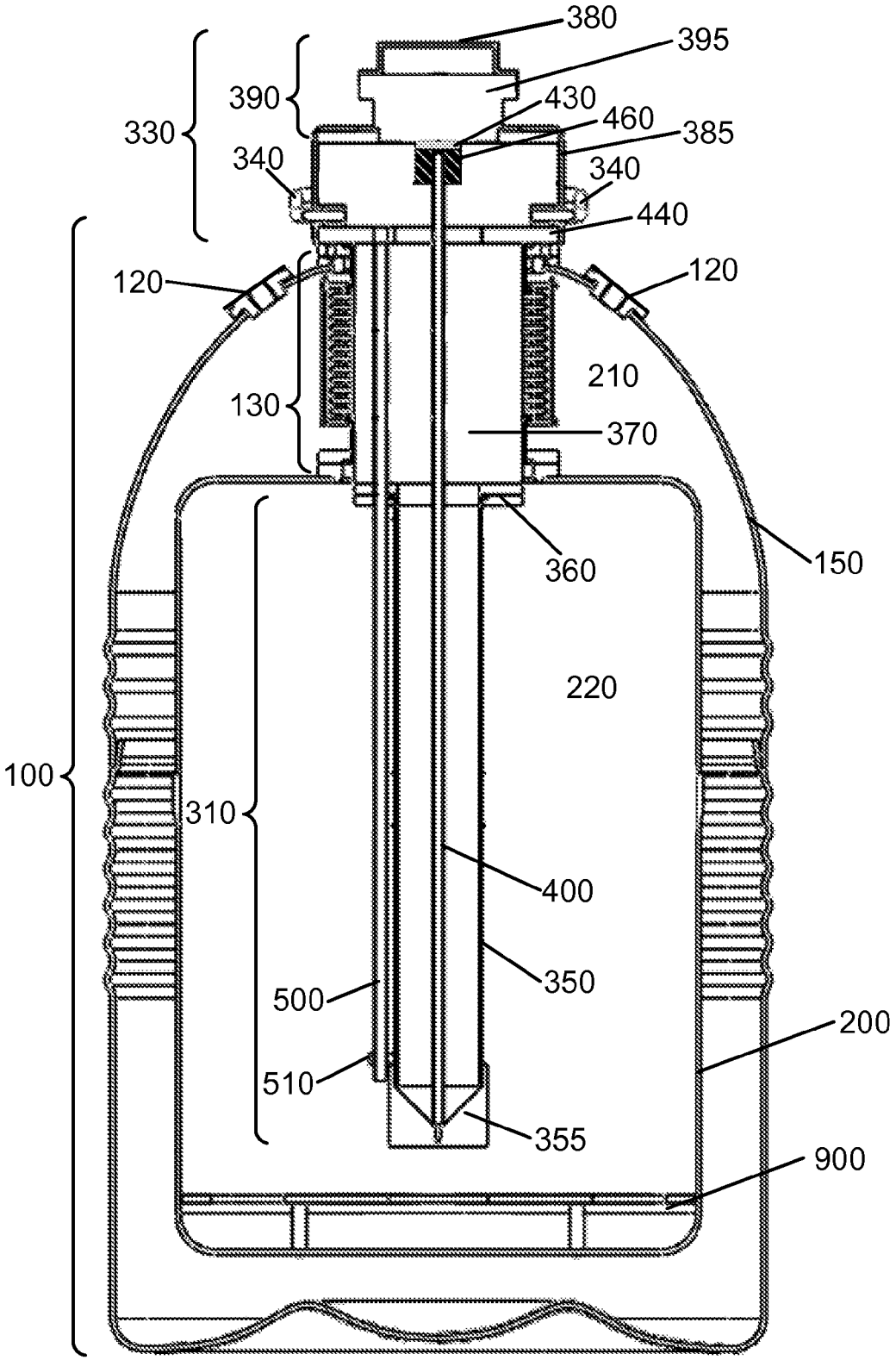
FIG. 10 illustrates a vertical cross-section view of a regulated cooling device in use within a substantially thermally sealed storage container.

FIG. 10 illustrates an embodiment of a regulated cooling device as used with a substantially thermally sealed container 100. The illustration shown in FIG. 10 is a substantially vertical cross-section view of the substantially thermally sealed container 100 and the regulated cooling unit. As depicted in FIG. 10, the regulated cooling device is positioned in a substantially vertical position within the structure of the substantially thermally sealed container 100. The substantially thermally sealed container 100 includes an outer wall 150, an inner wall 200 and a sealed gap 210 between the outer wall 150 and the inner wall 200. Access ports 120 are sealed in the embodiment shown in FIG. 10 to preserve the vacuum within the sealed gap 210.

In the embodiment shown in FIG. 10, the regulated cooling device includes a cooling region 310 positioned within the substantially thermally sealed storage region 220 of the container 100. The cooling region 310 is positioned approximately around the top region of a central, vertical axis of the substantially thermally sealed storage region 220. The cooling region 310 is positioned to not come in physical contact with the inner wall 200 or the storage structure 900. Although storage units are not depicted in FIG. 10, during use of the container 100 they would be positioned adjacent to the cooling region 310 within the substantially thermally sealed storage region 220.

The cooling region 310 of the regulated cooling device includes a thermal heat pipe 400 and an outer wall 350 positioned around the thermal heat pipe 400. An end cap 355 is positioned at the distal end of the outer wall 350 and surrounding the end of the thermal heat pipe 400. A sensor conduit 500 is positioned adjacent to the exterior surface of the outer wall 350. The sensor conduit 500 is located substantially parallel to the outer wall 350, and the thermal heat pipe 400. A fastener 510 holds the sensor conduit 500 in position at the distal end of the sensor conduit 500 in a location adjacent to the end cap 355. As shown in FIG. 10, the sensor conduit 500 continues as a conduit within the insulation unit 370. The region of the sensor conduit 500 within the insulation unit 370 includes one or more connectors, such as wire connectors, between the sensors affixed to the sensor conduit 500 and a microcontroller.

The outer wall 350 of the cooling unit 310 is stabilized in position relative to the insulation unit with a stabilizer 360. An aperture in the stabilizer 360 corresponds with the exterior dimensions of the sensor conduit 500 and a corresponding aperture within the insulation unit 370. The insulation unit 370 includes an outer surface configured to reversibly mate with the inner surface of the single access conduit 130 within the container 100 between the substantially thermally sealed storage region 220 and the region exterior to the container 100.

A lid region 330 is positioned adjacent to the top surface of the container 100. The lid region 330 includes a first wall 385 substantially surrounding the exterior of the lid region 330. The lid region includes a second wall 440 with an outer surface configured to reversibly mate with the external surface of the container 100 in a region adjacent to the exterior edge of the single access conduit 130. The lid region 330 includes a handle 340 positioned to assist a user of the regulated cooling device to move the device, for example into and out of the container 100.

The interior of the lid region 330 includes a thermoelectric unit 430 positioned adjacent to the end of the thermal heat pipe 400. The thermoelectric unit 430 is positioned with maximal thermal contact with the end of the thermal heat pipe 400. A thermal transfer unit 460 surrounds the end of the thermal heat pipe 400 adjacent to the thermoelectric unit 430. The thermal transfer unit 460 is positioned to transfer thermal energy (i.e. heat) from the surface of the end of the thermal heat pipe 400 adjacent to the thermoelectric unit 430 to the thermoelectric unit 430. The lid region 330 also includes a thermal dissipator unit 390 positioned adjacent to a surface of the thermoelectric unit 430 distal to the thermal heat pipe 400. The thermoelectric unit 430 is positioned between the end of the thermal heat pipe 400 and the thermal dissipator unit 390 in order to transfer heat from the end of the thermal heat pipe 400 to the thermal dissipator unit 390. The thermal dissipator unit 390 includes a plurality of thermal fins 395 oriented to transfer heat from the thermoelectric unit 430 to the ambient air surrounding the plurality of thermal fins 395. At least one fan is positioned adjacent to the plurality of thermal fins 395 to increase air flow around the plurality of thermal fins 395. A cover 380 is positioned adjacent to the top edge of the lid region 330. The cover 380 is of a size and shape to permit air flow around the plurality of thermal fins 395.

Figure 11:
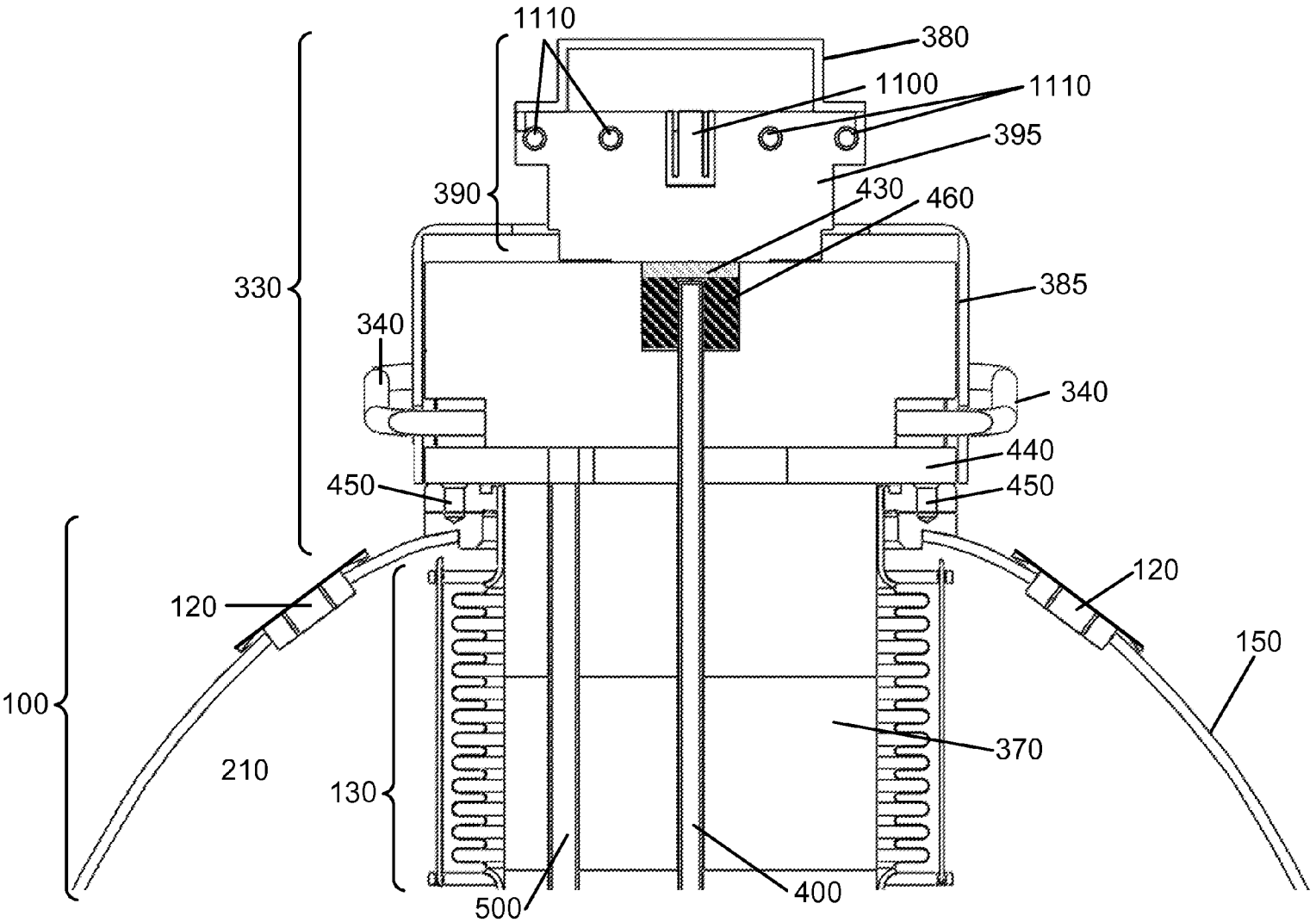
FIG. 11 shows a vertical cross-section view of a section of a regulated cooling device, such as illustrated in FIG. 10.

FIG. 11 depicts an embodiment of a regulated cooling device in use with a substantially thermally sealed container 100. The substantially thermally sealed container 100 includes an outer wall 150 surrounding a gas-sealed gap 210 in the interior of the container 100. A single access conduit 130 is positioned substantially vertically within the substantially thermally sealed container 100. The regulated cooling device includes an adiabatic region with an insulation unit 370. The insulation unit 370 has an outer surface configured to reversibly mate with the surface of the single access conduit 130. The insulation unit 370 includes a sensor conduit 500 within an aperture in the insulation unit 370. The insulation unit 370 includes a thermal heat pipe 400 within an aperture in the insulation unit 370.

In the embodiment shown in FIG. 11, the insulation unit 370 is connected to a lid region 330 of the regulated cooling unit. The lid region 330 includes an outer wall 385 substantially enclosing the outer surface of the lid region 330. The lid region 330 includes a second wall 440 secured to the lid region 330 with fasteners 450. The lid region 330 includes a handle 340 attached to the exterior of the lid region 330. Within the interior of the lid region 330, the thermal heat pipe 400 has a condenser end (the evaporator end of the thermal heat pipe is not illustrated in FIG. 11). Adjacent to the end of the thermal heat pipe 400, and in thermal contact with the end of the thermal heat pipe 400, is a thermoelectric unit 430. The thermoelectric unit 430 is positioned to transfer heat away from the end of the thermal heat pipe 400 and to a thermal dissipator unit 390 positioned adjacent to a surface of the thermoelectric unit 430 distal to the thermal heat pipe 400. A thermal transfer unit 460 surrounds the end of the thermal heat pipe 400 and is in thermal contact with the thermoelectric unit 430, so that heat can move from the end of the thermal heat pipe 400 through the thermal transfer unit 460 and to the adjacent face of the thermoelectric unit 430.

The lid region 330 includes a thermal dissipator unit 390 in thermal contact with the face of the thermoelectric unit 430 distal to the end of the thermal heat pipe 400. The thermal dissipator unit 390 is positioned to transfer heat from the surface of the thermoelectric unit 430 to the environmental air surrounding the thermal dissipator unit 390. In the embodiment shown in FIG. 11, the thermal dissipator unit 390 includes a plurality of thermal fins 395 positioned to transfer heat to the surrounding air. The embodiment of the thermal dissipator unit shown in FIG. 11 also includes a fan unit 1100 positioned adjacent to the plurality of thermal fins 395. In some embodiments, a fan unit can be connected to a microcontroller within the lid region. For example, in some embodiments the action of the fan unit is under control of the attached microcontroller, so that the fan unit is turned on when the thermoelectric unit, also under the control of the microcontroller, is turned on. For example, in some embodiments the action of the fan unit is under control of the attached microcontroller, so that the fan unit is turned on in response to information received and processed by the microcontroller, such as temperature sensor data. For example, in some embodiments the action of the fan unit is under control of the attached microcontroller, so that the fan unit is turned on in response to the microcontroller receiving input from a switch attached to the external surface of the lid region, for example an "on" switch or input from a button switch. In the embodiment illustrated in FIG. 11, the thermal dissipator unit 390 includes a plurality of thermal heat pipes 1110 passing through the plurality of thermal fins 395. The plurality of thermal heat pipes 1110 are oriented to assist in heat transfer to and around the plurality of thermal fins 395. As shown in FIG. 11, the thermal dissipator unit 390 includes a cover 380. The cover 380 is positioned to shield the top of the lid region 330 from physical damage during use, but to permit air flow around the thermal dissipator unit 390, including the plurality of thermal fins 395.

EXAMPLE

Example 1

A Regulated Cooling Device Tested with a Substantially Thermally Sealed Container A regulated cooling device was fabricated as described. The cooling region of the regulated cooling device included four Pt100 resistance temperature sensors in a three-wire configuration. The four temperature sensors were affixed to the outer wall of the cooling region. The four temperature sensors were connected to a microcontroller in the lid region of the device with a wire connector. The microcontroller was configured to send and receive electrical signals from the attached temperature sensors, as well as to record in memory the data received from the attached temperature sensors. The cooling region of the regulated cooling device included water and ice.

As a test of the regulated cooling device in use, the regulated cooling device was positioned within a substantially thermally sealed container, (see, e.g., FIGS. 10 and 11). The regulated cooling device was calibrated to maintain the internal temperature of that container between 0 degrees Centigrade and 8 degrees Centigrade for the duration of the test. The regulated cooling device and associated substantially thermally sealed container were placed in a testing chamber with 32 degree ambient temperature throughout the testing period. The regulated cooling device was provided with 30 W electrical power for 4 hours per 24 hour cycle. No other electrical power or thermal control was provided to the regulated cooling device or to the substantially thermally sealed container. The temperature readings from each of the four temperature sensors positioned adjacent to the cooling region of the regulated cooling device within the substantially thermally sealed storage region of the container were recorded during 15 days of testing.

Figure 12:
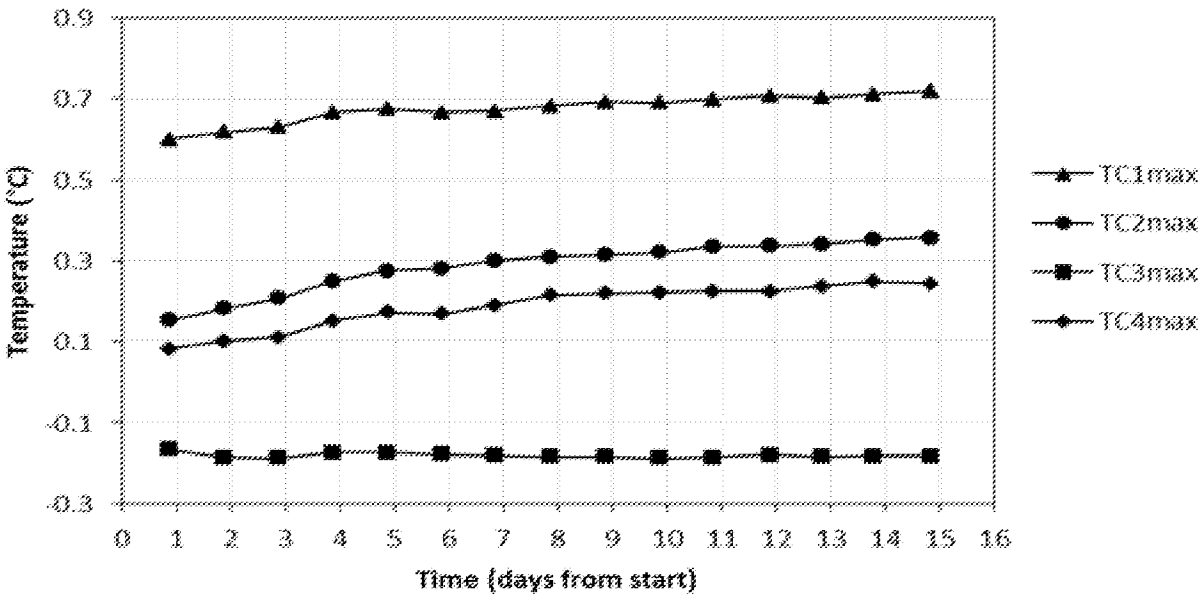
FIG. 12 is a graph illustrating temperature data from a regulated cooling unit over time.

FIG. 12 shows the maximum temperature readings from each of the four temperature sensors in each 24 hour period during the 15 days of the testing period. Temperature data from each of the four temperature sensors (TC1, TC2, TC3 and TC4) is shown as a separate line on the graph. The maximum temperature reading from each sensor on each of the 15 days of the test are shown in FIG. 12. TC1 was positioned adjacent to the end cap of the cooling region. TC4 was positioned adjacent to the outer surface of the cooling region in a position adjacent to the stabilizer. TC2 and TC3 were approximately equally spaced relative to each other between TC1 and TC 4, and positioned adjacent to the outer surface of the cooling region. FIG. 12 shows, inter alia, that the maximum temperature detected by each of the temperature sensors for each individual day of the test increased by less than 0.5 degrees C. through the entire 15 days of the testing period.

The claims, description, and drawings of this application may describe one or more of the instant technologies in operational/functional language, for example as a set of operations to be performed by a computer. Such operational/functional description in most instances refers to specifically-configured hardware (e.g., because a general purpose computer in effect becomes a special purpose computer once it is programmed to perform particular functions pursuant to instructions from program software).

The logical operations/functions described herein are a distillation of machine specifications or other physical mechanisms specified by the operations/functions such that the otherwise inscrutable machine specifications can be comprehensible to a human reader. The distillation also allows for adaptation of the operational/functional description of the technology across many different specific vendors' hardware configurations or platforms, without being limited to specific vendors' hardware configurations or platforms.

Some of the present technical description (e.g., detailed description, drawings, claims, etc.) may be set forth in terms of logical operations/functions. As described in more detail herein, these logical operations/functions are not representations of abstract ideas, but rather are representative of static or sequenced specifications of various hardware elements. The logical operations/functions set forth in the present technical description are representative of static or sequenced specifications of various ordered-matter elements, in order that such specifications can be comprehensible to the human mind and adaptable to create many various hardware configurations. The logical operations/functions disclosed herein are presented for ready understanding and application in a manner independent of a specific vendor's hardware implementation. Differently stated, unless context dictates otherwise, the logical operations/functions should be understood to be representative of static or sequenced specifications of various hardware elements. This is true because tools available to one of skill in the art to implement technical disclosures set forth in operational/functional formats—tools in the form of a high-level programming language (e.g., C, java, visual basic), etc.), or tools in the form of Very high speed Hardware Description Language ("VHDL," which is a language that uses text to describe logic circuits)—are generators of static or sequenced specifications of various hardware configurations. This fact is sometimes obscured by the broad term "software," but this term is a shorthand for a massively complex interchaining/specification of ordered-matter elements. The term "ordered-matter elements" can refer to physical components of computation, such as assemblies of electronic logic gates, molecular computing logic constituents, quantum computing mechanisms, etc.

The state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer can opt for a mainly hardware and/or firmware vehicle; alternatively, if flexibility is paramount, the implementer can opt for a mainly software implementation; or, yet again alternatively, the implementer can opt for some combination of hardware, software, and/or firmware in one or more machines, compositions of matter, and articles of manufacture. Hence, there are several possible vehicles by which the processes and/or devices and/or other technologies described herein can be effected, none of which is inherently superior to the other in that any vehicle to be utilized is a choice dependent upon the context in which the vehicle will be deployed and the specific concerns (e.g., speed, flexibility, or predictability) of the implementer, any of which can vary. Optical aspects of implementations will typically employ optically-oriented hardware, software, and or firmware.

In some implementations described herein, logic and similar implementations can include computer programs or other control structures. Electronic circuitry, for example, can have one or more paths of electrical current constructed and arranged to implement various functions as described herein. In some implementations, one or more media can be configured to bear a device-detectable implementation when such media hold or transmit device detectable instructions operable to perform as described herein. In some variants, for example, implementations can include an update or modification of existing software or firmware, or of gate arrays or programmable hardware, such as by performing a reception of or a transmission of one or more instructions in relation to one or more operations described herein. Alternatively or additionally, in some variants, an implementation can include special-purpose hardware, software, firmware components, and/or general-purpose components executing or otherwise invoking special-purpose components. Specifications or other implementations can be transmitted by one or more instances of tangible transmission media as described herein, optionally by packet transmission or otherwise by passing through distributed media at various times.

Alternatively or additionally, implementations can include executing a special-purpose instruction sequence or invoking circuitry for enabling, triggering, coordinating, requesting, or otherwise causing one or more occurrences of virtually any functional operation described herein. In some variants, operational or other logical descriptions herein can be expressed as source code and compiled or otherwise invoked as an executable instruction sequence. In some contexts, for example, implementations can be provided, in whole or in part, by source code, such as C++, or other code sequences. In other implementations, source or other code implementation, using commercially available and/or techniques in the art, can be compiled/implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) can be manifested as a Verilog-type hardware description (e.g., via Hardware Description Language (HDL) and/or Very High Speed Integrated Circuit Hardware Descriptor Language (VHDL)) or other circuitry model which can then be used to create a physical implementation having hardware (e.g., an Application Specific Integrated Circuit).

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood that each function and/or operation within such block diagrams, flowcharts, or examples can be implemented, individually and/or collectively, by a wide range of hardware, software, firmware, or virtually any combination thereof. In an embodiment, several portions of the subject matter described herein can be implemented via Application Specific Integrated Circuits (ASICs), Field Programmable Gate Arrays (FPGAs), digital signal processors (DSPs), or other integrated formats. However, some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. In addition, aspects of the subject matter described herein are capable of being distributed as a program product in a variety of forms, and an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link (e.g., transmitter, receiver, transmission logic, reception logic, etc.), etc.).

In a general sense, the various aspects described herein which can be implemented, individually and/or collectively, by a wide range of hardware, software, firmware, and/or any combination thereof can be viewed as being composed of various types of "electrical circuitry." As used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). The subject matter described herein can be implemented in an analog or digital fashion or some combination thereof.

At least a portion of the devices and/or processes described herein can be integrated into an image processing system. A typical image processing system generally includes one or more of a system unit housing, a video display device, memory such as volatile or non-volatile memory, processors such as microprocessors or digital signal processors, computational entities such as operating systems, drivers, applications programs, one or more interaction devices (e.g., a touch pad, a touch screen, an antenna, etc.), control systems including feedback loops and control motors (e.g., feedback for sensing lens position and/or velocity; control motors for moving/distorting lenses to give desired focuses). An image processing system can be implemented utilizing suitable commercially available components, such as those typically found in digital still systems and/or digital motion systems.

At least a portion of the devices and/or processes described herein can be integrated into a data processing system. A data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system can be implemented utilizing suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components can be referred to herein as "configured to," "configured by," "configurable to," "operable/operative to," "adapted/adaptable," "able to," "conformable/conformed to," etc. Such terms (e.g. "configured to") generally encompass active-state components and/or inactive-state components and/or standby-state components, unless context requires otherwise.

While particular aspects of the present subject matter described herein have been shown and described, it will be apparent that, based upon the teachings herein, changes and modifications can be made without departing from the subject matter described herein and its broader aspects and, therefore, the appended claims are to encompass within their scope all such changes and modifications as are within the true spirit and scope of the subject matter described herein. It will be understood that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense of the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense of the convention (e.g., "a system having at least one of A, B, or C" would include but not be limited to systems that have A alone, B alone, C alone, A and B together, A and C together, B and C together, and/or A, B, and C together, etc.). It will be further understood that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

The herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent. The various aspects and embodiments disclosed herein are for purposes of illustration and are not intended to be limiting, with the true scope and spirit being indicated by the following claims.

What is claimed is:

1. A regulated cooling device comprising:

a cooling region including an outer wall with an inner surface and an outer surface, at least one temperature sensor positioned adjacent to the outer surface of the outer wall, and a first region of thermal heat pipe positioned within the outer wall substantially parallel to the inner surface, the first region of the thermal heat pipe including a first end with a heat-absorbing interface;

an adiabatic region including an insulation unit, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe, and a second region of the thermal heat pipe positioned adjacent to the inner surface of the insulation unit;

a lid region including a third region of the thermal heat pipe, the third region including a second end with a heat-releasing interface, a thermoelectric unit in contact with the second end of the thermal heat pipe, and a thermal dissipator unit in contact with the thermoelectric unit; and an electronics unit attached to the lid region, including a microcontroller connected to the at least one temperature sensor, to the thermoelectric unit and to the thermal dissipator unit, and an power source attached to the microcontroller.

2. The regulated cooling device of claim 1, wherein the thermal heat pipe is substantially linear.

3. The regulated cooling device of claim 1, wherein the thermal heat pipe comprises:

a textured external surface.

4. The regulated cooling device of claim 1, wherein the cooling region comprises:

a phase change material-retaining unit with an outer boundary substantially formed by the outer wall; and a phase change material within the phase change material-retaining unit.

5. The regulated cooling device of claim 1, wherein the cooling region comprises:

a plurality of temperature sensors positioned adjacent to the outer surface of the outer wall; and a connector between the temperature sensors and the microcontroller of the electronics unit.

6. The regulated cooling device of claim 1, wherein the first region of the thermal heat pipe has an outer surface, the outer surface positioned substantially parallel to the inner surface of the outer wall of the cooling region, with a phase change material-impermeable gap between the outer surface of the heat pipe and the inner surface of the outer wall of the cooling region.

7. The regulated cooling device of claim 1, wherein the cooling region comprises:

an end cap, the end cap attached to the outer surface of the outer wall and aligned with the first end of the thermal heat pipe.

8. The regulated cooling device of claim 1, wherein the largest cross-section diameter of the cooling region is less than the diameter of the outer surface of the insulation unit.

9. The regulated cooling device of claim 1, wherein the adiabatic region comprises:

a wire conduit within the insulation unit, the wire conduit including an internal surface configured to mate with an outer surface of a wire.

10. The regulated cooling device of claim 1, wherein the adiabatic region comprises:

a medicinal storage cup attached to the insulation unit at a region of the insulation unit proximal to the cooling region.

11. The regulated cooling device of claim 1, wherein the lid region comprises:

a surface configured to reversibly mate with an external surface of a substantially thermally sealed storage container.

12. The regulated cooling device of claim 1, wherein the first region of the thermal heat pipe, the second region of the thermal heat pipe, and the third region of the thermal heat pipe are substantially linear.

13. The regulated cooling device of claim 1, wherein the first region of the thermal heat pipe is configured to operate while positioned below the second region of the thermal heat pipe.

14. The regulated cooling device of claim 1, comprising:

a user interface attached to the electronics unit.

15. The regulated cooling device of claim 1, comprising:

a stabilizer unit attached to a first end of the insulation unit and to the outer surface of the outer wall of the cooling region at a position distal to the first end of the thermal heat pipe.

16. A regulated cooling device comprising:

a thermal heat pipe including a first end with a heat-absorbing interface, and a second end with a heat-releasing interface;

an outer wall surrounding the first end of the heat pipe, the outer wall including an inner surface and an outer surface, the outer wall forming a phase change material-impermeable gap around the first end of the heat pipe;

an end cap, the end cap sealed to an edge of the outer wall distal to the first end of the heat pipe;

a phase change material within the phase change material-impermeable gap around the first end of the heat pipe;

at least one temperature sensor positioned adjacent to the outer wall;

an insulation unit surrounding the heat pipe at a region between the first end and the second end, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe at the region between the first end and the second end;

a thermoelectric unit in contact with the second end of the thermal heat pipe;

a thermal dissipator unit in contact with the thermoelectric unit;

a microcontroller connected to the at least one temperature sensor, to the thermoelectric unit and to the thermal dissipator unit; and an power source attached to the microcontroller.

17. The regulated cooling device of claim 16, wherein the thermal heat pipe is substantially linear.

18. The regulated cooling device of claim 16, wherein the outer wall surrounding the first end of the heat pipe is substantially transparent.

19. The regulated cooling device of claim 16, wherein the outer wall is fabricated from a polycarbonate plastic material.

20. The regulated cooling device of claim 16, wherein the inner surface of the outer wall surrounding the first end of the heat pipe is a textured surface.

21. The regulated cooling device of claim 16, wherein the external diameter of the outer wall surrounding the first end of the heat pipe is smaller than the external diameter of the outer surface of the insulation unit.

22. The regulated cooling device of claim 16, wherein the insulation unit comprises:

a wire conduit within the insulation unit, the wire conduit including an internal surface configured to mate with an outer surface of a wire.

23. The regulated cooling device of claim 16, comprising:

a plurality of temperature sensors positioned adjacent to the outer surface of the outer wall surrounding the first end of the heat pipe; and a connector between the plurality of temperature sensors and the microcontroller.

24. The regulated cooling device of claim 16, comprising:

a lid enclosure surrounding the thermal dissipator unit and the microcontroller, the lid enclosure including at least one first wall including a plurality of apertures, the lid enclosure including at least one second wall with an external surface configured to reversibly mate with an external surface of the substantially thermally sealed storage container.

25. The regulated cooling device of claim 16, comprising:

a medicinal storage cup attached to the insulation unit at a region of the insulation unit proximal to the outer wall forming the phase change material-impermeable gap.

26. A regulated cooling device comprising:

a substantially tubular thermal heat pipe including a first end with a heat-absorbing interface, and a second end with a heat-releasing interface;

a phase change material-retaining unit surrounding the first end of the thermal heat pipe, the phase change material-retaining unit including an outer wall surrounding the first end of the heat pipe, the outer wall including an inner surface and an outer surface, the outer wall forming a phase change material-impermeable gap around the first end of the heat pipe, the inner surface positioned substantially parallel to an outer surface of the thermal heat pipe, an end cap sealed to a first edge of the outer wall distal to the first end of the heat pipe, and a phase change material within the phase change material-impermeable gap;

a sensor conduit attached to the outer surface of the outer wall of the phase change material-retaining unit, the sensor conduit including a first temperature sensor positioned to detect temperature in a location adjacent to the end cap, and a second temperature sensor positioned to detect temperature in a location adjacent to the outer wall distal to the end cap;

at least one capacitance sensor attached to the outer surface of the phase change material-retaining unit and positioned to detect capacitance across the phase change material within the phase change material-impermeable gap;

an insulation unit surrounding the heat pipe at a region between the first end and the second end, the insulation unit including a lower surface sealed to a second edge of the outer wall of the phase change material-retaining unit, the insulation unit including an outer surface of a size and shape to reversibly mate with a surface of an access conduit within a substantially thermally sealed storage container, the insulation unit including an inner surface of a size and shape to reversibly mate with an outer surface of the thermal heat pipe at the region between the first end and the second end;

an electronics conduit within the insulation unit, the electronics conduit including one or more wires attached to the first and second temperature sensors within the sensor conduit;

a thermoelectric unit in thermal contact with the second end of the thermal heat pipe;

a thermal dissipator unit in thermal contact with the thermoelectric unit;

a microcontroller connected to the one or more connectors attached to the first and second temperature sensors, to the at least one capacitance sensor, to the thermoelectric unit and to the thermal dissipator unit; and an power source attached to the microcontroller.

27. The regulated cooling device of claim 26, wherein the substantially tubular thermal heat pipe is substantially linear.

28. The regulated cooling device of claim 26, wherein the substantially tubular thermal heat pipe comprises:

a textured external surface.

29. The regulated cooling device of claim 26, wherein the sensor conduit comprises:

at least one additional sensor.

30. The regulated cooling device of claim 26, comprising:

a user interface attached to the microcontroller.

31. The regulated cooling device of claim 26, comprising:

a medicinal storage cup attached to the insulation unit at a region of the insulation unit proximal to the lower surface of the insulation unit.

* * * * *